US006691375B1

(12) United States Patent
Savicki

(10) Patent No.: US 6,691,375 B1
(45) Date of Patent: Feb. 17, 2004

(54) CLOSURE DEVICE AND METHOD OF ASSEMBLY

(75) Inventor: Alan F. Savicki, Naperville, IL (US)

(73) Assignee: The Glad Products Company, Oakland, CA (US)

( * ) Notice: Subject to any disclaimer, the term of this patent is extended or adjusted under 35 U.S.C. 154(b) by 0 days.

(21) Appl. No.: 09/980,450

(22) PCT Filed: Jun. 10, 1999

(86) PCT No.: PCT/US99/13222

§ 371 (c)(1),
(2), (4) Date: Nov. 14, 2001

(87) PCT Pub. No.: WO00/76342

PCT Pub. Date: Dec. 21, 2000

(51) Int. Cl.[7] ..... A44B 19/16; A65D 77/10

(52) U.S. Cl. ..... 24/30.5 R; 24/585.1; 383/63; 383/65; 156/66

(58) Field of Search ..... 24/30.5 R, 30.5 P, 24/399, 400, 587, 576, 389, 585.1, 585.12; 383/63–65; 156/66

(56) References Cited

U.S. PATENT DOCUMENTS

| | | | | |
|---|---|---|---|---|
| 2,960,561 A | | 11/1960 | Plummer | |
| 3,343,233 A | | 9/1967 | Gould | |
| 3,426,396 A | | 2/1969 | Laguerre | |
| 3,713,923 A | | 1/1973 | Laguerre | |
| 3,806,998 A | | 4/1974 | Laguerre | |
| 4,199,845 A | | 4/1980 | Ausnit | |
| 4,262,395 A | | 4/1981 | Kosky | |
| 5,007,142 A | | 4/1991 | Herrington | |
| 5,007,143 A | | 4/1991 | Herrington | |
| 5,010,627 A | | 4/1991 | Herrington et al. | |
| 5,020,194 A | | 6/1991 | Herrington et al. | |
| 5,067,208 A | | 11/1991 | Herrington, Jr. et al. | |
| 5,070,583 A | | 12/1991 | Herrington | |
| 5,283,932 A | | 2/1994 | Richardson et al. | |
| 5,301,394 A | | 4/1994 | Richardson et al. | |
| 5,422,838 A | | 6/1995 | Lin | |
| 5,426,830 A | | 6/1995 | Richardson et al. | |
| 5,431,760 A | | 7/1995 | Donovan | |
| 5,442,837 A | | 8/1995 | Morgan | |
| 5,442,838 A | | 8/1995 | Richardson et al. | |
| 5,448,808 A | | 9/1995 | Gross | |
| 5,664,299 A | | 9/1997 | Porchia et al. | |
| 6,014,795 A | * | 1/2000 | McMahon et al. | 24/400 |
| 6,047,450 A | * | 4/2000 | Machacek et al. | 24/399 |
| 6,306,071 B1 | * | 10/2001 | Tomic | 493/213 |
| 6,385,818 B1 | * | 5/2002 | Savicki, Sr. | 24/30.5 R |
| 6,490,769 B2 | * | 12/2002 | Siegel | 24/415 |

FOREIGN PATENT DOCUMENTS

| | | |
|---|---|---|
| FR | 1564039 | 4/1996 |

* cited by examiner

*Primary Examiner*—Anthony Knight
*Assistant Examiner*—Andre' L. Jackson
(74) *Attorney, Agent, or Firm*—Thomas C. Feix

(57) ABSTRACT

The closure device (121) includes interlocking fastening strips (130, 131) and a slider (132) slidably disposed on the fastening strips for facilitating the occlusion and deocclusion of the fastening strips when moved towards first and second ends thereof. A flexible slider (132) is provided for facilitating the attachment of the slider onto the fastening strips (130, 131) in the vertical Z axis (106). The slider (132) includes legs (240, 242) which provide resistance against the removal of the slider from the fastening strips (130, 131) in the vertical Z axis (106) thereafter. The closure device also provides resistance against the removal of the slider (132) from the fastening strips (130, 131) in the horizontal X axis (102).

74 Claims, 40 Drawing Sheets

CLOSURE DEVICE AND METHOD OF ASSEMBLY

FIELD OF THE INVENTION

The present invention relates generally to closure devices and, more particularly, to a slider, interlocking fastening strips and a method of assembly. The inventive closure devices and method may be employed in traditional fastener areas, and is particularly well suited for fastening flexible storage containers, including plastic bags.

BACKGROUND OF THE INVENTION

The use of closure devices for fastening storage containers, including plastic bags, is generally well known. Furthermore, the manufacture of closure devices made of plastic materials is generally known to those skilled in the art, as demonstrated by the numerous patents in this area.

A particularly well-known use for closure devices is in connection with flexible storage containers, such as plastic bags. In some instances, the closure device and the associated container are formed from thermoplastic materials, and the closure device and the side walls of the container are integrally formed by extrusion as a single piece. Alternatively, the closure device and side walls of the container may be formed as separate pieces and then connected by heat sealing or any other suitable connecting process. In either event, such closure devices are particularly useful in providing a closure means for retaining matter within the bag.

Conventional closure devices typically utilize mating fastening strips or closure elements which are used to selectively seal the bag. With such closure devices, however, it is often difficult to determine whether the fastening strips are fully occluded. This problem is particularly acute when the strips are relatively narrow. Accordingly, when such fastening strips are employed, there exists a reasonable likelihood that the closure device is at least partially open.

Such fastening strips devices are also particularly difficult to handle by individuals with limited manual dexterity. Thus, in order to assist these individuals and for ease of use by individuals with normal dexterity, the prior art has also provided sliders for use in opening and closing the fastening strips, as disclosed, for example, in U.S. Pat. Nos. 4,199,845, 5,007,142, 5,007,143, 5,010,627, 5,020,194, 5,070,583, 5,283,932, 5,301,394, 5,426,830, 5,431,760, 5,442,838, and 5,448,808. Some of these sliders include a separator which extends at least partially between the fastening strips. When the slider is moved in the appropriate direction, the separator divides the fastening strips and opens the bag.

During assembly of closure devices utilizing sliders, the sliders are often mounted onto fastening strips by moving the slider over the fastening strips in the vertical axis. Specifically, if the longitudinal axis of the fastening strips and slider is the X axis, the width is the transverse Y axis and the height is the vertical Z axis, the slider is attached to the fastening strips by moving the slider over the fastening strips in the vertical Z axis. In the past, sliders attached in the vertical Z axis have utilized either a multi-part design or folding design with the hinge along the X axis. In either case the slider must be properly positioned along the fastening strip while the slider components are either snapped or ultrasonically welded together. These procedures increase manufacturing costs. Examples of sliders with multiple parts are disclosed in U.S. Pat. Nos. 5,007,142 and 5,283,932 and folding plastic sliders in U.S. Pat. Nos. 5,067,208, 5,070,583, and 5,448,808. Examples of single piece sliders which are inserted on unoccluded fastening strips are disclosed in U.S. Pat. Nos. 3,426,396, 3,713,923, 3,806,998 and 4,262,395.

The prior art has failed to afford a slider that is attached to the fastening strips in the vertical Z axis through a single step process. It would be desirable to have a slider that may be attached to the fastening strips in the vertical Z axis by merely urging the slider over the fastening strips. Such a device would reduce the manufacturing costs of closure devices utilizing sliders in addition to providing an effective and reliable means of attaching sliders to the fastening strips.

OBJECTS OF THE INVENTION

Accordingly, a general object of the present invention is to provide a slider which overcomes the deficiencies of the prior art.

A more specific object of the present invention is to provide a one piece slider that may be attached to the fastening strips in the vertical Z axis by merely urging the slider over the fastening strips.

A related object of the present invention is to provide a slider that once attached prevents itself from being removed from the fastening strips thereafter.

SUMMARY OF THE INVENTION

The inventive slider is intended for use with a storage container which includes a pair of complementary sheets or opposing flexible side walls, such as a plastic bag. The closure device includes interlocking fastening strips disposed along respective edge portions of the opposing side walls, and a slider slidably disposed on the interlocking fastening strips for facilitating the occlusion and deocclusion of the fastening strips when moved towards first and second ends thereof. In accordance with the present invention, a flexible slider is provided for facilitating the attachment of the slider onto the fastening strips in the vertical Z axis. The slider includes legs which provide resistance against the removal of the slider from the fastening strips in the vertical Z axis thereafter. Additionally, the present invention provides resistance against removal of the slider from the fastening strips in the horizontal X axis.

These and other objects, features, and advantages of the present invention will become more readily apparent upon reading the following detailed description of exemplified embodiments and upon reference to the accompanying drawings herein.

While the present invention will be described and disclosed in connection with certain embodiments and procedures, the intent is not to limit the present invention to these embodiments and procedures. On the contrary, the intent is to cover all such alternatives, modifications, and equivalents that fall within the spirit and scope of the present invention as defined by the appended claims.

DESCRIPTION OF THE EMBODIMENTS

Figure 1:
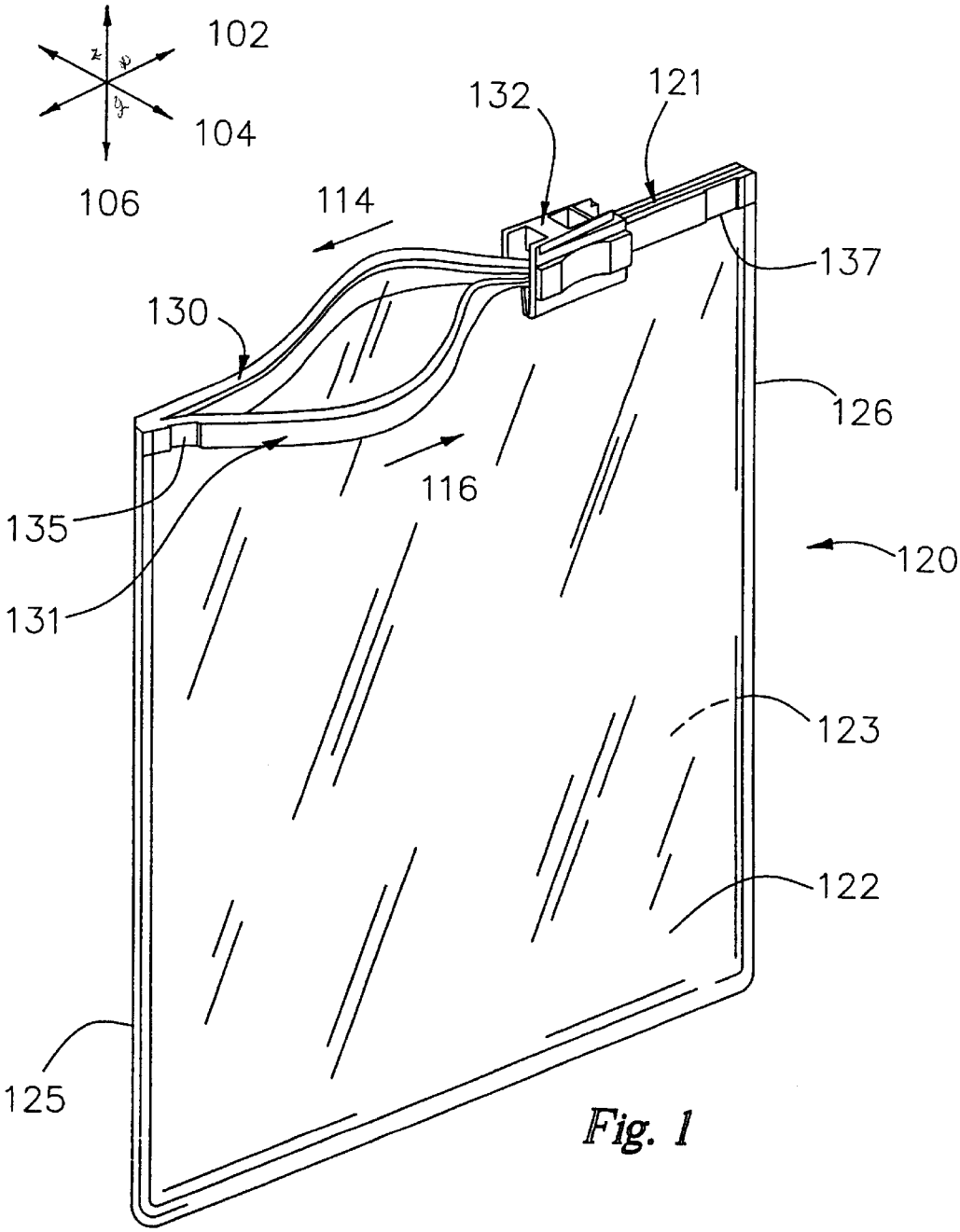
FIG. 1 is a perspective view of a container according to the present invention in the form of a plastic bag.
Figure 2:
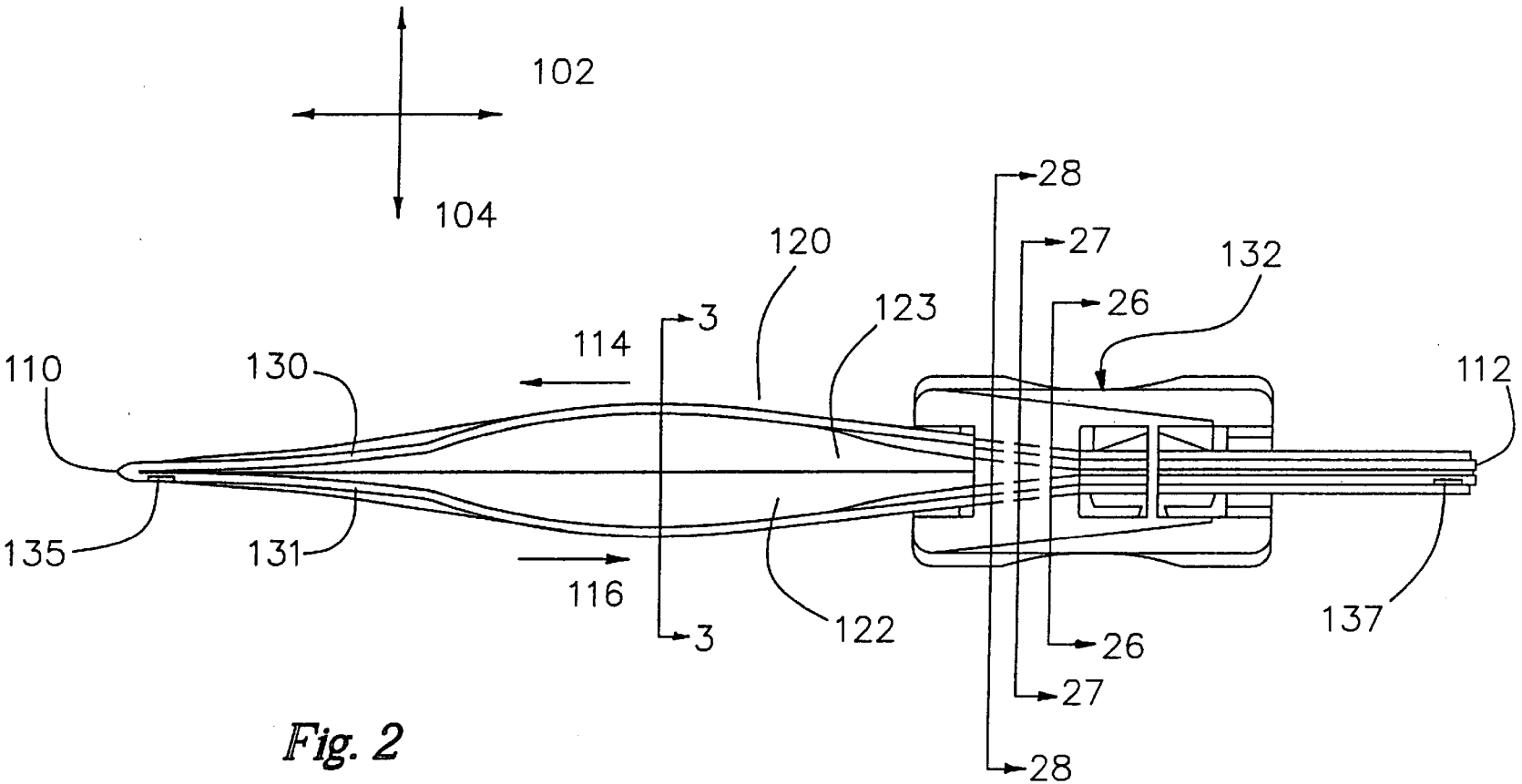
FIG. 2 is a top view of the container in FIG. 1.

FIGS. 1 and 2 illustrate a container in the form of a plastic bag 120 having a sealable closure device 121. The bag 120 includes side walls 122, 123 joined at seams 125, 126 to form a compartment sealable by means of the closure device 121. The closure device 121 comprises first and second fastening strips 130, 131 and a slider 132. The closure device 121 also includes first and second detents 135, 137 along the outside of the fastening strips 130, 131.

The fastening strips 130, 131 and the slider 132 have a longitudinal X axis 102 and a transverse Y axis 104 which is perpendicular to the longitudinal X axis 102. Also, the fastening strips have a vertical Z axis 106 which is perpendicular to the longitudinal X axis 102 and which is perpendicular to the transverse Y axis 104.

In use, the slider 132 of the present invention facilitates the occlusion and deocclusion of the interlocking fastening strips 130, 131 when moved in the appropriate direction along the longitudinal X axis 102 of the fastening strips 130, 131. In particular, the slider 132 facilitates the occlusion of the interlocking fastening strips 130, 131 when moved towards a first end 110 thereof, and facilitates the deocclusion of the interlocking fastening strips 130, 131 when moved towards a second end 112 thereof. When the slider 132 is moved in an occlusion direction, as indicated by reference numeral 114 in FIGS. 1 and 2, closure of the fastening strips 130, 131 occurs. Conversely, when the slider 132 is moved in a deocclusion direction, as indicated by reference numeral 116, separation of the fastening strips 130, 131 occurs.

In keeping with a general aspect of the present invention and as will be described in greater detail below, the interlocking fastening strips 130, 131 of the present invention may be of virtually any type or form including, for example: (1) U-channel fastening strips as best shown herein at FIGS. 3 and 4; (2) arrowhead-type fastening strips, as disclosed in U.S. Pat. Nos. 5,007,142 and 5,020,194, and as shown herein at FIG. 80; (3) profile fastening strips, as disclosed in U.S. Pat. No. 5,664,299 and as shown herein at FIG. 81; and/or (4) rolling action fastening strips as disclosed in U.S. Pat. No. 5,007,143 and as shown herein at FIG. 82. All of the above-identified patents and applications are hereby incorporated by reference in their entireties.

Figure 3:
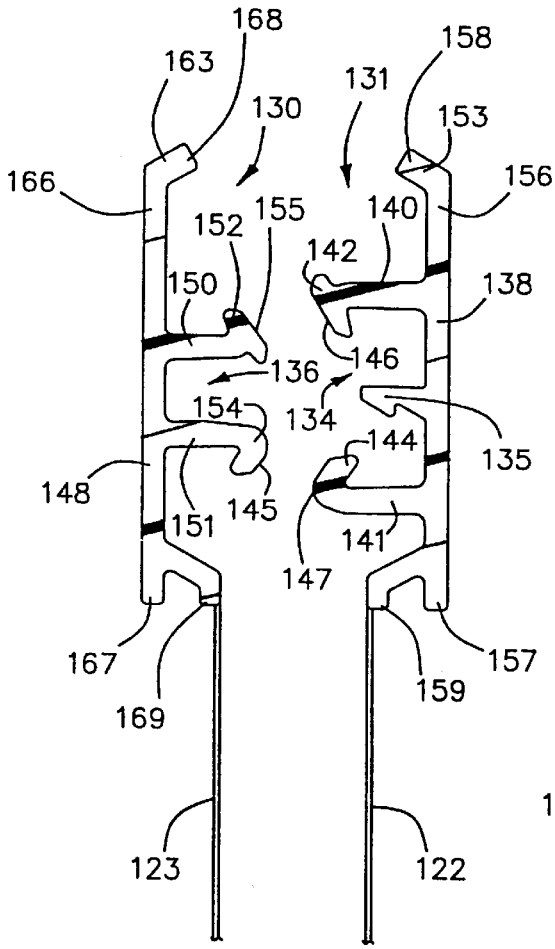
FIG. 3 is a partial cross-sectional view of the fastening strips taken along line 3—3 in FIG. 2.
Figure 4:
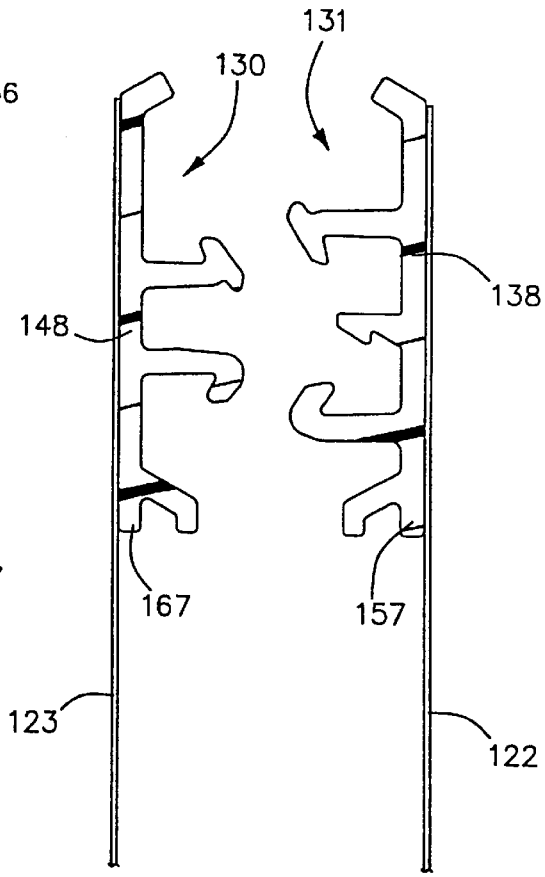
FIG. 4 is another embodiment of attaching the fastening strips.

An illustrative example of the type of closure device that may be used with the present invention is shown in FIG. 3. The fastening strips include a first fastening strip 130 with a first closure element 136 and a second fastening strip 131 with a second closure element 134. The first closure element 136 engages the second closure element 134. The first fastening strip 130 may include a flange 163 disposed at the upper end of the first fastening strip 130 and an outer offset 167 and an inner offset 169, each disposed at the lower end of the first fastening strip 130. Likewise, the second fastening strip 131 may include a flange 153 disposed at the upper end of the second fastening strip 131 and an outer offset 157 and an inner offset 159, each disposed at the lower end of the second fastening strip 131. The flanges 163, 153 include a straight portion 166, 156 and an angled portion 168, 158. The angled portion 168, 158 is at an approximately 120 degree angle to the straight portion 166, 156. The side walls 122, 123 of the plastic bag 120 may be attached to the inner offsets 159, 169 of their respective fastening strips 130, 131 by conventional manufacturing techniques. As shown in FIG. 4, the side walls 122, 123 of the bag 120 may also be attached to the outside surfaces of their respective fastening strips 130, 131, where the outside surfaces comprise the outer offsets 157, 167 and the base portions 138, 148

The second closure element 134 includes a base portion 138 having a pair of spaced-apart parallely disposed webs 140, 141, extending from the base portion 138. The webs 140, 141 include hook closure portions 142, 144 extending from the webs 140, 141 respectively, and facing towards each other. The hook closure portions 142, 144 include guide surfaces 146, 147 which serve to guide the hook closure portions 142, 144 for occluding with the hook closure portions 152, 154 of the first closure element 136.

The first closure element 136 includes a base portion 148 including a pair of spaced-apart, parallely disposed webs 150, 151 extending from the base portion 148. The webs 150, 151 include hook closure portions 152, 154 extending from the webs 150, 151 respectively and facing away from each other. The hook closure portions 152, 154 include guide surfaces 145, 155, which generally serve to guide the hook closure portions 152, 154 for occlusion with the hook closure portions 142, 144 of the second closure element 134. The guide surfaces 145, 155 may also have a rounded crown surface. In addition, the hook closure portions 144, 154 may be designed so that the hook closure portions 144, 154 adjacent the interior of the container provide a greater resistance to opening the closure device 121.

The second fastening strip 131 may or may not include a color enhancement member 135 which is described in U.S. Pat. No. 4,829,641 and which is incorporated by reference.

Figure 5:
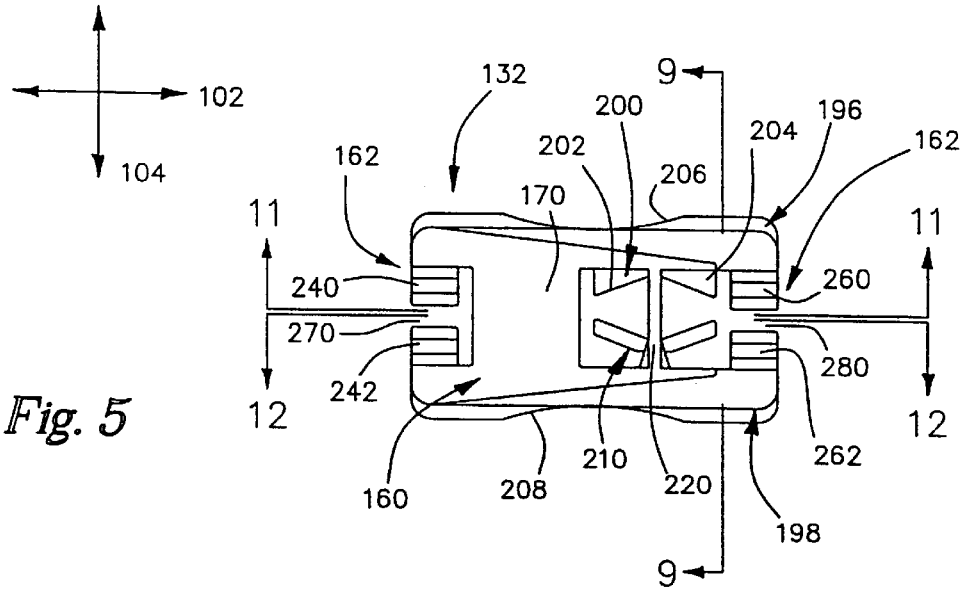
FIG. 5 is a top view of the slider in FIG. 2.
Figure 6:
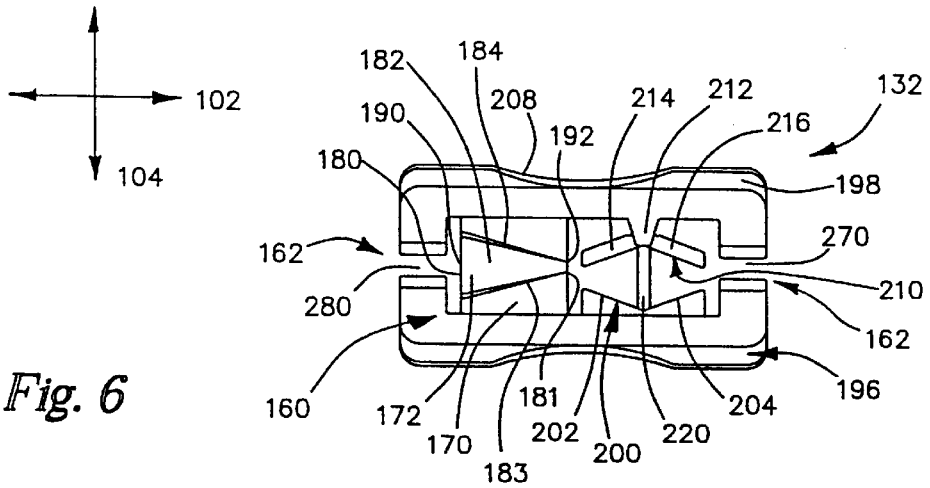
FIG. 6 is a bottom view of the slider in FIG. 2.
Figure 11:
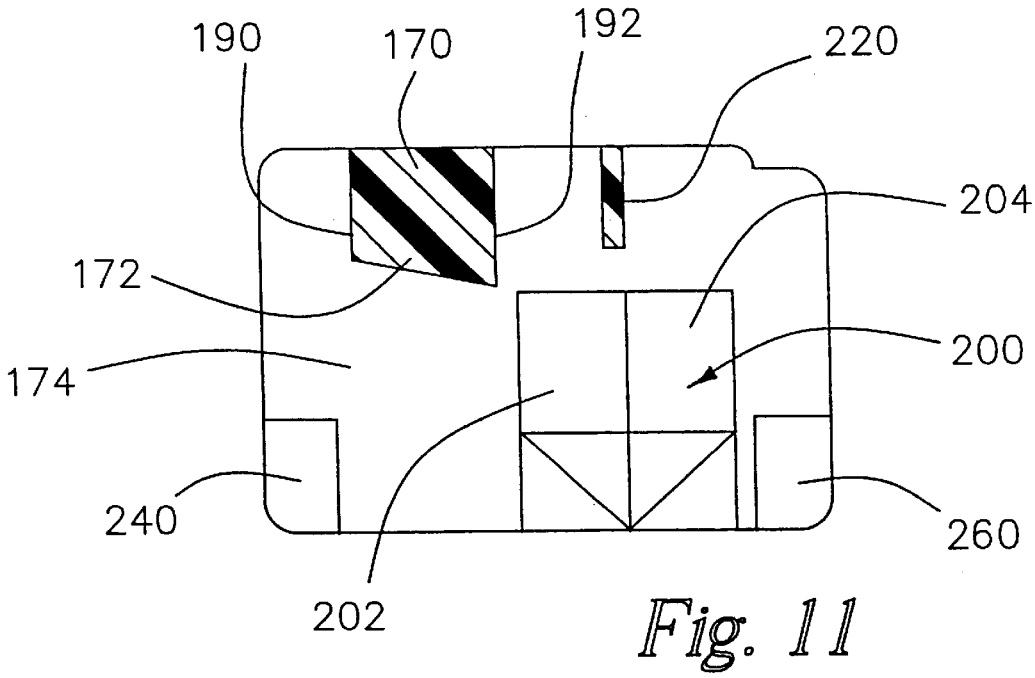
FIG. 11 is a cross-sectional view taken along line 11—11 in FIG. 5.
Figure 12:
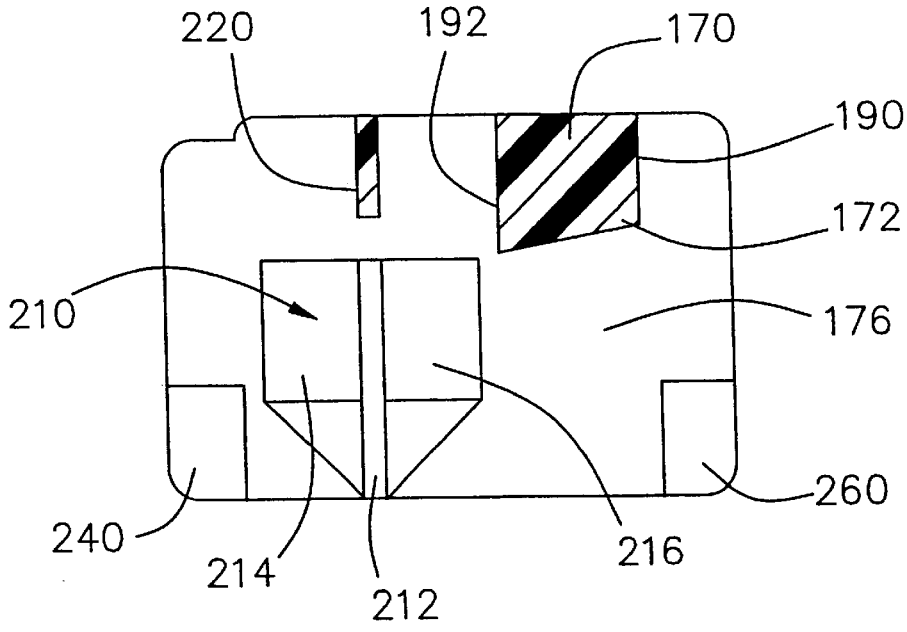
FIG. 12 is a cross-sectional view taken along line 12—12 in FIG. 5.

Referring to FIGS. 5–12, the slider 132 includes a housing 160 and an attaching means 162. The housing 160 may include a top portion 170, a first side portion 174, and a second side portion 176. The top portion 170 provides a separator 172 having a first end 190 and a second end 192 where the first end 190 is wider than the second end 192. The separator 172 also angles downwardly from the first end 190 to the second end 192 as illustrated in FIGS. 11 and 12. The separator 172 is triangular in shape as shown in FIG. 6.

Figure 7:
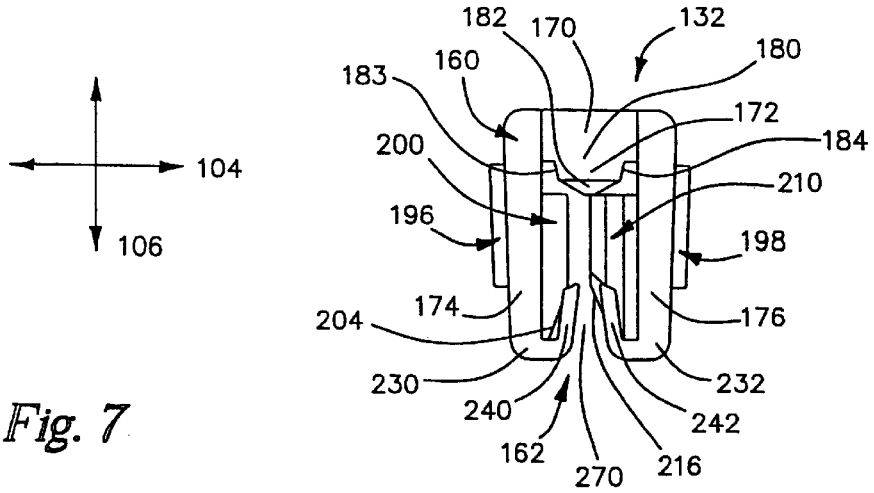
FIG. 7 is a front view of the slider in FIG. 2.
Figure 9:
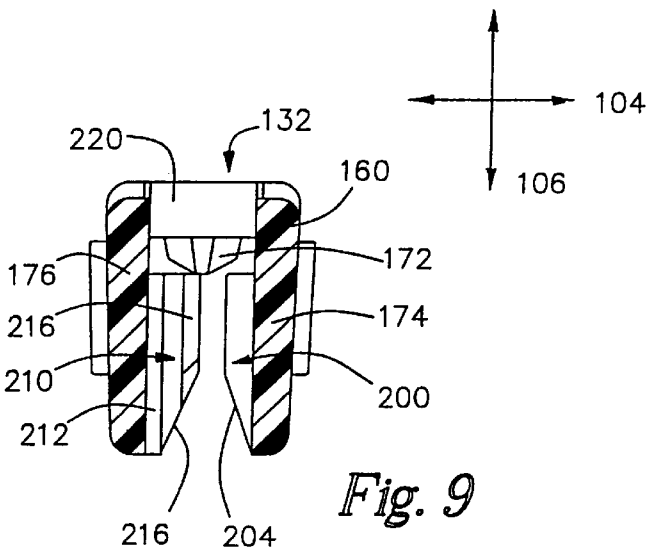
FIG. 9 is a cross-sectional view taken along line 9—9 in FIG. 5.
Figure 8:
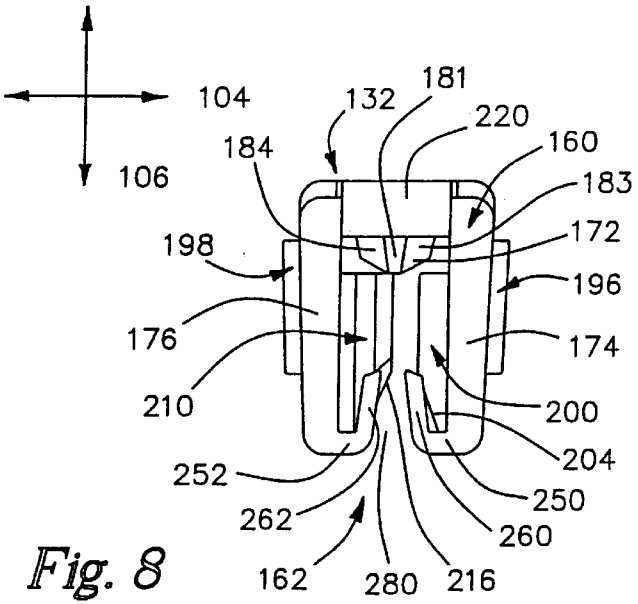
FIG. 8 is a rear view of the slider in FIG. 2.
Figure 10:
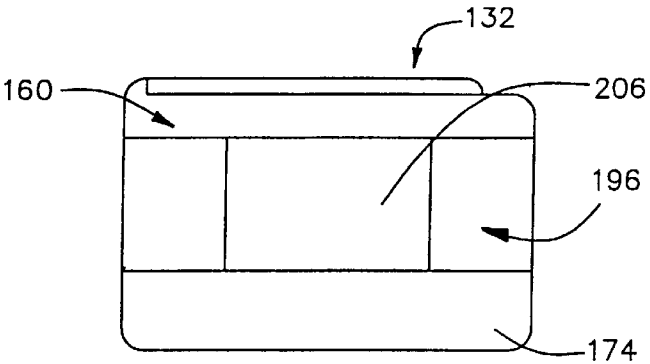
FIG. 10 is a right side view of the slider in FIG. 2.

Referring to FIGS. 7 and 8, the separator 172 has a first surface 180 at the first end 190 and a second surface 181 at the second end 192. The separator 172 has a bottom surface 182. In this embodiment, the bottom surface 182 angles downwardly from the first end 190 to the second end 192 as shown in FIGS. 7, 11 and 12. In addition, the bottom surface 182 angles inwardly from the first end 190 to the second end 192 as shown in FIG. 6. Also, the separator 172 has a first side wall 183 and a second side wall 184 as shown in FIGS. 6–8. The side walls 183, 184 angle inwardly from the first end 190 to the second end 192. The side walls 183, 184 also angle outwardly from the bottom to the top as shown in FIGS. 7 and 8.

The top portion 170 of the slider merges into a first side portion 174 and a second side portion 176. The first side portion 174 has a first grip 196 and a rigid occlusion member 200. Similarly, the second side portion 176 has a second grip 198 and a flexible occlusion member 220. The first grip 196 and the second grip 198 extend laterally along the outer surfaces of the side portions 174, 176 and provide inwardly protruding radial gripping surfaces 206, 208 designed to correspond to the contour of a person's fingertips as viewed in FIGS. 5 and 6. The radial surfaces 206, 208 facilitate grasping the slider 132 during occlusion or deocclusion of the fastening strips 130, 131.

The occlusion members 200, 210 oppose one another and force the fastening strips 130, 131 together to effectuate occlusion of the fastening strips 130, 131 when the slider is moved in the occlusion direction 114. A bridge 220 perpendicularly disposed between the side portions 174, 176 provides reinforcement between the occlusion members 200, 210 to prevent the side portions 174, 176 from flexing during use. As viewed in FIGS. 5 and 6, the rigid occluding member 200 has inner surfaces 202, 204 which angle outwardly thus forming a V-shape. The flexible occlusion member 210 includes a spine 212 and a pair of flexible arms 214, 216. The two flexible arms 214, 216 are attached to and angle inwardly toward the spine 212 thereby forming a V-shape as viewed in FIGS. 5 and 6. The respective V-shapes of the occlusion members 200, 210 facilitate insertion of the fastening strips 130, 131 between the occlusion members 200, 210 by minimizing the surface area resisting insertion of the fastening strips 130, 131 into the slider 132. The flexible occlusion member 210 also permits the use of fastening strips of different and/or varying widths. Specifically, the flexible occlusion member can flex to accommodate fastening strips of different and/or varying widths, but can also exert sufficient force to occlude the fastening strips.

As viewed in FIGS. 5–9, the inner surfaces 202, 204 of the rigid occlusion member 200 taper outwardly in the transverse Y axis 104, ultimately merging into the first side portion 174. Similarly, the arms 214, 216 of the flexible occlusion member 210 also taper outwardly in the transverse Y axis 104. The tapered surfaces of the occlusion members 200, 210 serve to guide the fastening strips 130, 131 between the occluding members 200, 210 during attachment of the slider 132 onto the fastening strips 130, 131.

The attaching means 162 includes a pair of front flexible shoulders 230, 232, a pair of front legs 240, 242, a pair of rear flexible shoulders 250, 252, and a pair of rear legs 260, 262. As viewed in FIG. 7, the first side portion 174 merges into the first front leg 240 through the first front shoulder 230. Likewise, the second side portion 176 merges into the second front leg 242 through the second front shoulder 232. The front legs 240, 242 angle inwardly in the transverse Y axis 104 thereby forming a front slot 270 of substantially uniform width as seen in FIGS. 5 and 6.

Similarly, as viewed in FIG. 8, the first side portion 174 merges into the first rear leg 260 through the first rear shoulder 250. Also, the second side portion 176 merges into the second rear leg 262 through the second rear shoulder 252. The rear legs 260, 262 angle inwardly in the transverse Y axis 104 thus forming a rear slot 280 of substantially uniform width. In a relaxed state, the legs 240, 242, 260, 262 of the slider 132 angle inwardly away from their respective side portions 174, 176 to form a void volume through which the legs 240, 242, 260, 262 may move outwardly in the transverse Y axis 104 during attachment of the slider 132 onto the fastening strips 130 131.

In accordance with an aspect of the present invention, a flexible slider 132 is provided to attach the slider 132 to the fastening strips 130, 131 in the vertical Z axis 106 while preventing the slider 132 from being removed from the fastening strips 130, 131 in the vertical Z axis 106 thereafter. It will be appreciated by those skilled in the art that the slider 132 may be molded from any suitable plastic material.

Figure 15:
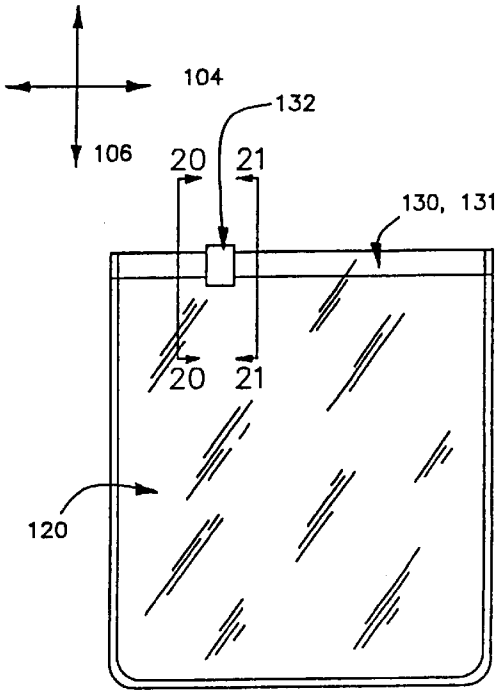
FIG. 15 is a side view of the container in FIG. 1 and illustrates the slider fully attached to the fastening strips.
Figure 14:
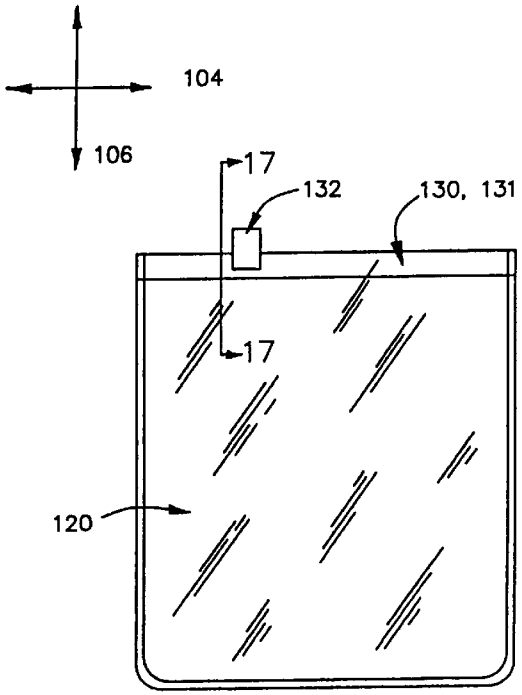
FIG. 14 is a side view of the container in FIG. 1 and illustrates the slider as it is positioned onto the fastening strips.
Figure 13:
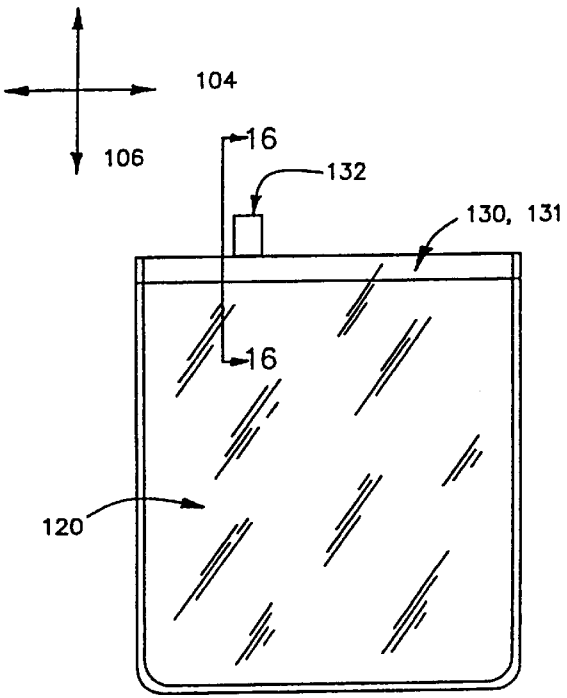
FIG. 13 is a side view of the container in FIG. 1 and illustrates the slider positioned above the fastening strips.

FIGS. 13–15 sequentially illustrate the attachment of a slider 132 made in accordance with the present invention onto the fastening strips 130, 131 of a plastic bag 120 in the vertical Z axis 106. FIG. 13 represents the slider 132 positioned directly over the fastening strips 130, 131. FIG. 14 illustrates the slider as it is moved downwardly in the vertical Z axis 106 and positioned onto the fastening strips 130, 131. FIG. 15 shows the slider 132 as it is moved further in the vertical Z axis 106 and represents the slider 132 fully attached to the fastening strips 130, 131 of the plastic bag 120.

FIGS. 16–19 sequentially illustrate the attachment of the slider 132 onto the fastening strips 130, 131 in the vertical Z axis 106. Although the following description will be limited to the slider components illustrated in the respective view described, it will be appreciated that the other slider components will function in a similar fashion. For example, the front legs 240, 242 of the slider 132 will operate in the same fashion as the rear legs 260, 262 of the slider 132 during attachment of the slider 132 onto the fastening strips 130, 131.

Figure 17:
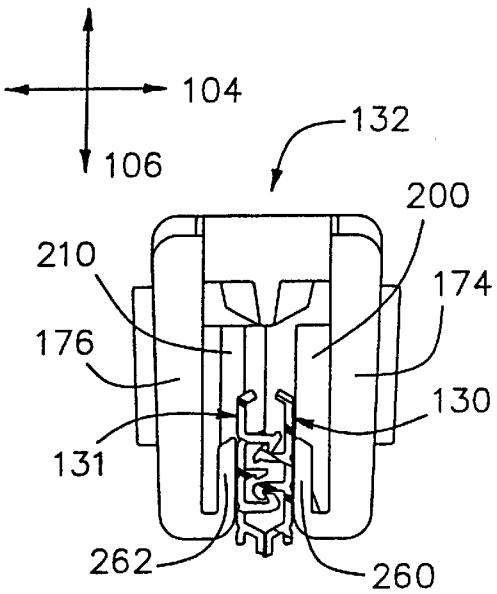
FIG. 17 is a cross-sectional view taken along line 17—17 in FIG. 14 and illustrates the respective positions of the slider to the fastening strips as the slider is positioned onto the fastening strips.
Figure 16:
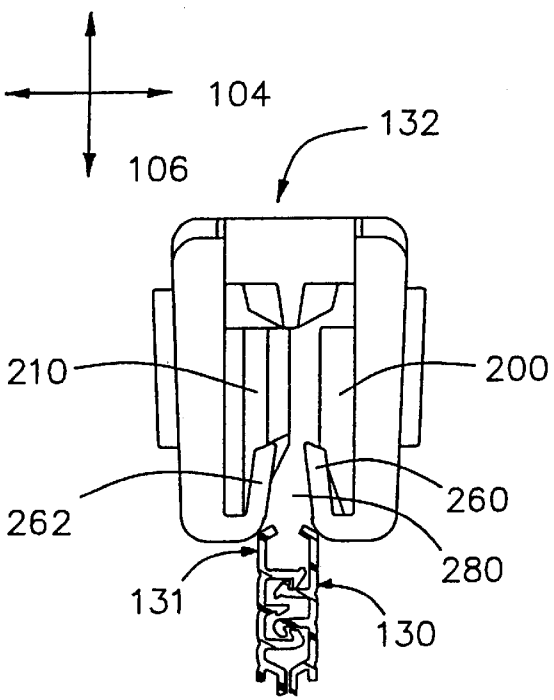
FIG. 16 is a cross-sectional view taken along line 16—16 in FIG. 13 and illustrates the slider positioned above the fastening strips.

FIG. 16 depicts occluded fastening strips 130, 131 and a slider 132 having first and second rear legs 260, 262 in a relaxed position. The occluded fastening strips 130, 131 are immediately below the rear slot 280. Referring to FIG. 17, the slider 132 is moved in the vertical Z axis 106 toward the fastening strips 130, 131. The fastening strips 130, 131 engage the rear legs 260, 262 and deflect the legs 260, 262 outwardly in the transverse Y axis 104 toward their respective side portions 174, 176 thus widening the rear slot 280. The fastening strips 130, 131 are guided into the slider 132 by the tapered surfaces of the occlusion members 200, 210.

Figure 18:
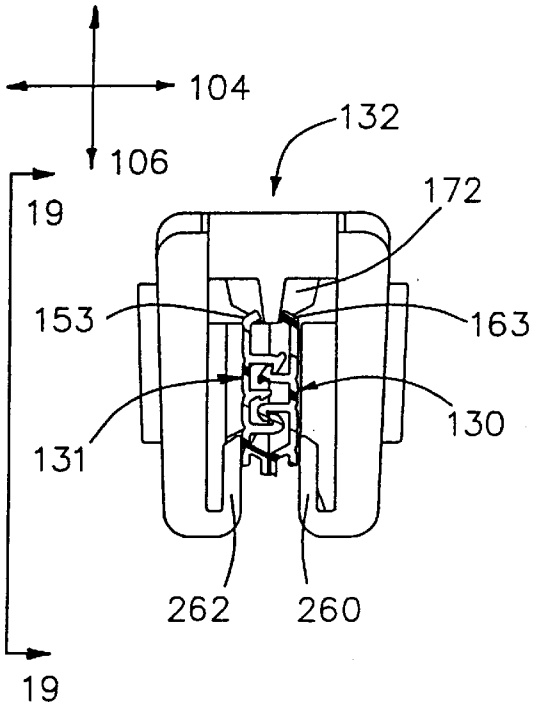
FIG. 18 is a rear view of the slider and cross-sectional view of the fastening strips and illustrates their respective positions to one another as the slider is positioned onto the fastening strips.
Figure 19:
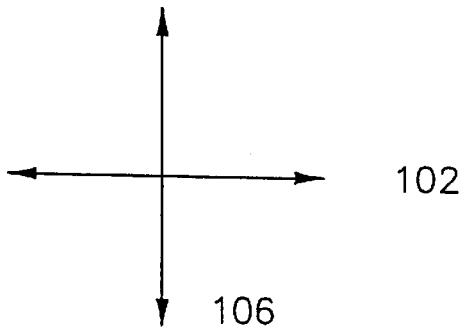
FIG. 19 is an enlarged fragmentary view of the slider and fastening strips in FIG. 18.
Figure 19:
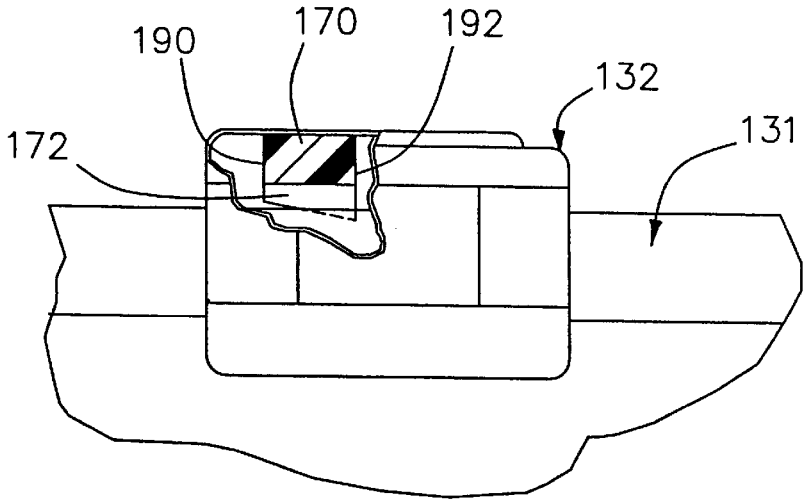

FIG. 18 illustrates the fastening strips 130, 131 moving through the rear slot 280. The separator 172 begins to penetrate between the flanges 153, 163 of the fastening strips 130,131. In this position, the second end 192 of the separator 172 has penetrated between the fastening strips 130, 131, whereas the first end 190 of the separator 172 is still positioned above the fastening strips 130, 131 as illustrated in FIG. 19. This effect is achieved by the separator 172 design which, as stated above, angles downwardly from the first end 190 to the second end 192. As such, the second end 192 of the separator 172 serves to initially penetrate the occluded fastening strips 130, 131 and positions the separator 172 between the fastening strips 130, 131 before full attachment is achieved.

Figure 21:
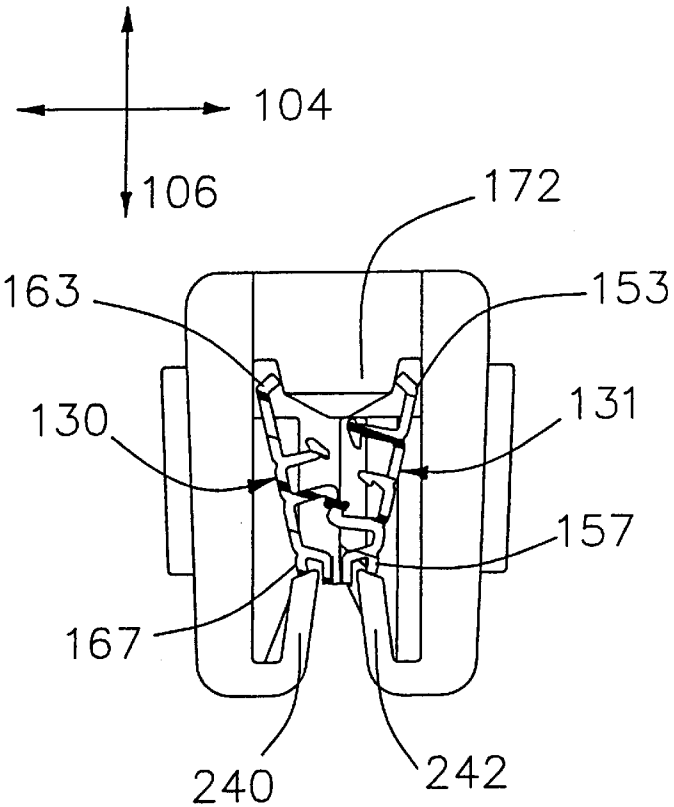
FIG. 21 is a cross-sectional view taken along line 21—21 in FIG. 15 and illustrates the slider fully attached to the fastening strips.
Figure 20:
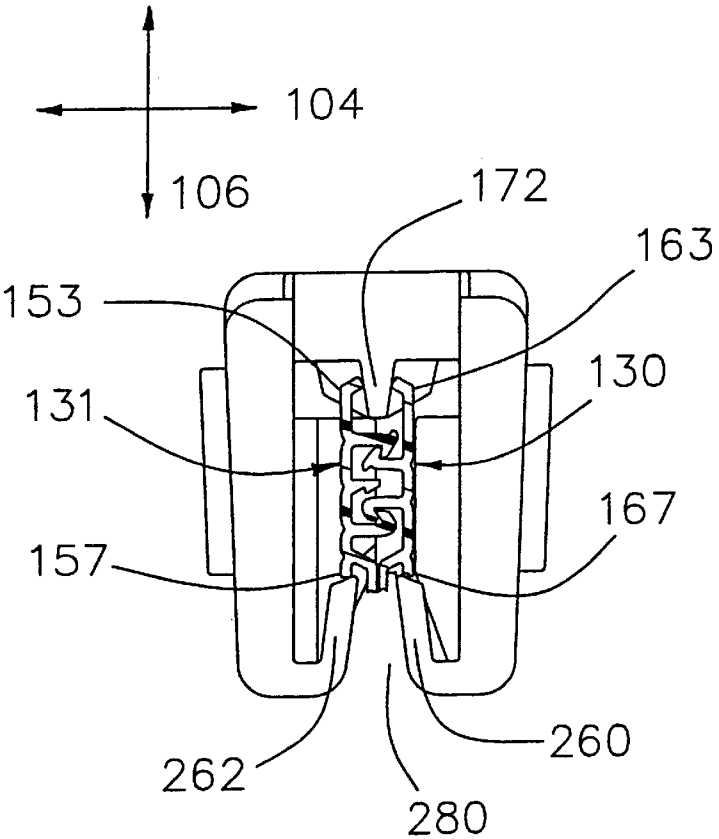
FIG. 20 is a cross-sectional view taken along line 20—20 in FIG. 15 and illustrates the slider fully attached to the fastening strips.

As shown in FIG. 20, upon further movement of the fastening strips 130, 131 toward the slider 132 in the vertical Z axis 106, the fastening strips 130, 131 project through the legs 260, 262, and the legs 260, 262 retract back to their relaxed position. Likewise, the width of the rear slot 280 returns to its relaxed position width. With respect to the fastening strips 130, 131, the separator 172 is forced between the flanges 153, 163 of the occluded fastening strips 130, 131. The first end 190 of the separator 172, the wider end, is forced between and effectively deoccludes the fastening strips 130, 131 as illustrated in FIG. 21. The penetration and deocclusion is discussed more fully with respect to FIGS. 22–25.

FIGS. 20 and 21 represent the attached position of the slider 132 on fastening strips 130, 131. As illustrated in FIG. 20, once the legs 260, 262 return to their relaxed position, the fastening strips 130, 131; no longer fit through the slot 280. As an aspect of the present invention, the legs 260, 262 effectuate attachment of the slider 132 onto the fastening strips 130, 131 in the vertical Z axis 106 while preventing removal of the slider 132 from the fastening strips 130, 131 in the vertical Z axis 106 after the slider 132 has been attached to the fastening strips 130, 131. In the event removal of the slider 132 in the vertical Z axis 106 is attempted, the legs 260, 262 will provide resistance against removal of the slider 132. The legs 260, 262 retain the slider 132 on the fastening strips 130, 131 by resisting vertical Z axis 106 movement of the fastening strips 130, 131 through the slot 280. More specifically, the legs 260, 262, are angled upwardly and inwardly so that during insertion of the slider 132 onto the fastening strips 130, 131 the legs 260, 262 deflect outwardly in the transverse Y axis 104 to increase the width of the slot 280 and permit the passage of the fastening strips 130, 131. When attempting to remove the slider 132 from the fastening strips 130, 131 in the vertical Z axis 106, the outer offsets 157, 167 of the fastening strips 130, 131 contact the legs 260, 262 and deflect the legs 260, 262 inwardly in the transverse Y axis 104. Thus, the width of the slot 280 is reduced until the legs 260, 262 are ultimately forced against one another. The rigidity of the legs 260, 262 and shoulders 250, 252 will resist inward movement of the legs 260, 262 beyond the point where the legs 260, 262 engage one another. As a result, the slider 132 may only be removed from the fastening strips 130, 131 in the vertical Z axis 106 by either tearing through the fastening strips 130, 131 or breaking and/or by deforming the legs 260, 262 of the slider 132.

Figures 22, 23, 24, 25:
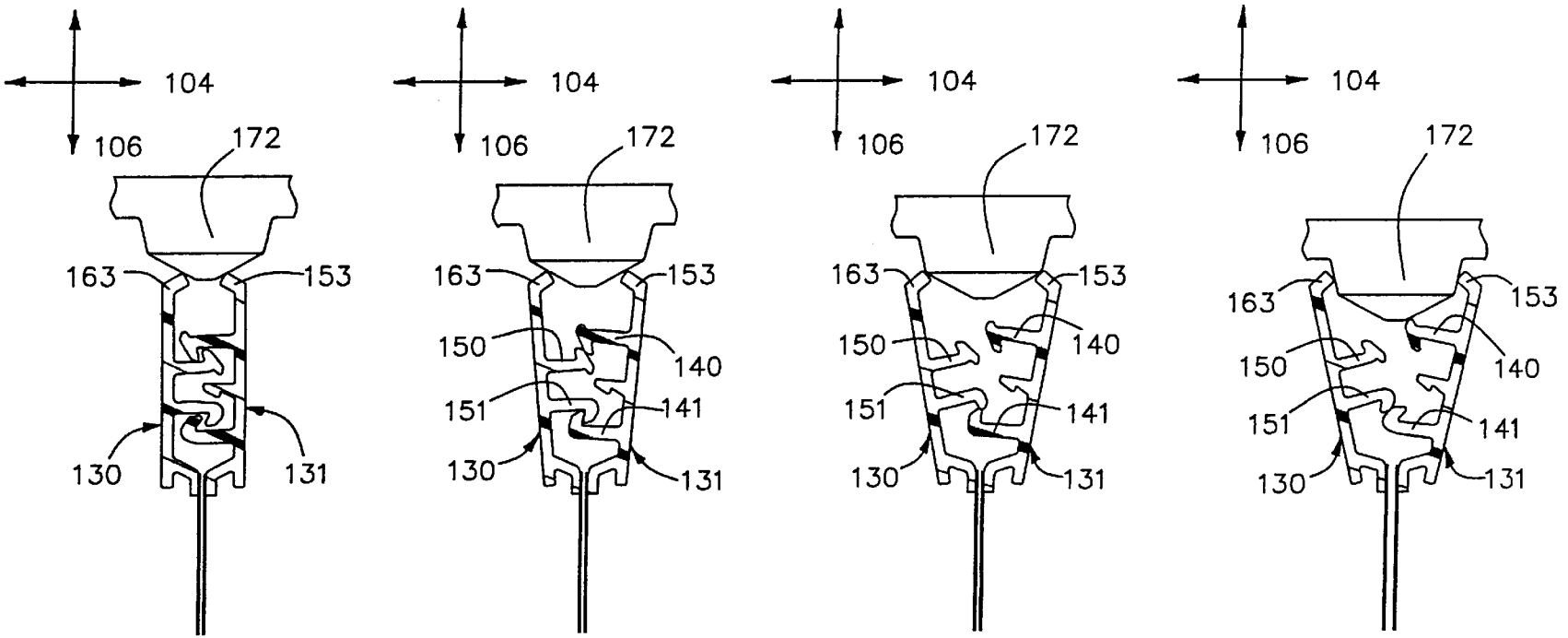
FIG. 22 is a front view of the separator and cross-sectional view of the fastening strips and illustrates their respective positions to one another as the slider is positioned onto the fastening strips.
FIG. 23 is a front view of the separator and cross-sectional view of the fastening strips and illustrates their respective positions to one another as the slider is positioned onto the fastening strips.
FIG. 24 is a front view of the separator and cross-sectional view of the fastening strips and illustrates their respective positions to one another as the slider is positioned onto the fastening strips.
FIG. 25 is a front view of the separator and cross-sectional view of the fastening strips and illustrates their respective positions to one another as the slider is positioned onto the fastening strips.

FIGS. 22–25 sequentially illustrate the first end 190., the wider end, of the separator 172 penetrating the occluded fastening strips 130, 131 during attachment of the slider 132 onto the fastening strips 130, 131 in the vertical Z axis 106. FIG. 22 depicts the separator 172 immediately above the occluded fastening strips 130, 131 in a position prior to penetration by the separator 172. Referring to FIG. 23, the separator 172 is moved downwardly in the vertical Z axis 106 and forced between the flanges 153, 163 of the fastening strips 130, 131. The fastening strips 130, 131 are forced apart in the transverse Y axis 104 and the upper webs 140, 150 of the fastening strips 130, 131 are effectively deoccluded. As the separator 172 penetrates further between the flanges 153, 163 of the fastening strips 130, 131, the lower webs 141, 151 of the fastening strips 130, 131 also begin to deocclude as illustrated in FIG. 24. FIG. 25 shows the separator 172 once it has fully penetrated the fastening strips 130, 131. At this position both the upper webs 140, 141 and the lower webs 150, 151 of the fastening strips 130, 131 are deoccluded and attachment of the slider 172 to the fastening strips 130, 131 is complete. The flanges 153, 163 of the fastening strips 130, 131 are the only separator 172 engaging surfaces of the fastening strips 130, 131. As such, the slider 132 need not force itself between the webs 140, 141, 150, 151 of the fastening strips 130, 131.

Figures 26, 27, 28:
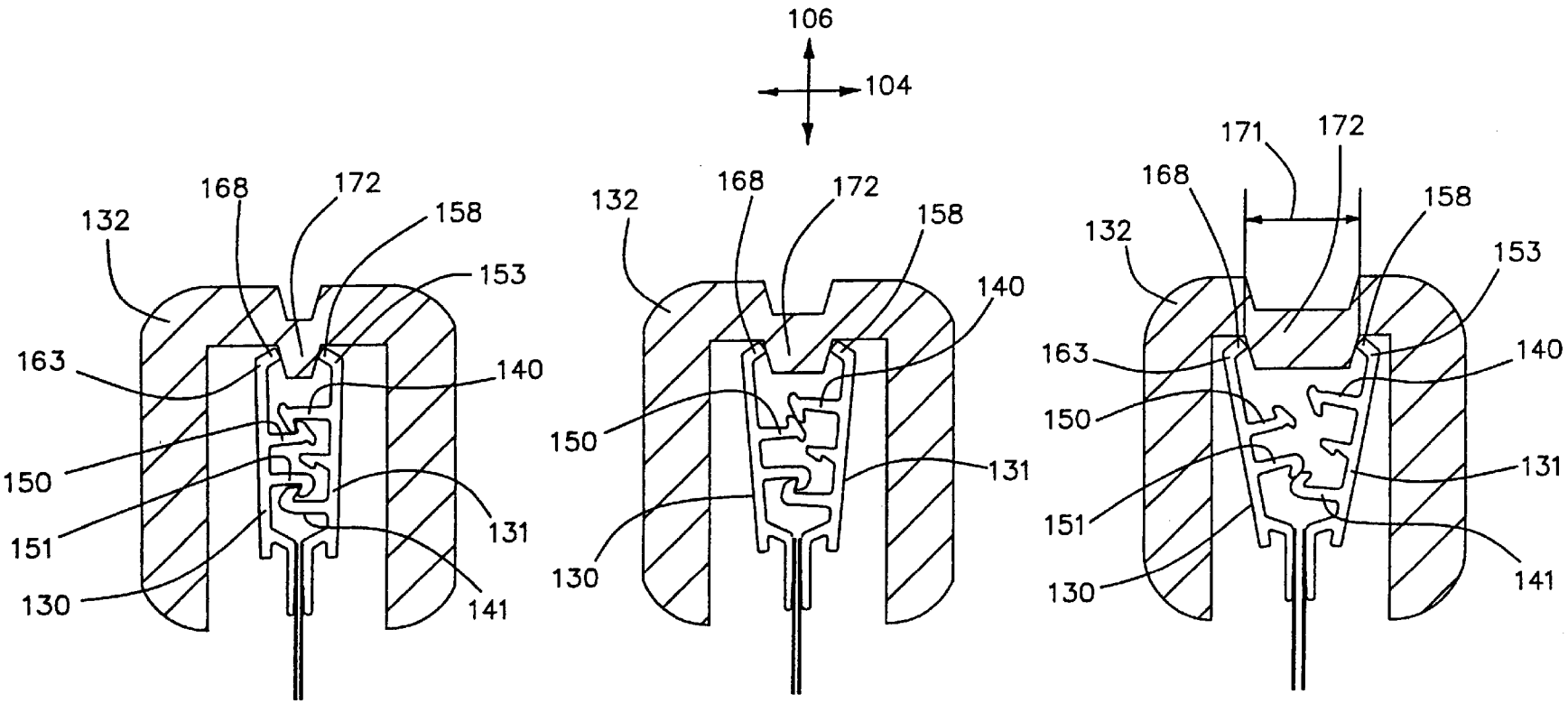
FIG. 26 is a cross-sectional view taken along line 26—26 in FIG. 2.
FIG. 27 is a cross-sectional view taken along line 27—27 in FIG. 2.
FIG. 28 is a cross-sectional view taken along line 28—28 in FIG. 2.

FIGS. 26–28 illustrate the fastening strips 130, 131 at different locations along the separator 172 of the slider 132 as shown in FIG. 2. FIG. 26 depicts the fastening strips 130, 131 at a location near the second end 192 (the narrow end) of the separator 172. The separator 172 is located between the flanges 153, 163 of the fastening strips 130, 131. At this location, the upper webs 140, 150 and the lower webs 141, 151 are occluded. FIG. 27 illustrates the fastenings strips 130, 131 at a location near the middle of the separator 172. The width of the separator 172 at this location forces the fastening strips 130, 131 apart in the transverse Y axis 104 and the upper webs 140, 150 of the fastening strips 130, 131 are effectively deoccluded. FIG. 28 shows the fastening strips 130, 131 near the first end 190 (the wide end) of the separator 172. At this position, the width of the separator 172 deoccludes both the upper webs 140, 150 and the lower webs 141, 151 of the fastening strips 130, 131. The flanges 153, 163 of the fastening strips 130, 131 are the only separator 172 engaging surfaces of the fastening strips 130, 131. Consequently, the slider 132 need not force itself between the webs 140, 141, 150, 151 of the fastening strips 130, 131.

The angled portions 168, 158 of the flanges facilitate the deocclusion of the fastening strips and allows the use of a narrower separator 172. Specifically, the angled portions contact the separator 172 to deocclude the fastening strips 130, 131. Because the angled portions 168, 158 extend inwardly to engage the separator 172, the separator can have a width 171 to achieve deocclusion of the fastening strips. If the angled portions were not used and the separator contacted only the straight portions, then the separator would need to have a width greater than width 171 in order to achieve deocclusion, assuming all other dimensions and parameters are the same.

Figure 30:
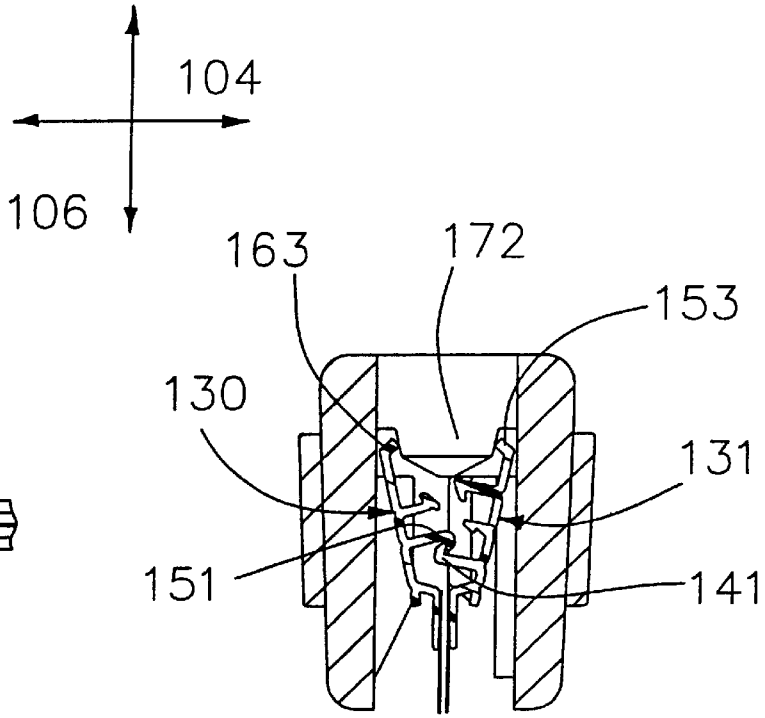
FIG. 30 is a cross-sectional view taken along line 30—30 in FIG. 29.
Figure 29:
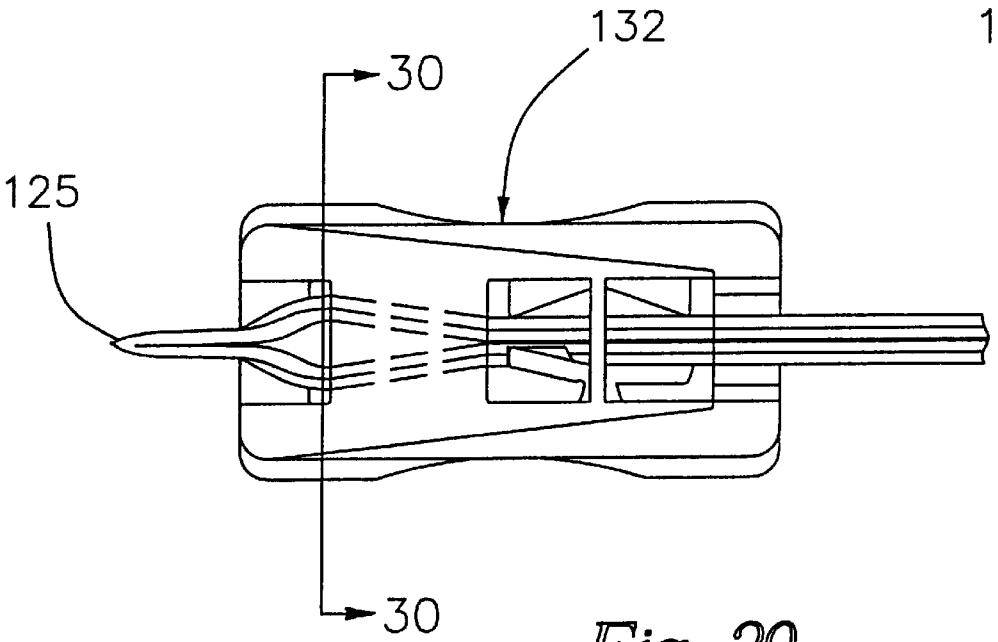
FIG. 29 is a partial top view of the slider located near the end of the fastening strips.

FIG. 29 shows the slider 132 in the end position of the fastening strips 130, 131 near the seam 125. FIG. 30 illustrates occlusion of the fastening strips in the end position. In accordance with one feature of the invention, these figures demonstrate that the closure device will have a leak proof seal when the slider is in the end position. The leak proof seal is created even though the separator finger extends between the flanges 153, 163. The positions of the fastening strips are effected not only by the forces acting upon them by the slider at a particular location but are also effected by the position of the fastening strips at locations before and after that particular location. Specifically, with respect to the position of the inner closure portions 141, 151 in FIG. 30, the position of the inner closure portions 141,

151 is effected by the seam 125 at the end of the fastening strips. At the seam 125, the fastening strips 130, 131 are melted together which effectively occludes the fastening strips. This occlusion of the fastening strips 130, 131 at the seam 125 prevents separating action of the separator finger 172 from deoccluding the inner closure portions 141, 151. Thus, the inner closure portions 141, 151 remain occluded even though the separator finger 172 is attempting to deocclude the inner closure portions. Consequently, the inner closure portions 141, 151 remain occluded through the length of the fastening strips and establish a leak proof seal through the length of the fastening strips when fully occluded.

For example, as the user moves the slider 132 in the occlusion direction, the slider would deocclude the fastening strips 130, 131 in the sequence shown in FIGS. 26–28. When the slider is in the location shown in FIG. 28, the inner closure portions 141, 151 of the fastening strips would usually be deoccluded as shown in FIG. 28. Referring to FIG. 29, the slider is prevented from further movement in the occlusion direction when the latch contacts the notch. However, as noted above, the seam 125 causes the inner closure portions 141, 151 to be occluded at the location in FIG. 30 even when the slider is not present. Therefore, when the slider moves to the locations shown in FIGS. 29 and 30, the inner closure portions 141, 151 are already occluded and the separating action of the separating finger 172 is not able to overcome the occlusion effect of the seam 125. Thus, the inner closure portions 141, 151 remain occluded through the length of the fastening strips and establish a leak proof seal.

Figure 31:
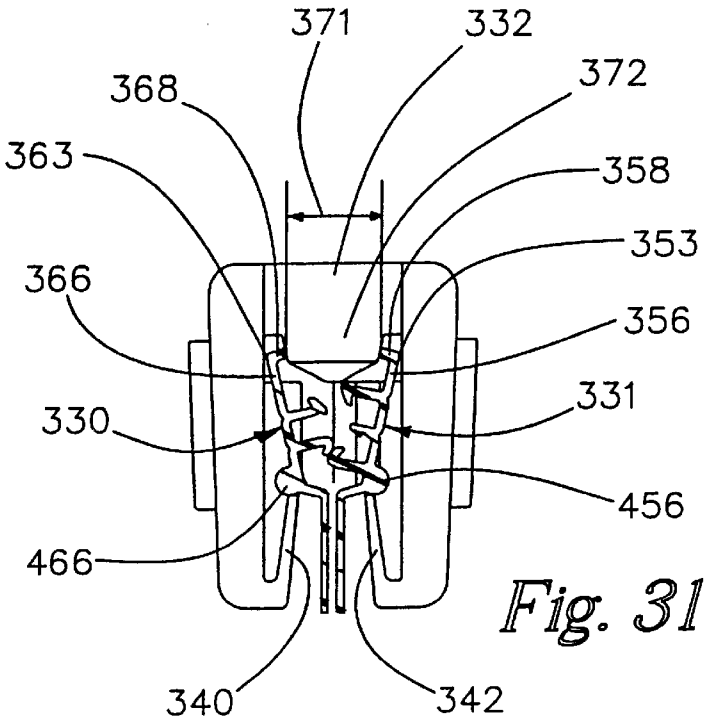
FIG. 31 is a cross-sectional view of another embodiment of the slider and fastening strips.
Figure 33:
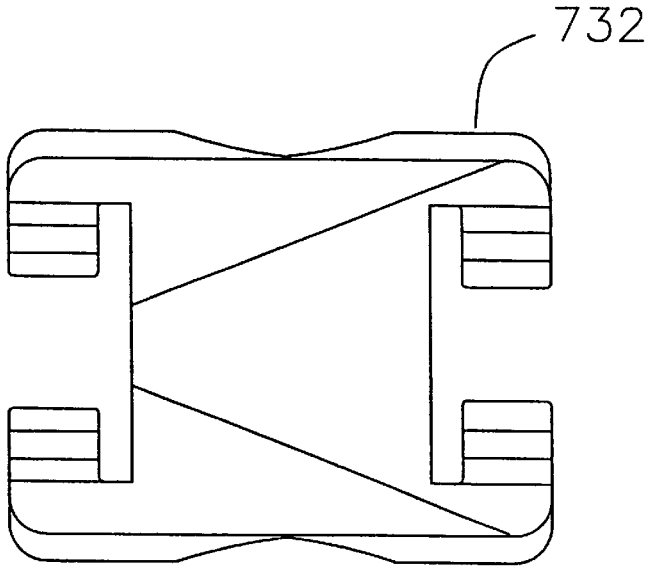
FIG. 33 is a top view of another embodiment of a slider.

FIG. 31 illustrates another embodiment of a slider 332 and fastening strips 330, 331. The fastening strips 330, 331 include flanges 363, 353 which include a straight portion 366, 356 and an angled portion 368, 358. The angled portion 368, 358 is at an approximately 90 degree angle to the straight portion 366, 356. The angled portion 368, 358 facilitates the deocclusion of the fastening strips and allows the use of a narrower separator 372. Specifically, the angled portions contact the separator 372 to deocclude the fastening strips 330, 331. Because the angled portions 368, 358 extend inwardly to engage the separator 372, th e separator can have a width 371 to achieve deocclusion of the fastening strips.

If the angled portions were not used and the separator contacted only the straight portions, then the separator would need to have a width greater than width 371 in order to achieve deocclusion, assuming all other dimensions and parameters are the same.

The fastening strips 330, 331 also include protrusions 446, 456. The protrusions 466, 456 are located near the bottom of the fastening strips 330, 331. The shoulders 34b, 342 engage the protrusions 466, 456 to hold the fastening strips 330, 331 within the slider 332.

Figure 32:
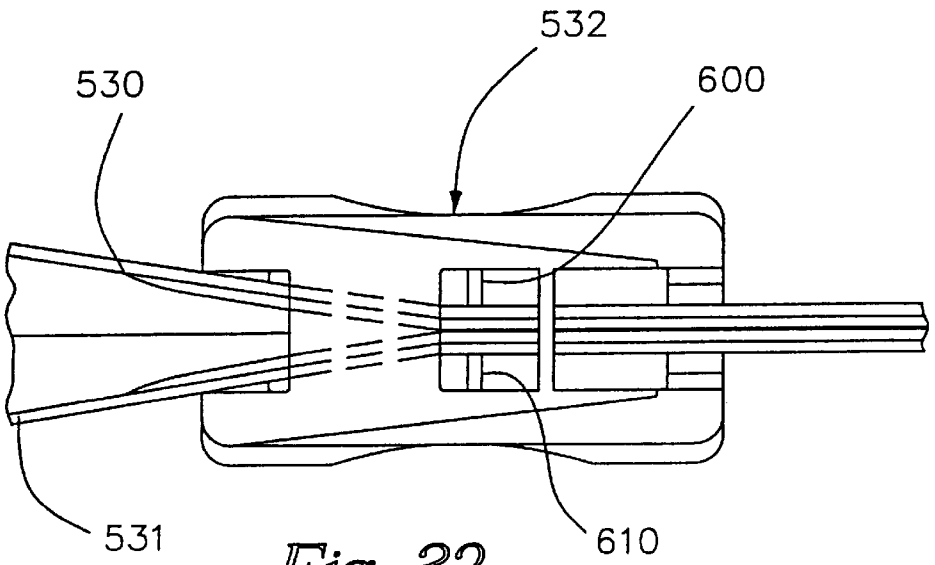
FIG. 32 is a top view of another embodiment of the slider and fastening strips.

FIG. 32 illustrates another embodiment of a slider 532 and fastening strips 530, 531. The slider 532 has occlusion members 600, 610. The occlusion members 600, 610 extend inward from the side walls of the slider towards the center of the slider. The occlusion members 600, 610 occlude the fastening strips 530, 531 similar to occlusion members 200, 210 in FIG. 5. However, occlusion members 600, 610 are rigid occlusion members.

Figure 34:
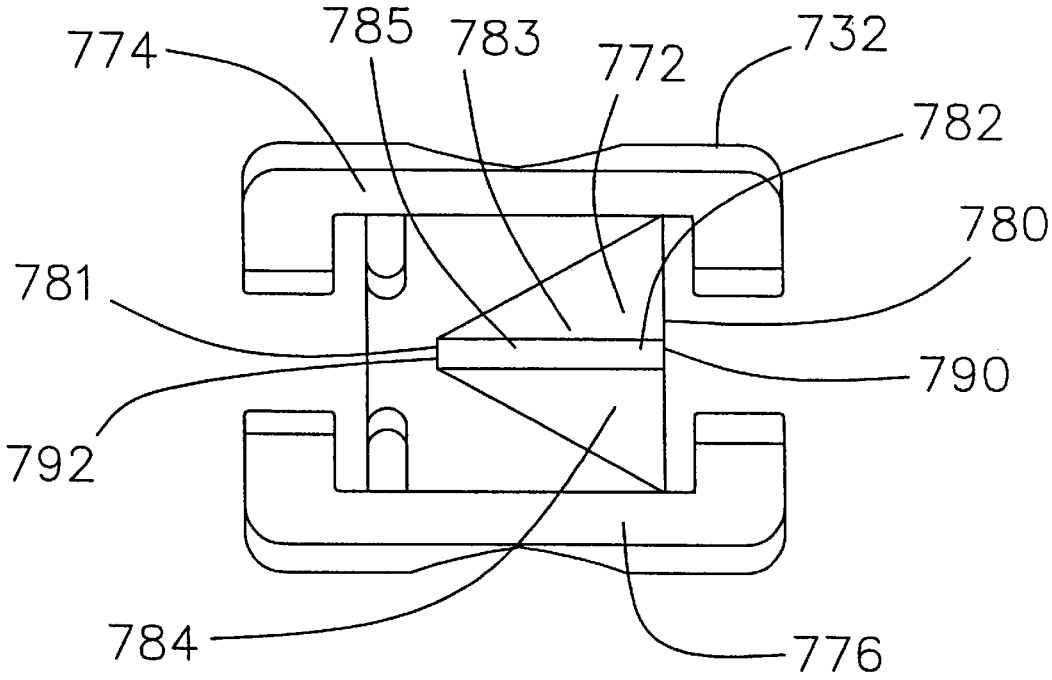
FIG. 34 is a bottom view of the slider of FIG. 33.
Figure 36:
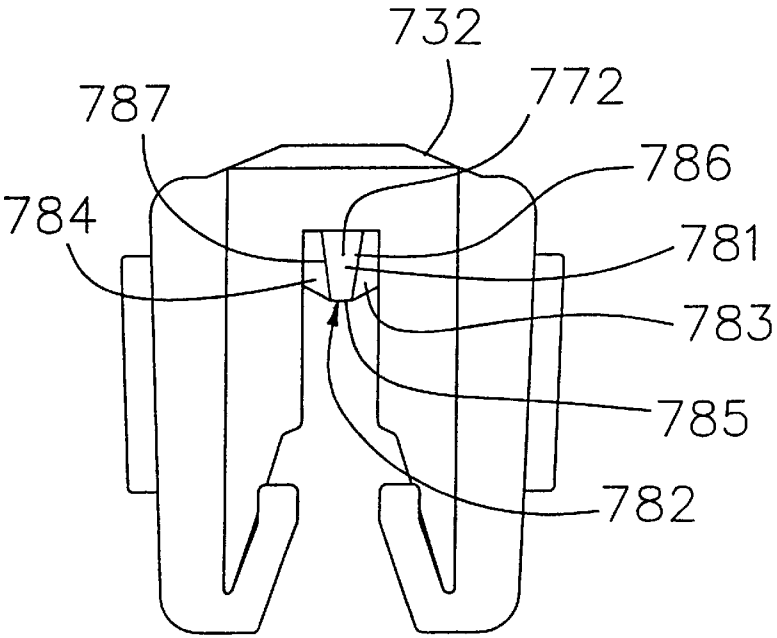
FIG. 36 is a rear view of the slider in FIG. 33.
Figure 35:
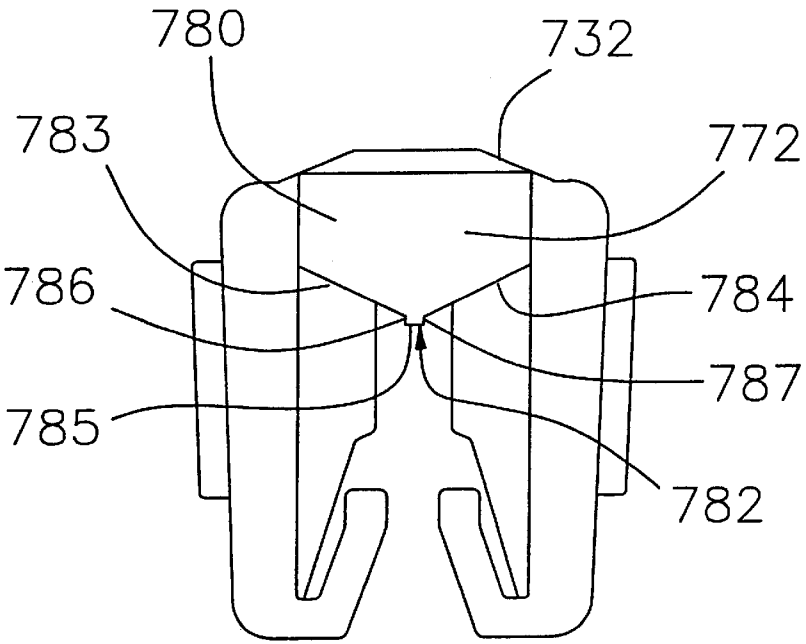
FIG. 35 is a front view of the slider in FIG. 33.
Figure 37:
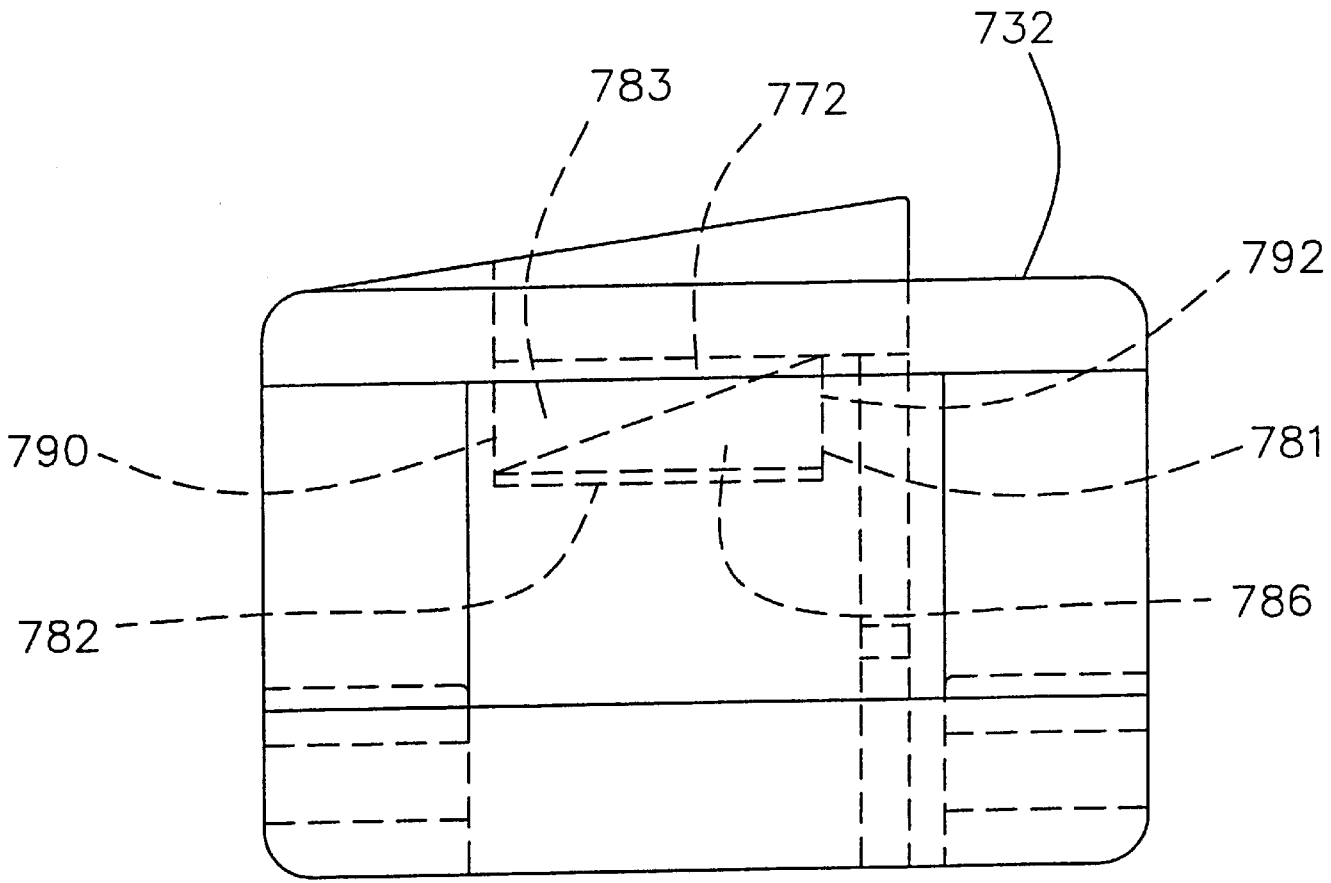
FIG. 37 is a side view of the slider in FIG. 33.

FIGS. 33–37 illustrate another embodiment of a slider 732. The slider 732 has another embodiment of a separator 772. The separator 772 has a different configuration than the separator 172 shown in FIG. 6. In addition, the separator 772 is wider than the separator 172 shown in FIG. 6. The separator 772 has a first end 790 and a second end 792. In this embodiment, the first end 790 is wider than the second end 792 as shown in FIG. 34. The separator has a first surface 780 at the first end 790 and a second surface 781 at the second end 792. The separator has a bottom surface 782. In this embodiment, the bottom surface 782 is a raised ridge with a horizontal surface 785 and side surfaces 786, 787. The separator also has a first side wall 783 and a second side wall 784. The side walls 783, 784 angle inwardly and upwardly from the first end 790 to the second end 792. The side walls 783, 784 extend to the first side portion 774 and to the second side portion 776. In addition, the separator has rigid occlusion members 800, 810 as described with respect to FIG. 32.

FIGS. 38–41 sequentially illustrate the attachment of the slider 732 onto the fastening strips 130, 131 in the vertical Z axis 106. Although the following description will be limited to the slider components illustrated in the respective view described, it will be appreciated that the other slider components will function in a similar fashion. For example, the front legs 840, 842 of the slider 732 will operate in the same fashion as the rear legs 860, 862 of the slider 732 during attachment of the slider 732 onto the fastening strips 130, 131.

Figure 38:
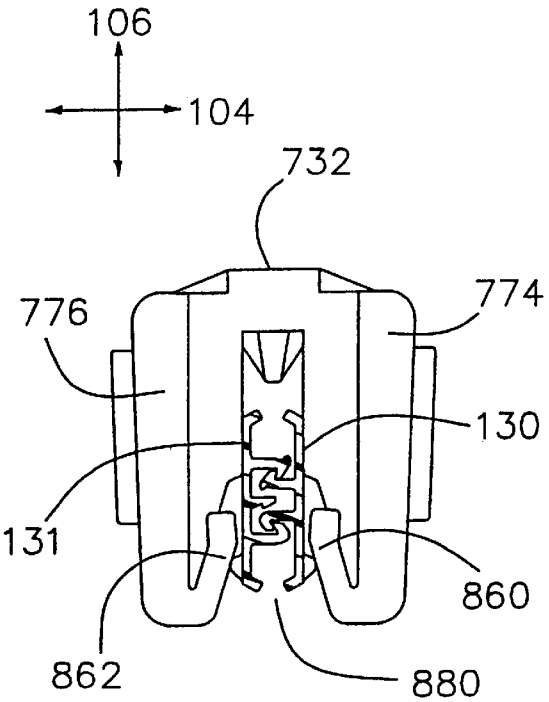
FIG. 38 is a cross-sectional view illustrating the slider being positioned on the fastening strips.

Referring to FIG. 38, the slider 732 is moved in the vertical Z axis 106 toward the fastening strips 130, 131. The fastening strips 130, 131 engage the rear legs 860, 862 and deflect the legs 860, 862 outwardly in the transverse Y axis 104 toward their respective side portions 774, 776 thus widening the rear slot 880. The fastening strips 130, 131 are guided into the slider 732 by the tapered surfaces of the legs 860, 862.

Figure 40:
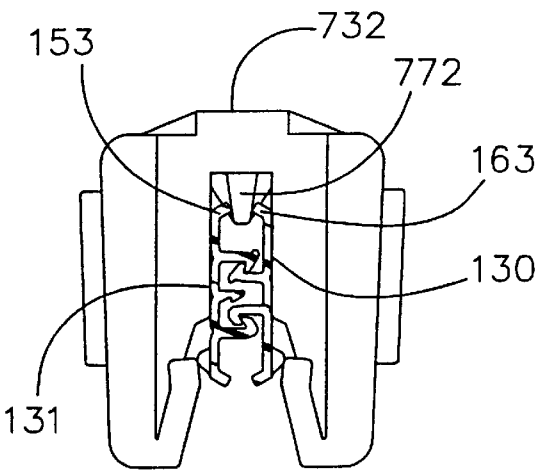
FIG. 40 is a cross-sectional view illustrating the slider being positioned on the fastening strips.
Figure 39:
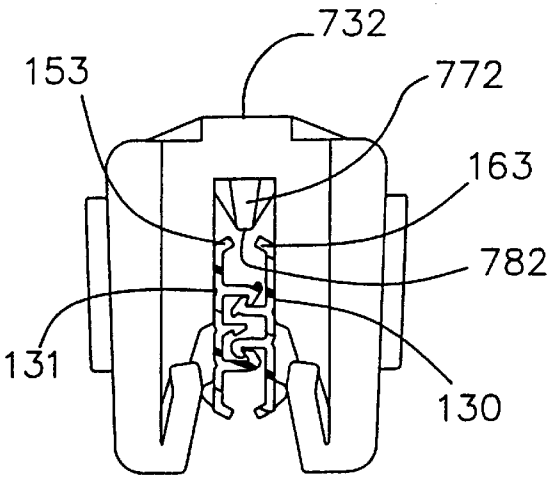
FIG. 39 is a cross-sectional view illustrating the slider being positioned on the fastening strips.

FIGS. 39 and 40 illustrate the fastening strips 130, 131 moving through the rear slot 880. The separator 772 begins to penetrate between the flanges 153, 163 of the fastening strips 130,131. The bottom surface 782 of the separator 772 has penetrated between the fastening strips 130, 131. This effect is achieved by the ridge 172 which serves to initially penetrate the occluded fastening strips 130, 131 and positions the separator 772 between the fastening strips 130, 131 before full attachment is achieved.

Figure 41:
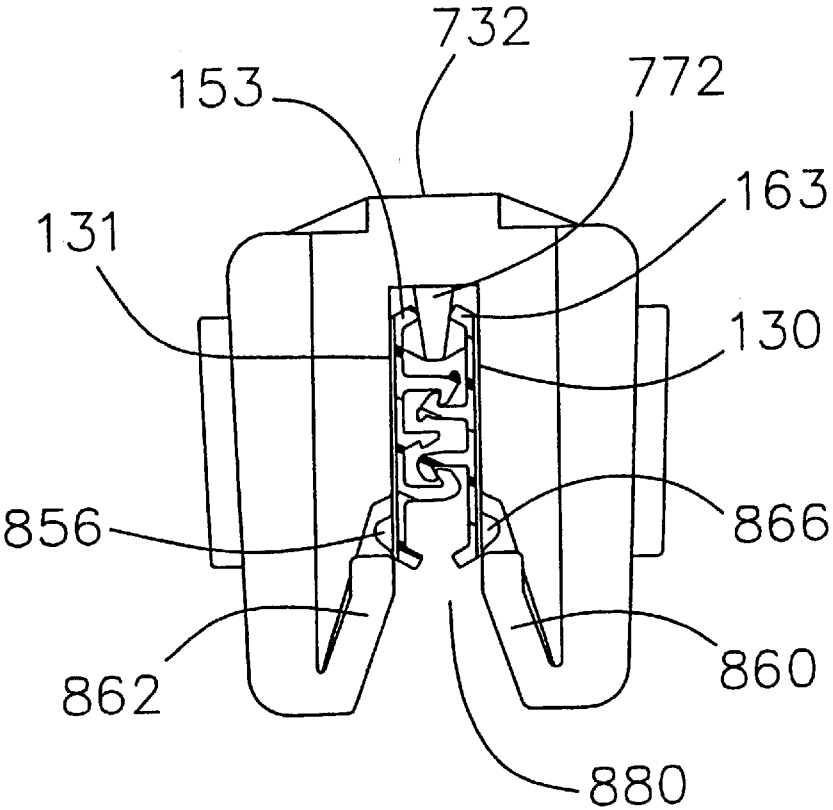
FIG. 41 is a cross-sectional view of the closing end illustrating the slider fully attached to the fastening strips.

As shown in FIG. 41, upon further movement of the fastening strips 130, 131 toward the slider 732 in the vertical Z axis 106, the fastening strips 130, 131 project through the legs 860, 862, and the legs 860, 862 retract back to their relaxed position. Likewise, the width of the rear slot 880 returns to its relaxed position width. With respect to the fastening strips 130, 131, the separator 772 is forced between the flanges 153, 163 of the occluded fastening strips 130, 131. The first end 790 of the separator 772, the wider end, is forced between and effectively deoccludes the fastening strips 130, 131 a s illustrated in FIG. 42. The penetration and deocclusion is discussed more fully with respect to FIGS. 43–46.

Figure 42:
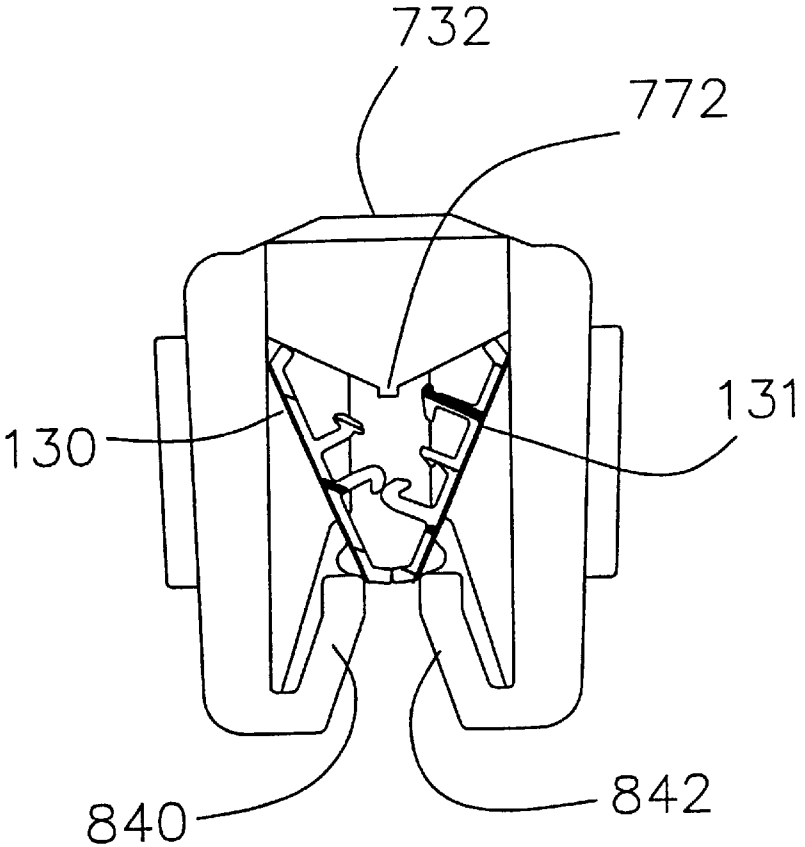
FIG. 42 is a cross-sectional view of the opening end illustrating the slider fully attached to the fastening strips.

FIGS. 41 and 42 represent the attached position of the slider 732 on fastening strips 130, 131. As illustrated in FIG. 41, once the legs 260, 262 return to their relaxed position, the fastening strips 130, 131 no longer fit through the slot 880. As an aspect of the present invention, the legs 860, 862 effectuate attachment of the slider 732 onto the fastening strips 130, 131 in the vertical Z axis 106 while preventing removal of the slider 732 from the fastening strips 130, 131 in the vertical Z axis 106 after the slider 732 has been attached to the fastening strips 130, 131. In the event removal of the slider 732 in the vertical Z axis 106 is attempted, the legs 860, 862 will provide resistance against removal of the slider 732. The legs 860, 862 retain the slider 732 on the fastening strips 130, 131 by resisting vertical Z axis 106 movement of the fastening strips 130, 131 through the slot 880.

More specifically, the legs 860, 862 are angled upwardly and inwardly so that during insertion of the slider 732 onto the fastening strips 130, 131 the legs 860, 862 deflect outwardly in the transverse Y axis 104 to increase the width of the slot 880 and permit the passage of the fastening strips 130, 131. When attempting to remove the slider 732 from the fastening strips 130, 131 in the vertical Z axis 106, the protrusions 866, 856 of the fastening strips 130, 131 contact the legs 860, 862 and deflect the legs 860, 862 inwardly in the transverse Y axis 104. Thus, the width of the slot 880 is reduced until the legs 860, 862 are ultimately forced against one another. The rigidity of the legs 860, 862 and shoulders will resist inward movement of the legs 860, 862 beyond the point where the legs 860, 862 engage one another. As a result, the slider 732 may only be removed from the fastening strips 130, 131 in the vertical Z axis 106 by either tearing through the fastening strips 130, 131 or breaking and/or by deforming the legs 860, 862 of the slider 732.

Figures 43, 44, 45, 46:
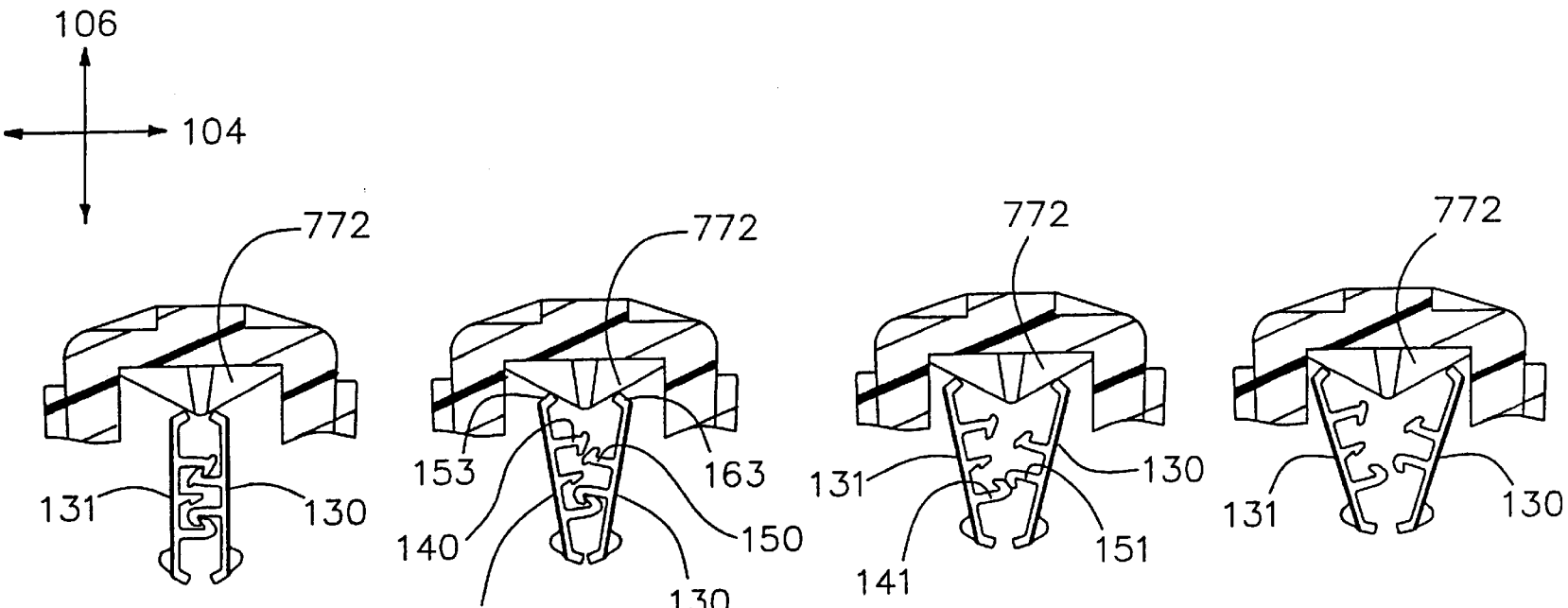
FIG. 43 is view of the separator and fastening strips and illustrates their positions to one another as the slider is positioned onto the fastening strips.
FIG. 44 is view of the separator and fastening strips and illustrates their positions to one another as the slider is positioned onto the fastening strips.
FIG. 45 is view of the separator and fastening strips and illustrates their positions to one another as the slider is positioned onto the fastening strips.
FIG. 46 is view of the separator and fastening strips and illustrates their positions to one another as the slider is positioned onto the fastening strips.

FIGS. 43–46 sequentially illustrate the first end 790, the wider end, of the separator 772 penetrating the occluded fastening strips 130, 131 during attachment of the slider 732 onto the fastening strips 130, 131 in the vertical Z axis 106. FIG. 43 depicts the separator 772 immediately above the occluded fastening strips 130, 131 in a position prior to penetration by the separator 772. Referring to FIG. 44, the separator 772 is moved downwardly in the vertical Z axis 106 and forced between the flanges 153, 163 of the fastening strips 130, 131. The fastening strips 130, 131 are forced apart in the transverse Y axis 104 and the upper webs 140, 150 of the fastening strips 130, 131 are deoccluded. As the separator 772 penetrates further between the flanges 153, 163 of the fastening strips 130, 131, the lower webs 141, 151 of the fastening strips 130, 131 also begin to deocclude as illustrated in FIG. 45. FIG. 46 shows the separator 772 once it has fully penetrated the fastening strips 130, 131. At this position both the upper webs 140, 141 and the lower webs 150, 151 of the fastening strips 130, 131 are deoccluded and attachment of the slider 772 to the fastening strips 130, 131 is complete. The flanges 153, 163 of the fastening strips 130, 131 are the only separator 772 engaging surfaces of the fastening strips 130, 131. As such, the slider 732 need not force itself between the webs 140, 141, 150, 151 of the fastening strips 130, 131.

Figure 47:
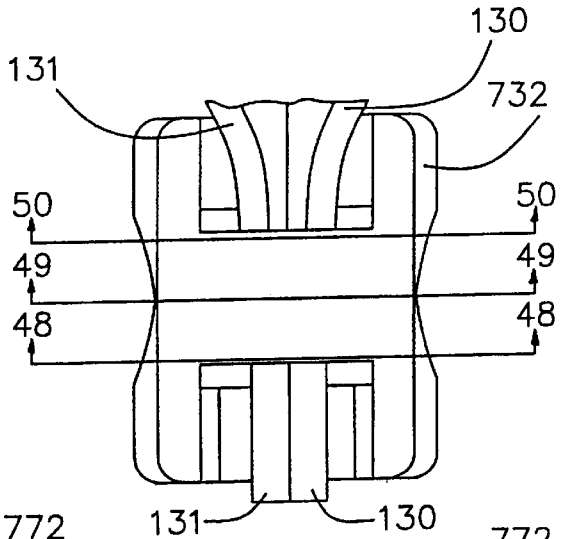
FIG. 47 is a top view of the slider in FIG. 33 and a partial view of the fastening strips.
Figure 49:
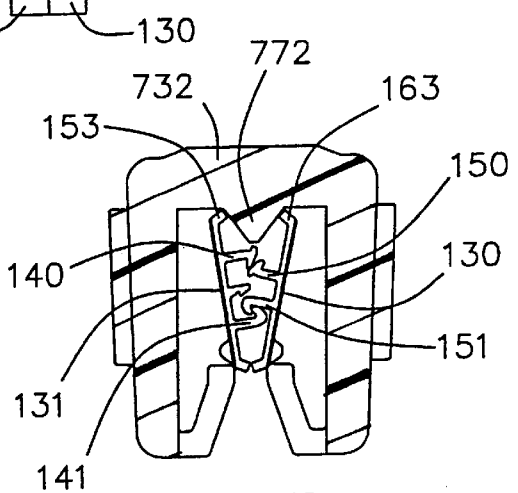
FIG. 49 is a cross-sectional view taken along line 49—49 in FIG. 47.
Figure 48:
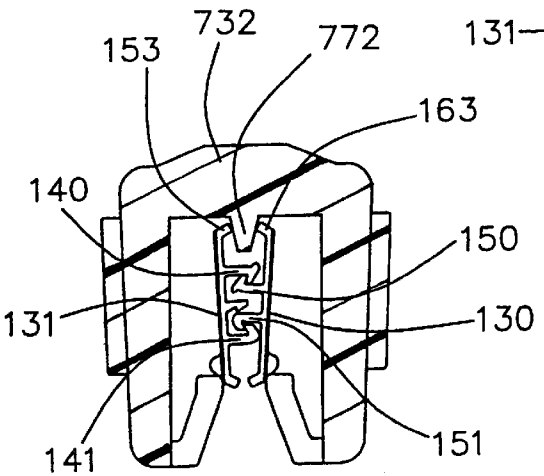
FIG. 48 is a cross-sectional view taken along line 48—48 in FIG. 47.
Figure 50:
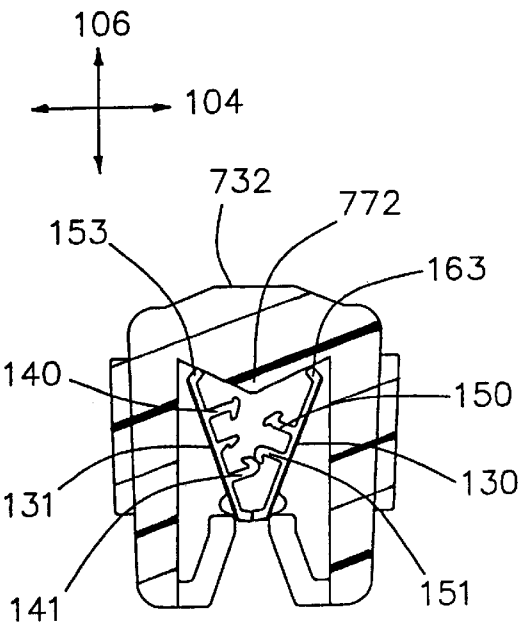
FIG. 50 is a cross-sectional view taken along line 50—50 in FIG. 47.
Figure 51:
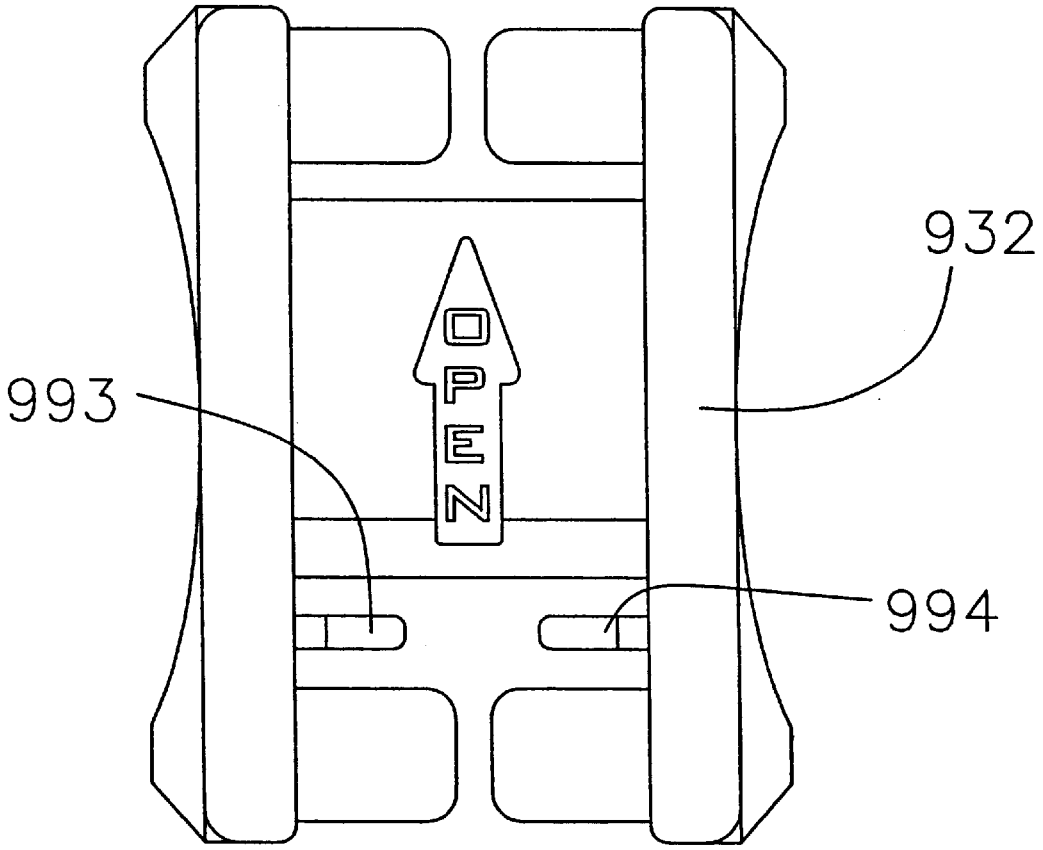
FIG. 51 is a top view of another embodiment of a slider.

FIGS. 48–50 illustrate the fastening strips 130, 131 at different locations along the separator 772 of the slider 732 as shown in FIG. 47. FIG. 48 depicts the fastening strips 130, 131 at a location near the second end 192 (the narrow end) of the separator 772. The separator 172 is located between the flanges 153, 163 of the fastening strips 130, 131. At this location, the upper webs 140, 150 and the lower webs 141, 151 are occluded. FIG. 49 illustrates the fastenings strips 130, 131 at a location near the middle of the separator 772. The width of the separator 772 at this location forces the fastening strips 130, 131 apart in the transverse Y axis 104 and the upper webs 140, 150 of the fastening strips 130, 131 are deoccluded. FIG. 50 shows the fastening strips 130, 131 near the first end 190 (the wide end) of the separator 772. At this position, the width of the separator 772 deoccludes both the upper webs 140, 150 and the lower webs 141, 151 of the fastening strips 130, 131. The flanges 153, 163 of the fastening strips 130, 131 are the only separator 772 engaging surfaces of the fastening strips 130, 131. Consequently, the slider 732 need not force itself between the webs 140, 141, 150, 151 of the fastening strips 130, 131.

Figure 52:
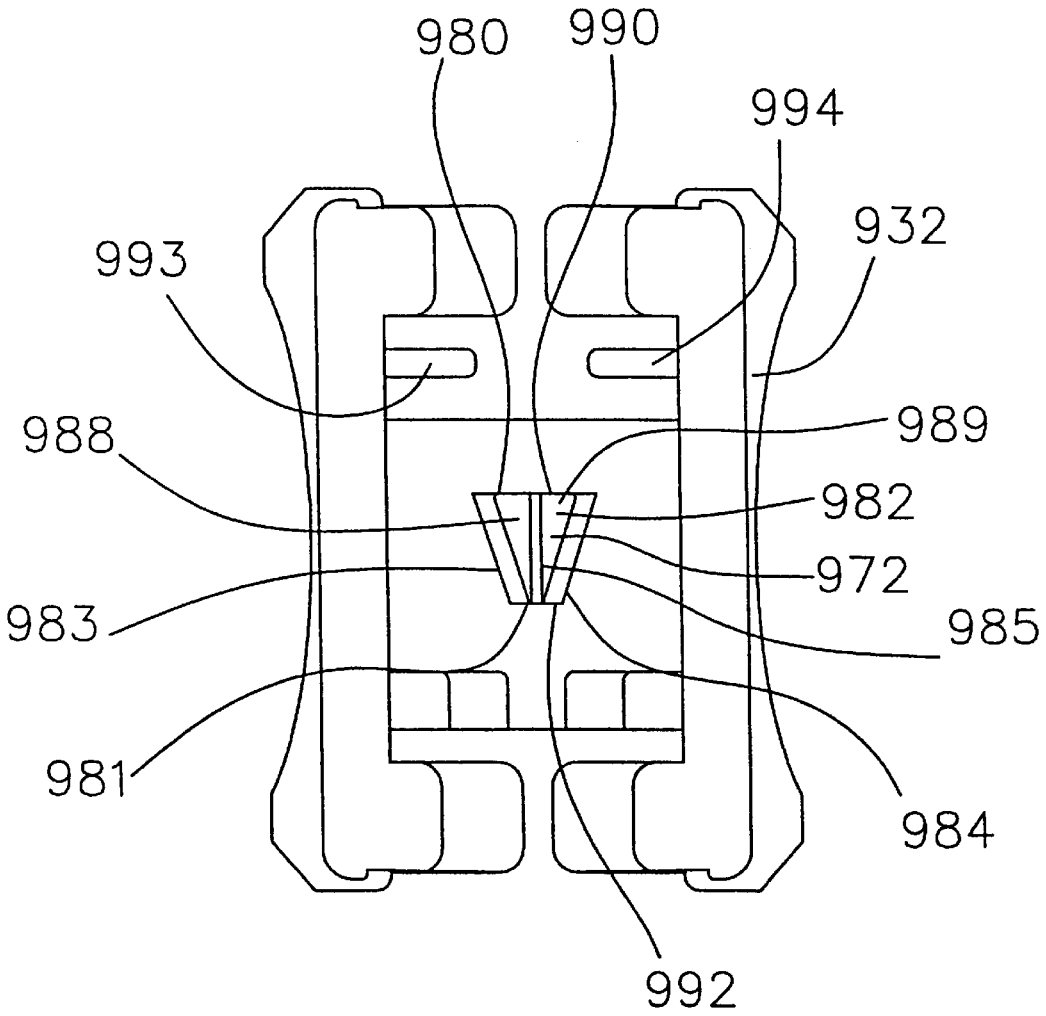
FIG. 52 is a bottom view of the slider in FIG. 51.
Figure 53:
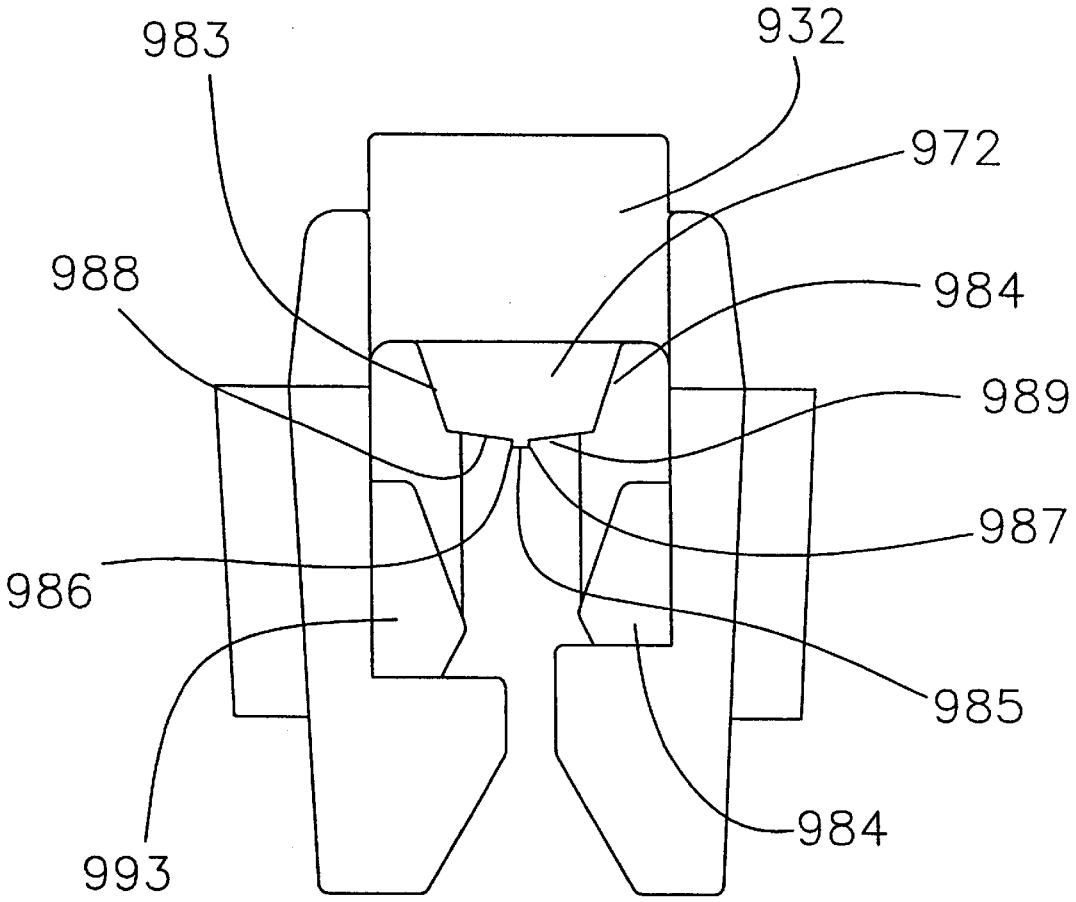
FIG. 53 is an end view of the slider in FIG. 51.
Figure 54:
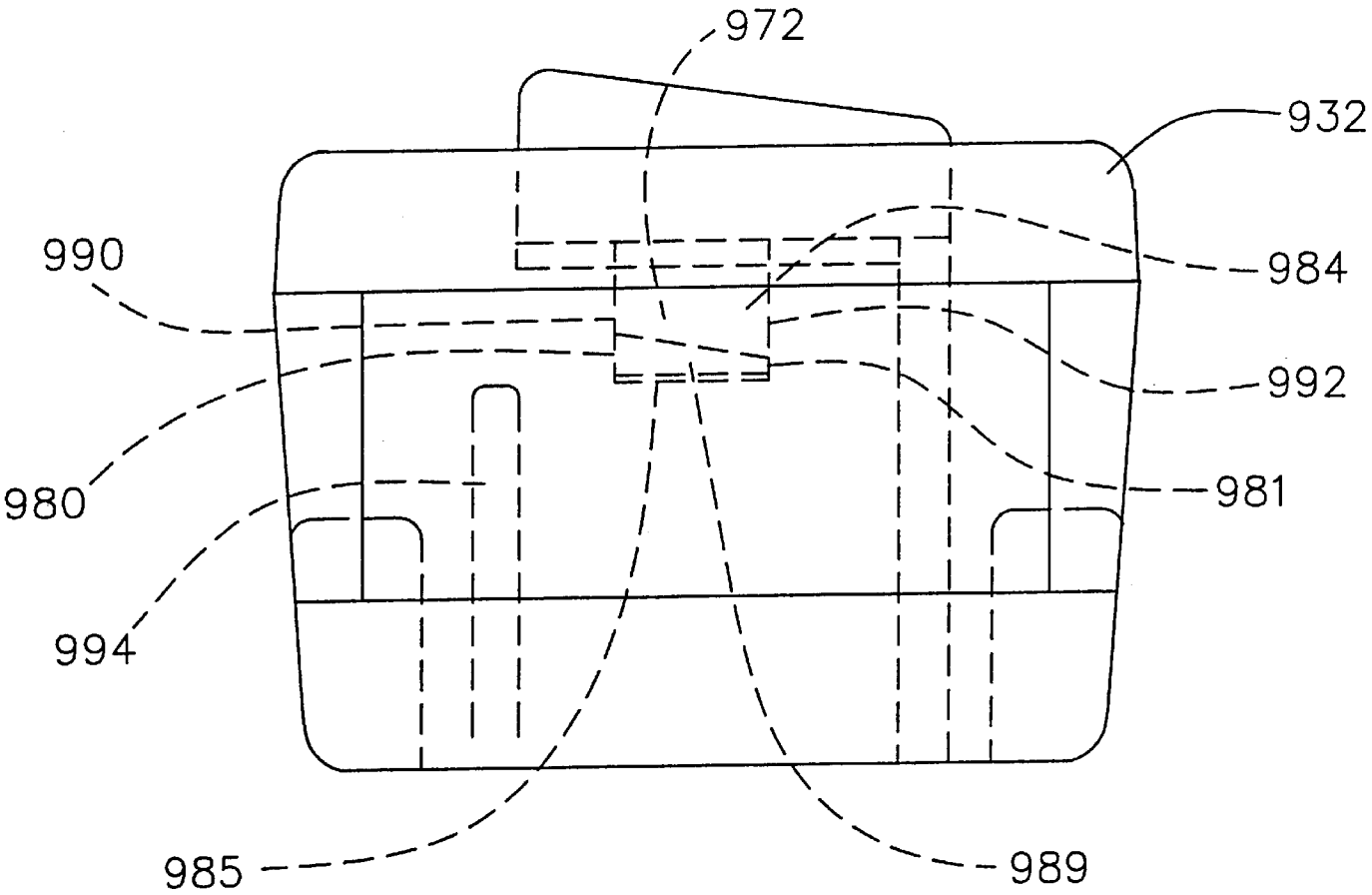
FIG. 54 is a side view of the slider in FIG. 51.

FIGS. 51–54 illustrate another embodiment of a slider 932. The slider 932 has another embodiment of a separator 972. The separator 972 has a first end 990 and a second end 992. In this embodiment, the first end 990 is wider than the second end 992 as shown in FIG. 52. The separator has a first surface 980 at the first end 990 and a second surface 981 at the second end 992. The separator has a bottom surface 982. In this embodiment, the bottom surface 982 includes a raised ridge with a horizontal surface 985 and side surfaces 986, 987. The bottom surface 982 also includes angled surfaces 988, 989 which angle inwardly from the first end 990 to the second end 992 as shown in FIG. 54. Furthermore, the angled surfaces 988, 989 angle downwardly relative to the vertical Z axis from the outer edges at the side walls 983, 984 toward the middle of the separator as shown in FIG. 53. Also, the separator 972 has a first side wall 983 and a second side wall 984 as shown in FIGS. 52–54. The side walls 983, 984 angle inwardly from the first end 990 to the second end 992 as shown in FIG. 52. The side walls 983, 984 also angle outwardly from the bottom to the top as shown in FIG. 53.

In this embodiment, the slider 932 has relatively rigid legs or shoulders similar to the embodiments shown in FIGS. 63–66. The slider 932 attaches to the fastening strips similar to those sliders as noted below. In another embodiment, the slider may have flexible legs or shoulders and would attach to the fastening strips similar to sliders noted above.

Figure 55:
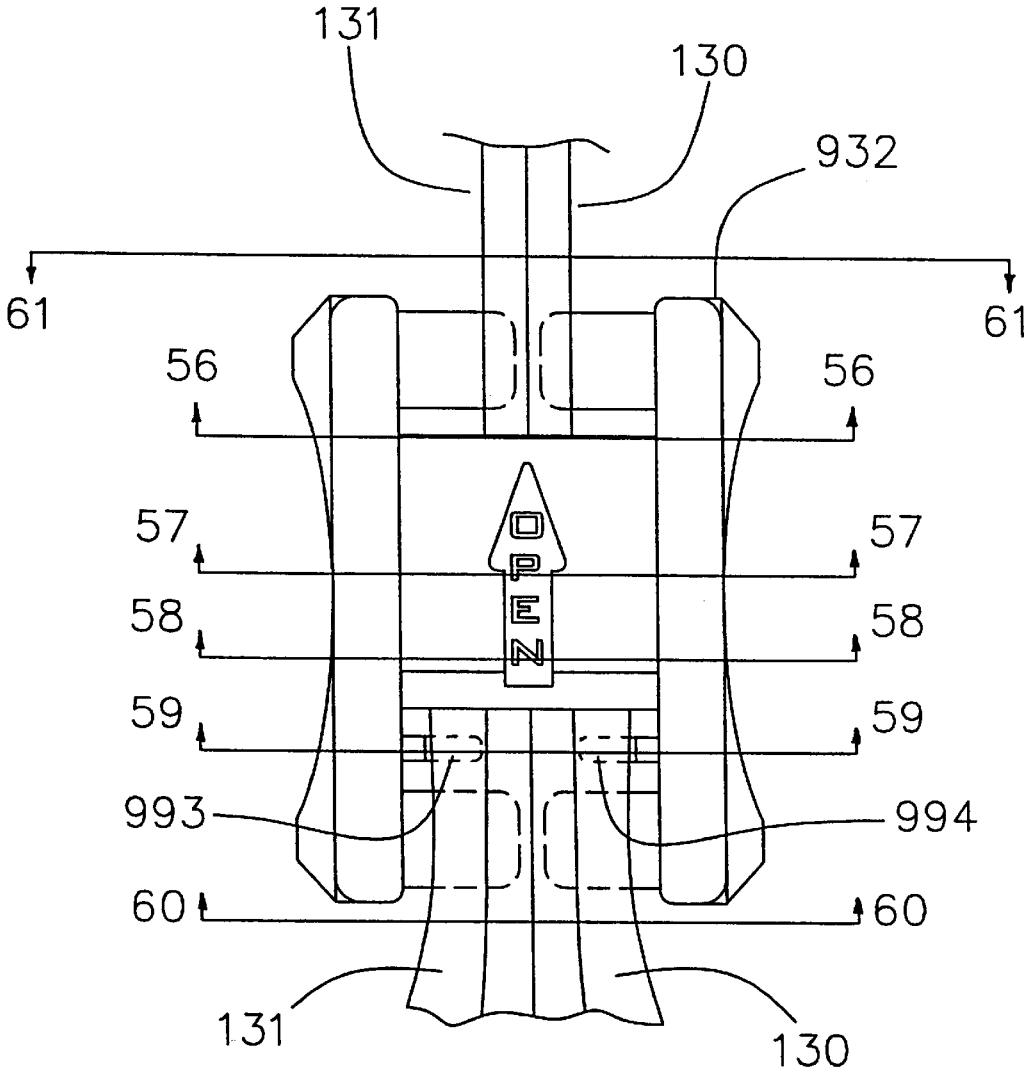
FIG. 55 is a top view of the slider in FIG. 51 and a partial view of the fastening strips.
Figure 56:
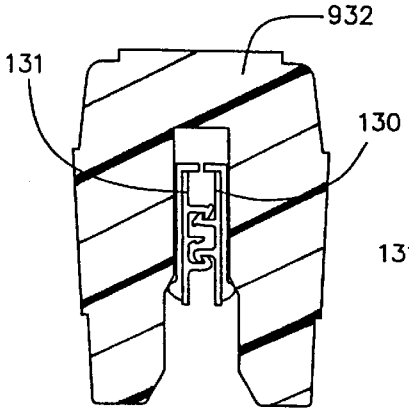
FIG. 56 is a cross-sectional view taken along line 56—56 in FIG. 55.
Figure 57:
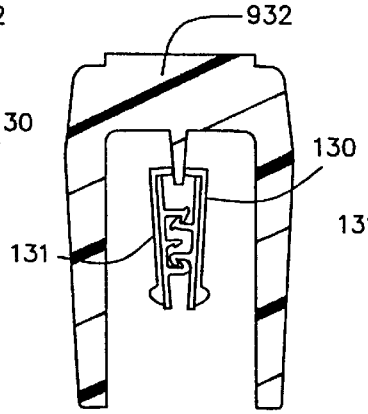
FIG. 57 is a cross-sectional view taken along line 57—57 in FIG. 55.

FIGS. 56–59 illustrate the fastening strips 130, 131 at different locations along the slider 932 as shown in FIG. 55. The fastening strips 130, 131 occlude and deocclude similar to the embodiments noted above. However, this embodiment includes shear wings 993, 994 as shown in FIGS. 52, 53, 54 and 59. During the manufacture of the fastening strips, certain lengths of the fastening strips may be improperly formed. F or example, the webs 141, 151 may be angled downward, as opposed to the normal position, for a portion along the length of the fastening strips. This malformation of the webs 141, 151 may make the disengagement of the webs 141, 151 more difficult than for normally formed webs 141, 151. The shear wings 993, 994 are used to assist the disengagement of the improperly formed webs.

Figure 58:
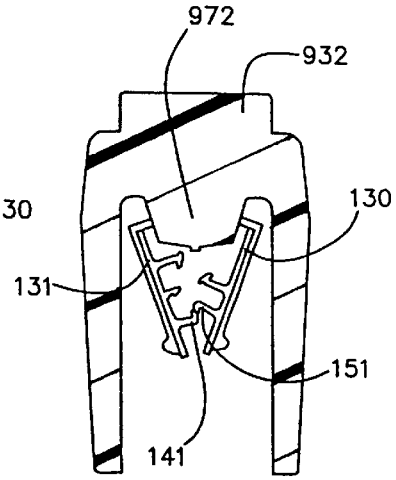
FIG. 58 is a cross-sectional view taken along line 58—58 in FIG. 55.
Figure 59:
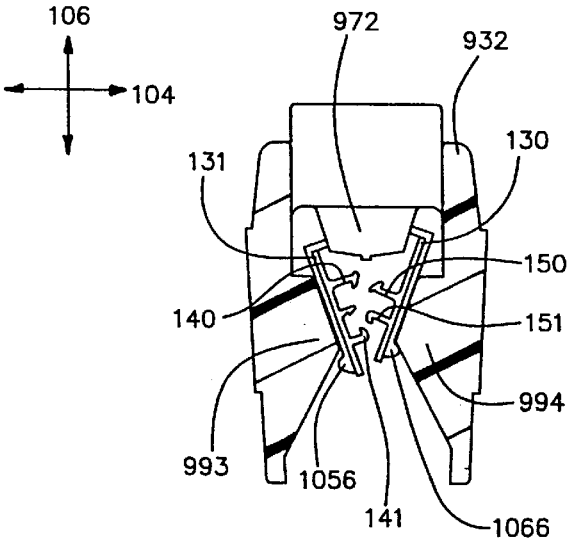
FIG. 59 is a cross-sectional view taken along line 59—59 in FIG. 55.

Specifically, when the properly formed webs 141, 151 are near the location shown in FIG. 58, the webs 141, 151 are usually disengaged. However, when improperly formed webs 141, 151 are near the location shown in FIG. 58, the webs 141, 151 may not be disengaged. In order to assist the disengagement of the improperly formed webs, the shear wings 993, 994 cause the fastening strips to shear in the vertical axis 106 as shown in FIG. 59. The deflection of the webs and hooks in conjunction with the shearing action causes the improperly formed webs 141, 151 to disengage.

Figure 60:
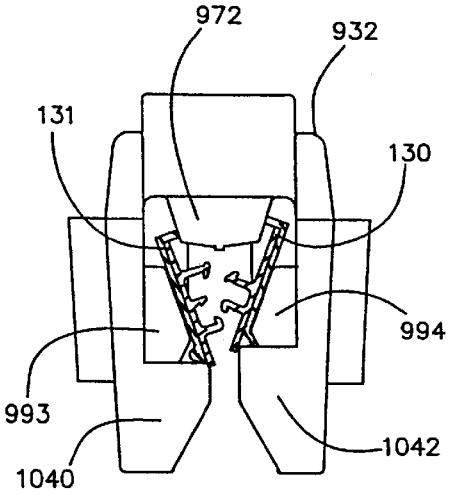
FIG. 60 is a cross-sectional view taken along line 60—60 in FIG. 55.
Figure 61:
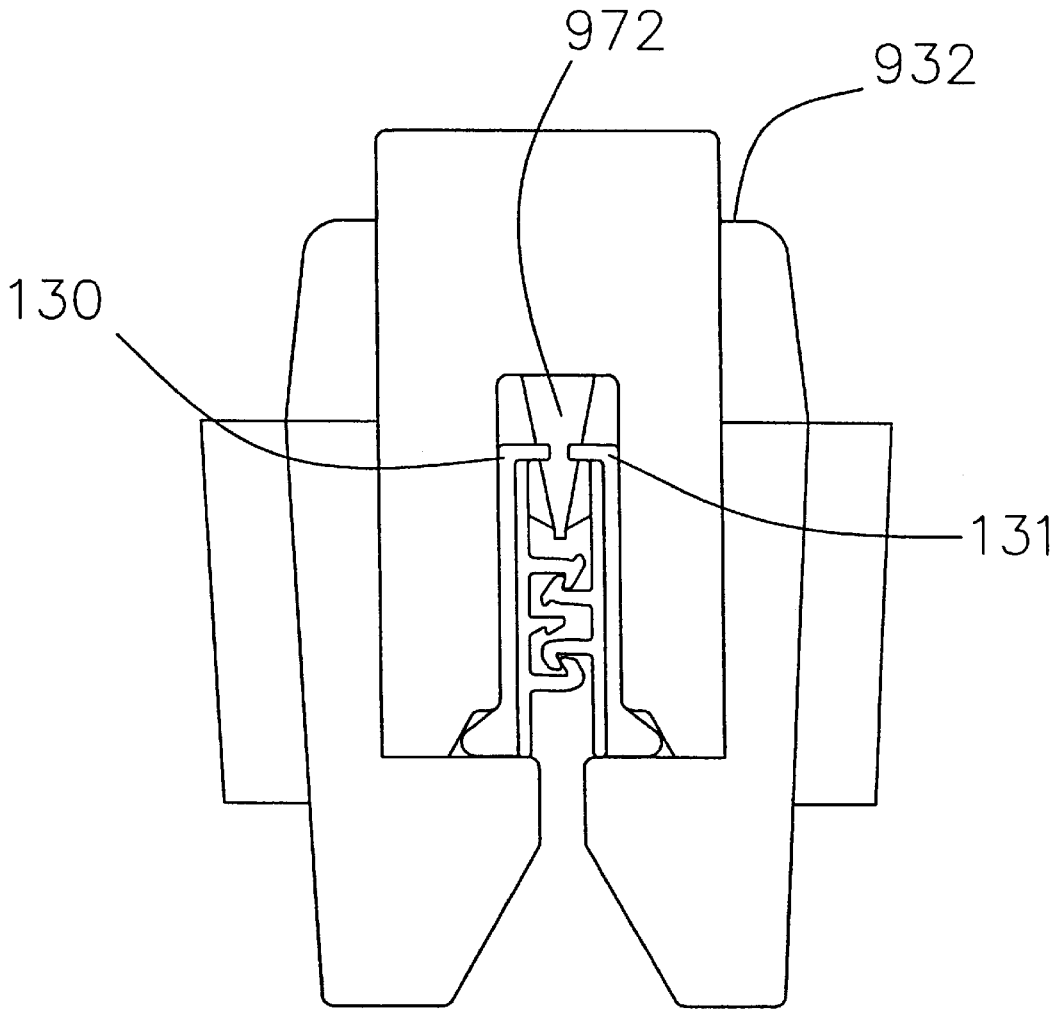
FIG. 61 is a cross-sectional view taken along line 61—61 in FIG. 55.

Referring to FIG. 59, the shearing action occurs when the fastening strip 130 engages the shoulder 1042 on the slider 932. The shoulder 1042 is at a different height than the shoulder 1040 as shown in FIG. 60. Specifically, the shoulder 1042 is higher than the shoulder 1040. When the fastening strip 130 engages the shoulder 1042, the fastening strip 130 is moved upward in the vertical Z axis 106 relative to the fastening strip 130. The fastening strip 130 moves upward until the protrusion 1066 engages the shear wing 994. In addition, the shear wing 993 engages the protrusion 1056 and holds the fastening strip 131 to prevent the fastening s trip 131 from moving in the upward direction as shown in FIGS. 59 and 60. The shearing movement among the fastenings trips 130, 131, in conjunction with the deflection of the webs and hooks, causes the improperly formed webs 141, 151 to disengage as shown in FIG. 59.

In another embodiment, the fastening strip 131 could be moved downward relative to the fastening strip 130. In this other embodiment, the shearing action occurs when the shear wing 993 engages the protrusion 1056 on the fastening strip 131. When the shear wing 993 engages the protrusion 1056, the fastening strip 131 is moved downward in the vertical Z axis 106 relative to the fastening strip 130. In addition, the shoulder 1042 holds the fastening strip 130 to prevent the fastening strip 130 from moving in the downward direction. The shoulder 1042 is at a different height than the shoulder 1040. In this other embodiment, the shoulder 1042 is higher than the shoulder 1040. The shearing movement among the fastening strips 130, 131, in conjunction with the deflection of the webs and hooks, causes the improperly formed webs 141, 151 to disengage.

Figure 62:
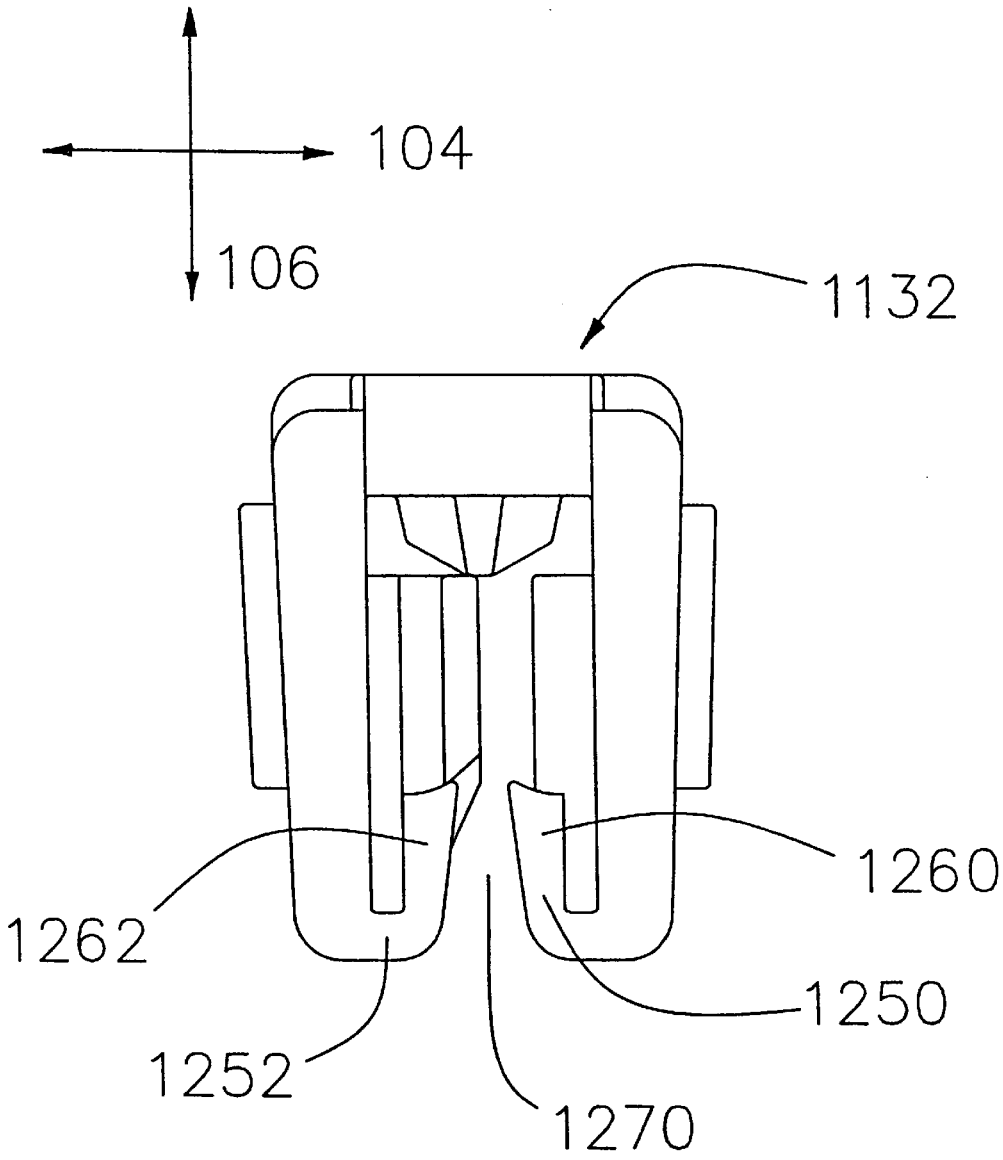
FIG. 62 is a rear view of another embodiment of the slider.

The resistance which the flexible shoulders and legs provide during attachment onto and removal from the fastening strips may be affected by varying the dimensions and/or material composition of the slider design. For instance, FIG. 62 depicts another embodiment of a slider 1132 made in accordance with the present invention. This embodiment is similar to the embodiment illustrated in FIG. 8 except that the legs 1260, 1262 of the slider 1132 have a different configuration. Specifically, the legs 1260, 1262 have a varied leg width that increases from the flexible shoulder 1250, 1252 to the slot 1270. The increased leg width may reduce the flexibility of the legs 1250, 1252 and increase the resistance provided by the legs 1250, 1252 during attachment of the slider 1132 onto and attempted removal of the slider 1132 from the fastening strips 130, 131 in the vertical Z axis 106.

Figure 65:
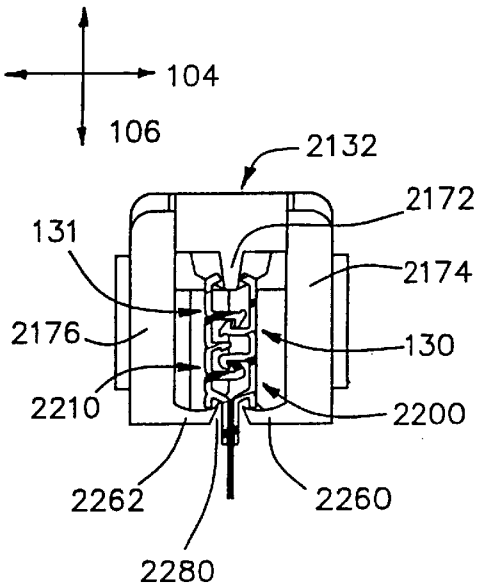
FIG. 65 is a rear view of the slider in FIG. 63 and cross-sectional view of the fastening strips and illustrates the slider fully attached to the fastening strips.
Figure 64:
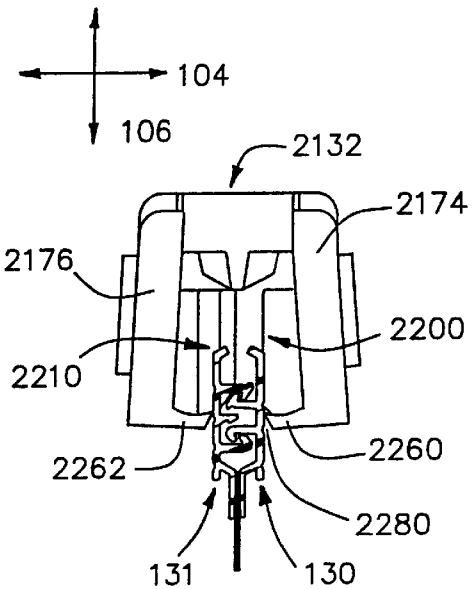
FIG. 64 is a rear view of the slider in FIG. 63 and cross-sectional view of the fastening strips and illustrates the slider as it is positioned onto the fastening strips.
Figure 63:
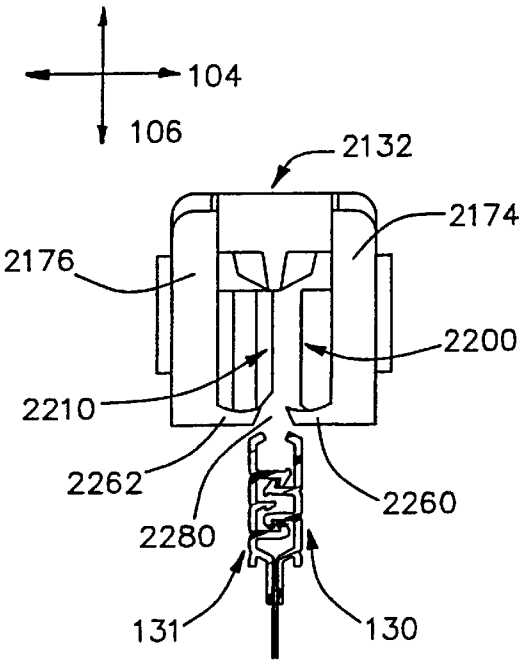
FIG. 63 is a rear view of another embodiment of the slider and cross-sectional view of the fastening strips and illustrates the slider positioned above the fastening strips.

FIGS. 63–65 show another embodiment of a slider 2132 that provides more rigid legs 2260, 2262 than the embodiment illustrated in FIG. 8. Moreover, in a relaxed position the legs 2260, 2262 of the slider 2132 project inwardly, substantially perpendicular to the side portions 2174, 2176. The slider 2132 provides more flexing in the side portions 2174, 2176 of the slider 2132 than does the first embodiment.

FIGS. 63–65 sequentially illustrate the attachment of the slider 2132 onto the fastening strips 130, 131 in the vertical Z axis 106. FIG. 63 depicts occluded fastening strips 130, 131 and the slider 2132 in a relaxed position. The occluded fastening strips 130, 131 are immediately below the slot 2280. The slider 2132 is then moved in the vertical Z axis 106 toward the fastening strips 130, 131. The fastening strips 130, 131 engage the legs 2260, 2262 and force the side portions 2174, 2176 to deflect outwardly in the transverse Y axis 104 thus widening the slot 2280. The fastening strips 130, 131 are guided into the slider by the tapered surfaces of the occlusion members 2200, 2210. FIG. 64 illustrates the fastening strips 130, 131 moving through the slot 2280. The base portions 138, 148 of the fastening strips 130, 131 are interposed between the legs 2260, 2262. FIG. 63 represents the attached position of the slider 2132 on fastening strips 130, 131. Once the side portions 2174, 2176 return to their relaxed position, the fastening strips 130, 131 no longer fit through the slot 2280.

Figure 66:
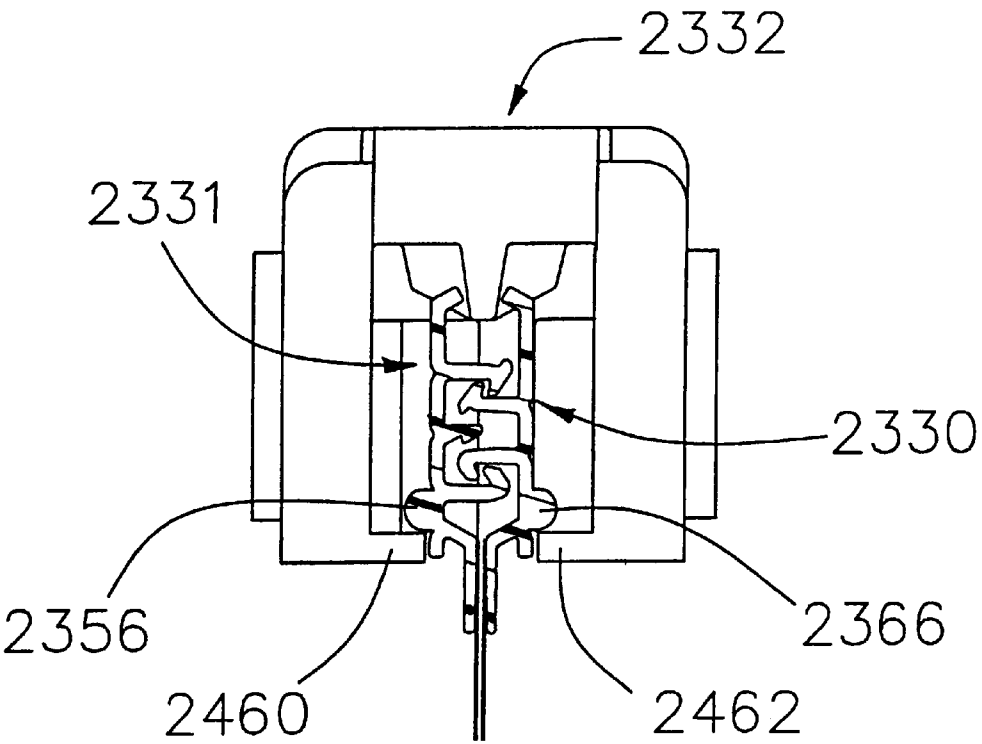
FIG. 66 is a rear view of another embodiment of the slider and the fastening strips.

FIG. 66 illustrates another embodiment of a slider 2332 and fastening strips 2330, 2331. Protrusions 2356, 2366 are located on the fastening strips 2331, 2330 and the shoulders 2460, 2462 engage the protrusions 2356, 2366 to hold the fastening strips 2331, 2330 within the slider 2332.

Figure 67:
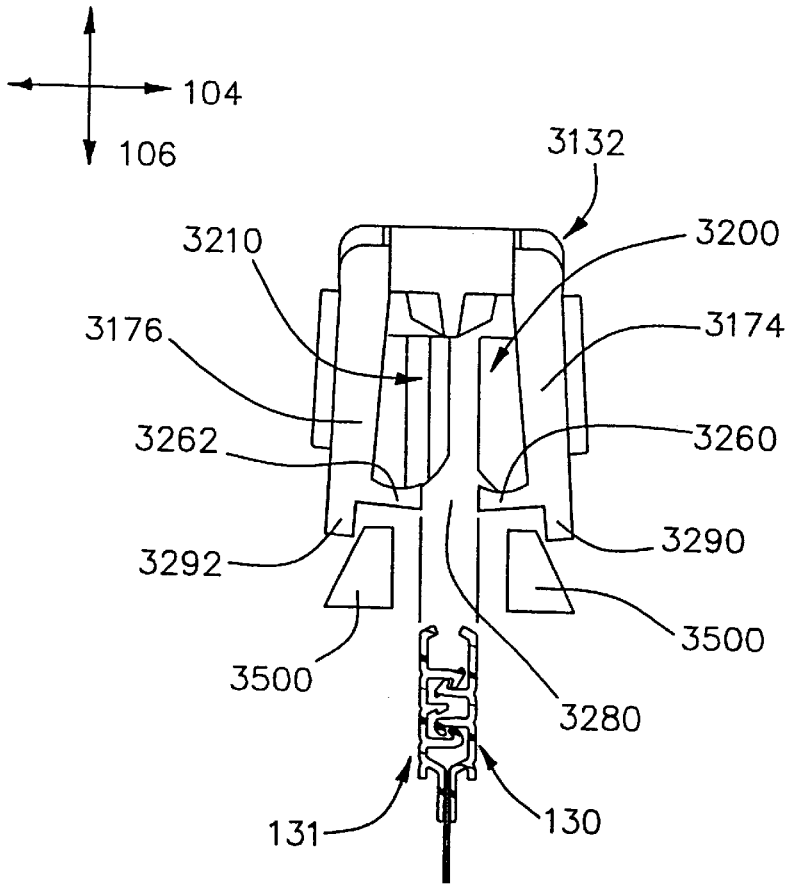
FIG. 67 is a rear view of another embodiment of the slider and cross-sectional view of the fastening strips and illustrates the slider positioned above the fastening strips.
Figure 68:
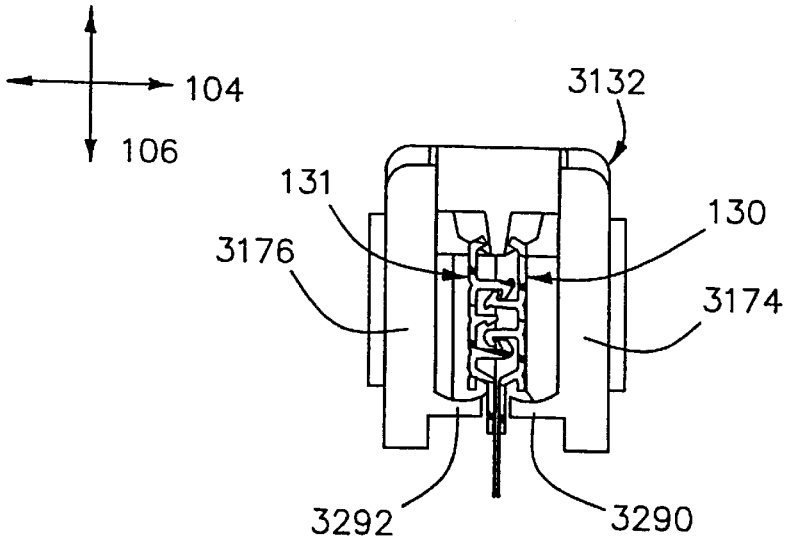
FIG. 68 is a rear view of the slider in FIG. 67 and cross-sectional view of the fastening strips and illustrates the slider fully attached to the fastening strips.

FIGS. 67 and 68 show another embodiment of a slider 3132. The side portions 3174, 3176 of this embodiment have lower embossments 3290, 3292 which extend below the first and second rear legs 3260, 3262 in the vertical Z axis 106. The slider 3132 utilizes a tool 3500 to engage the lower embossments 3290, 3292 and force the side portions 3174, 3176 apart in the transverse Y axis 104 during attachment of the slider 3132 onto the fastening strips 130, 131. FIGS. 67 and 68 also sequentially illustrate attachment of the slider 3132 onto the fastening strips 130, 131 in the vertical Z axis 106. FIG. 67 depicts occluded fastening strips 130, 131 and the slider 3132 as the tool 3500 forces the side portions 3174, 3176 apart in the transverse Y axis 104 thus widening the slot 3280. The fastening strips 130, 131 are immediately below the slot 3280. The fastening strips 130, 131 are guided into the slider 3132 by the tapered surfaces of the occlusion members 3200, 3210 as the slider 3132 is moved downwardly in the vertical Z axis 106. FIG. 68 represents the attached position of the slider 3132 on fastening strips 130, 131. Once the side portions 3174, 3176 return to their relaxed position, the fastening strips 130, 131 no longer fit through the slot 3280.

The present invention effectuates attachment of a slider onto fastening strips in the vertical Z axis 106 while preventing removal of the slider from the fastening strips in the vertical Z axis 106 thereafter.

Figure 69:
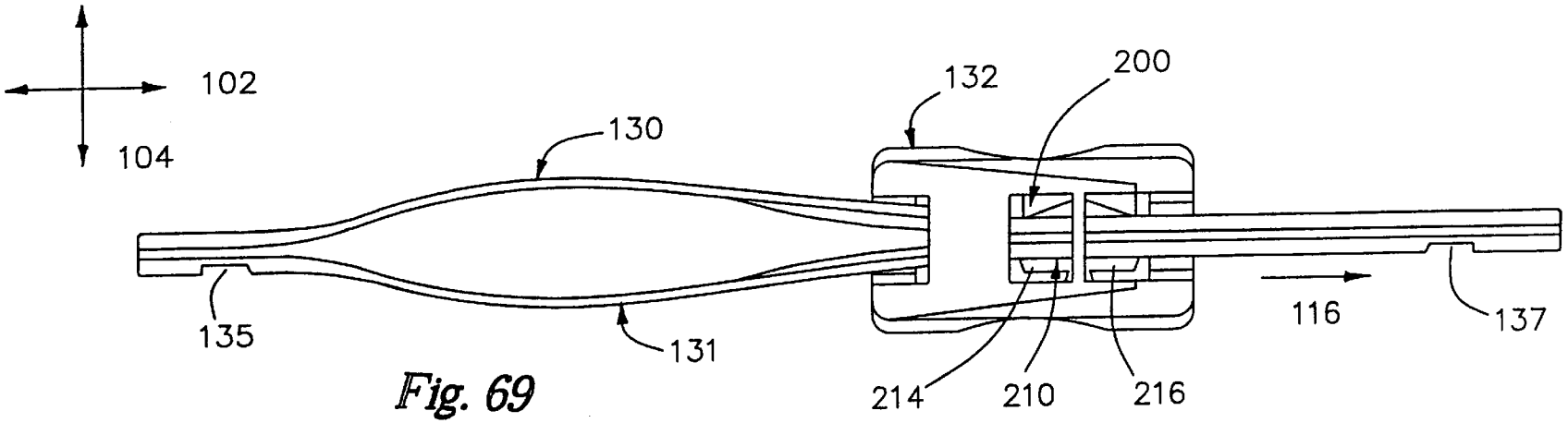
FIG. 69 is a top view of the slider attached to the fastening strips.

Another aspect of the present invention prevents removal of the slider from the fastening strips in the horizontal X axis 102 once the slider has been attached to the fastening strips. FIG. 69 illustrates the slider 132 attached to the fastening strips 130, 131. As may be readily seen, a portion of the fastening strips 130, 131 is interposed between the rigid occlusion member 200 and the flexible occlusion member 210. The inwardly biased arms 214, 216 of the flexible occlusion member 210 are forced to a position substantially parallel to the occluded fastening strips 130, 131. First and second detents 135, 137 are provided along the second fastening strip 131 for engagement with the arms 214, 216 of the flexible occlusion member 210. Once the slider 132 is moved a sufficient distance along the fastening strips 130, 131 in the horizontal X axis 102, the respective arm 214, 216 of the flexible occlusion member 210 engages either detent 135, 137.

Figure 70:
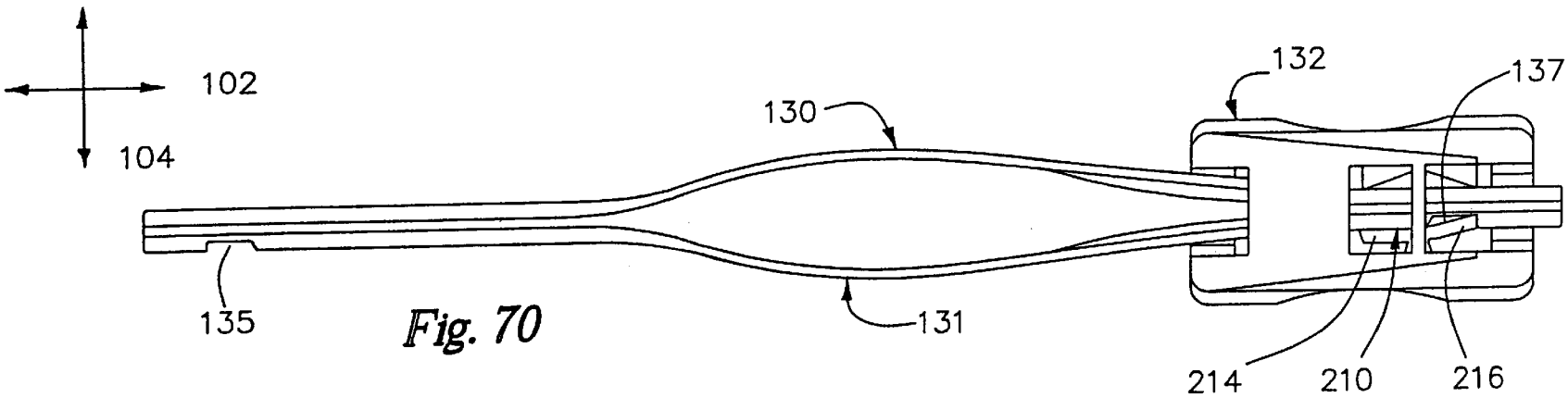
FIG. 70 is a top view of the slider attached to and engaged with a detent of the fastening strips.

For example, if the slider 132 is continually moved in the deocclusion direction 116, the arm 216 of the flexible occlusion member 210 will eventually engage the detent 137. The detent 137 allows the arm 216 of the flexible occlusion member 210 to return to its original inwardly extending position and engage the detent 137 as shown in FIG. 70. The arm 216 of the flexible occlusion member 210 will resist further movement of the slider 132 in the horizontal X axis 102 in the deocclusion direction 116. As a result, the slider 132 may only be removed from the fastening strips 130, 131 in the horizontal X axis 102 by either tearing through the fastening strips 130, 131 or by breaking and/or deforming the flexible occlusion member 210 of the slider 132. It will be appreciated that the detents 135, 137 of the fastening strip 131 may be provided on either the first or second fastening strip 130, 131 and should be on the fastening strip which contacts the flexible occlusion member 210. In this connection, the slider 132 may provide the flexible occlusion member 210 on either the first or second side portion 174, 176 of the of slider 132 so as to correspond to the detents 135, 137 of the fastening strips 130, 131.

Figure 71:
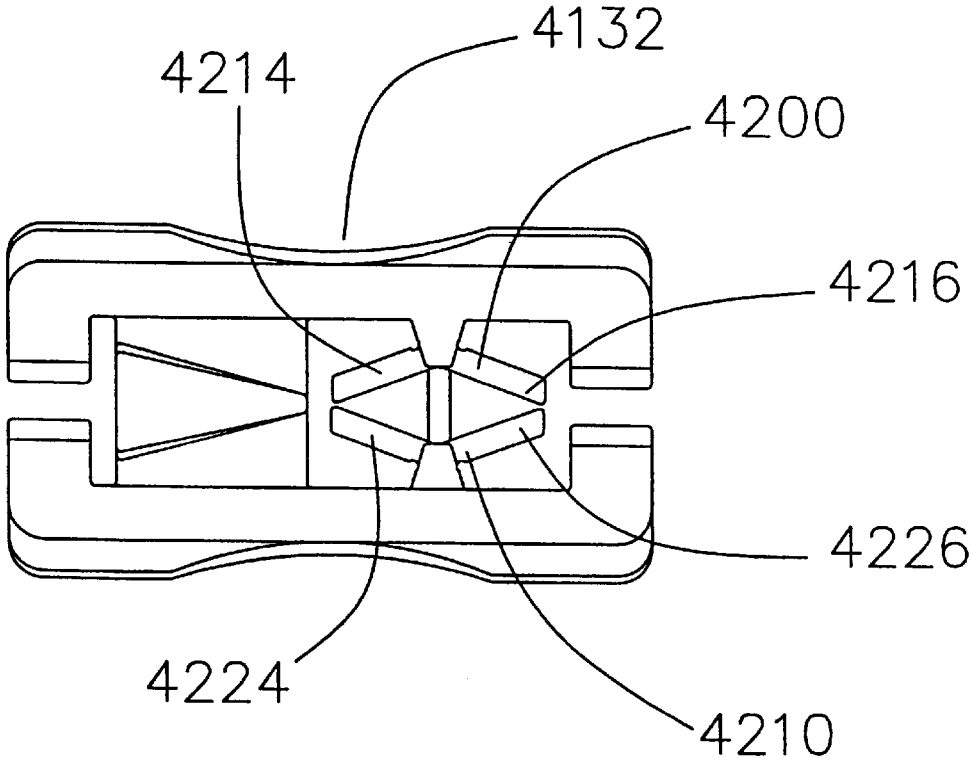
FIG. 71 is a bottom view of another embodiment of the slider.

FIG. 71 illustrates another embodiment of a slider 4132. The slider 4132 provides two flexible occlusion members 4200, 4210 rather than a rigid occlusion member and a flexible occlusion member. The slider 4132 may be used with fastening strips 130, 131, and either the first fastening strip 130 or the second fastening strip 131 may provide detents 135, 137 to engage the arms 4214, 4216, 4224, 4226 of the flexible occlusion members 4200, 4210. Also, one fastening strip 130 may provide a first detent in proximity with one end of the fastening strips 130, 131 while the second fastening strip 131 provides a second detent in proximity with the other end of the fastening strips 130, 131. Similarly, for additional resistance against slider 4132 removal in the horizontal X axis 102, both the first fastening strip 130 and the second fastening strip 131 may provide detents to engage the arms 4214, 4216, 4224, 4226 of the flexible occlusion members 4200, 4210.

Figure 72:
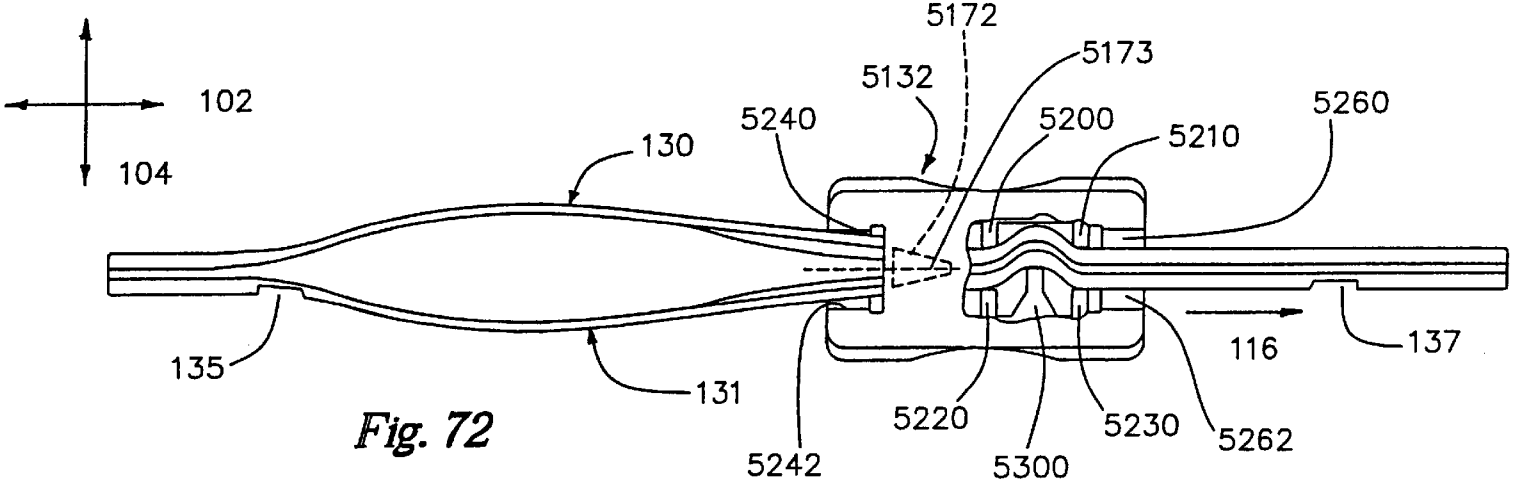
FIG. 72 is a partial cut away top view of another embodiment of the slider attached to the fastening strips.
Figure 73:
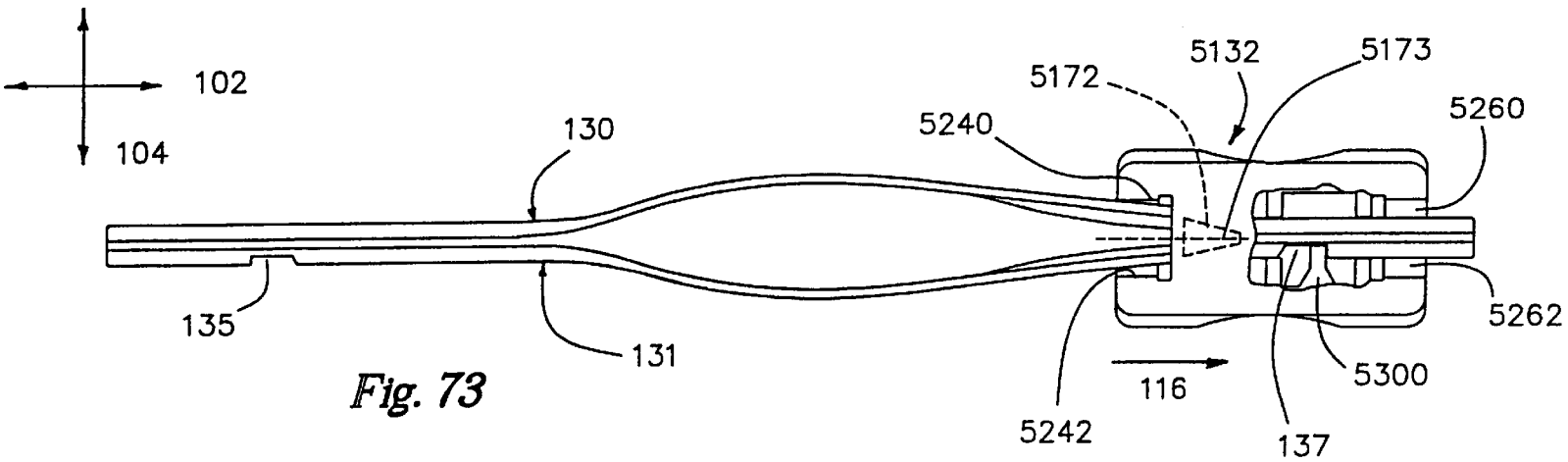
FIG. 73 is a partial cut away top view of the slider in FIG. 72 attached to and engaged with a detent of the fastening strips.

FIGS. 72 and 73 illustrate another embodiment of a slider 5132 made in accordance with the present invention. FIG. 72 illustrates a portion of the fastening strips 130, 131 interposed between rigid occlusion members 5200, 5210, 5220, 5230. Additionally, a peg 5300 is provided for engaging the detents 135, 137 of the second fastening strip 131. Once the slider 5132 is moved a sufficient distance along the fastening strips 130, 131 in the horizontal X axis 102, the peg 5300 engages either detent 135, 137. For example, if the slider 5132 is continually moved in the deocclusion direction 116 the peg 5300 will eventually engage the detent 137 as illustrated in FIG. 73. The peg 5300 will resist further movement of the slider 5132 in the horizontal X axis 102 in t he deocclusion direction 116. As a result, the slider 5132 may only be removed from the fastening strips 130, 131 in the horizontal X axis 102 by either tearing through the fastening strips 130, 131 or by breaking and/or deforming the peg 5300 of the slider 5132. It will be appreciated that the detents 135, 137 of the second fastening strip 131 may be provided on either the first or second fastening strip 130, 131 and should be on the fastening strip which contacts the peg 5300. In this connection, the slider 5132 may provide the peg 5300 on either side of the slider 5132 so as to correspond to the detents 135, 137 of the fastening strips 130, 131.

Referring to FIGS. 72 and 73, the slider 5132 has a separator 5172 and shoulders 5240, 5242, 5260, 5262. The separator 5172 has an axis 5173 which is parallel to the longitudinal X axis 102. In addition, the shoulders 5240, 5242, 5260, 5262 have an axis 5173 which is parallel to the longitudinal X axis 102.

Figure 75:
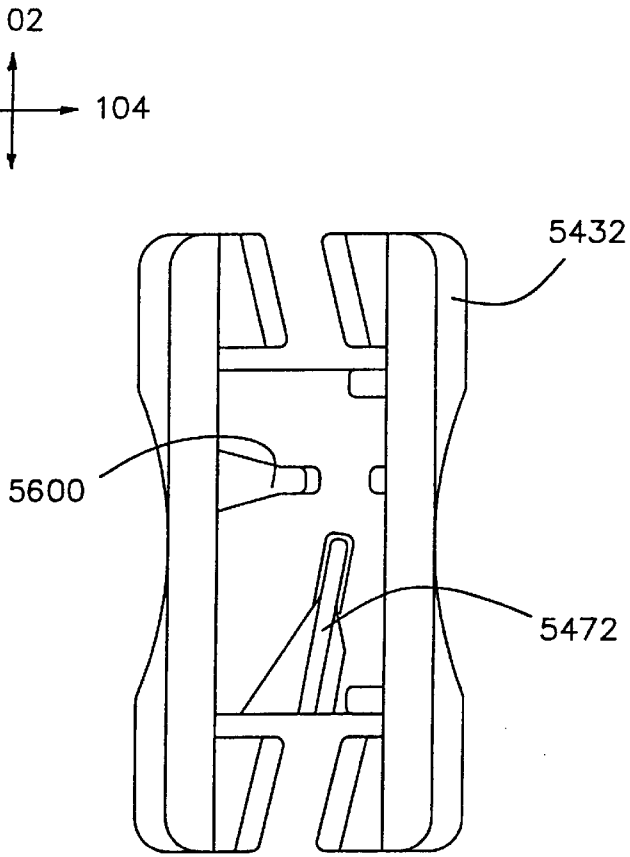
FIG. 75 is a bottom view of the slider in FIG. 74.
Figure 74:
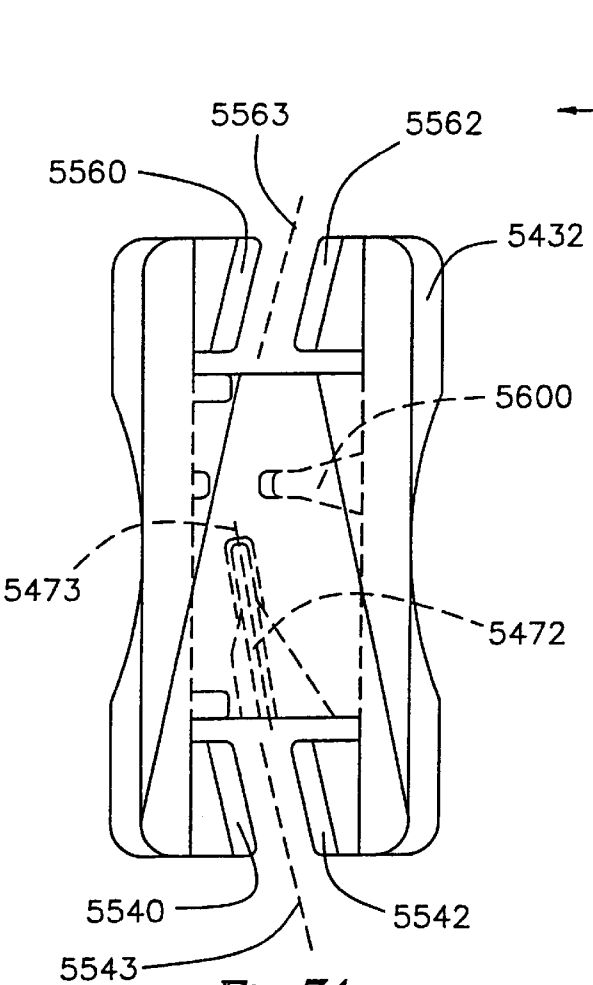
FIG. 74 is a top view of another embodiment of a slider.
Figure 77:
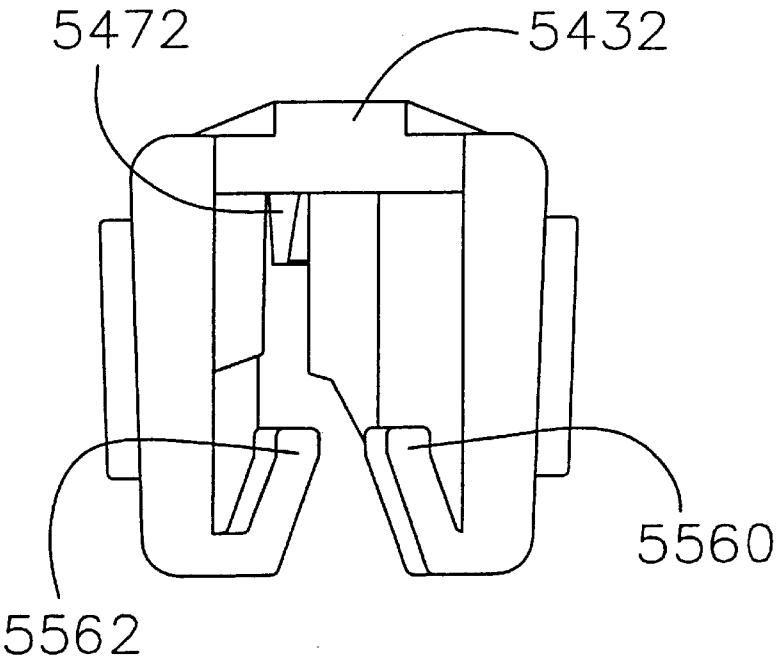
FIG. 77 is a rear view of the slider in FIG. 74.
Figure 76:
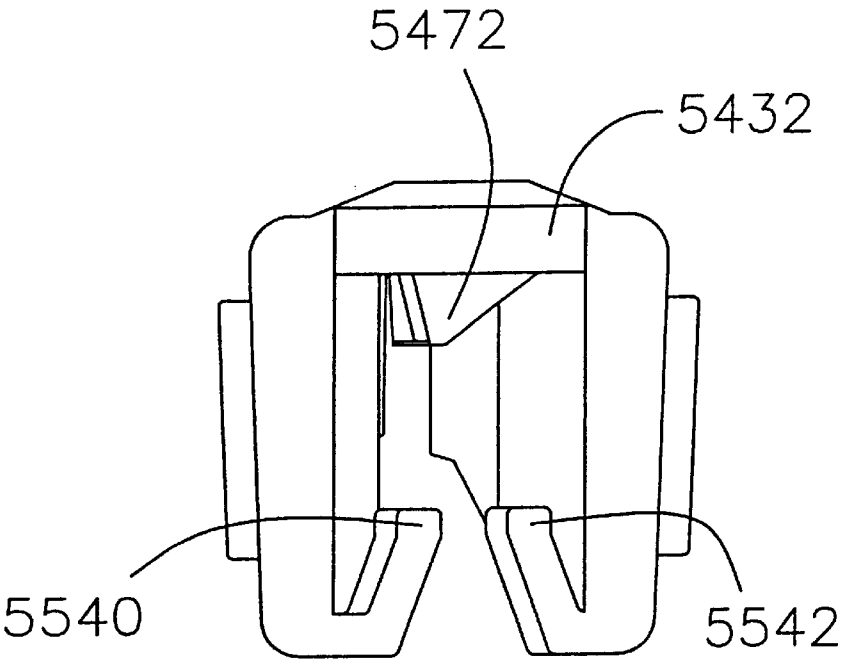
FIG. 76 is a front view of the slider in FIG. 74.

FIGS. 74–79 illustrate another embodiment of a slider 5432. The slider 5432 has a peg 5600 similar to the embodiment shown in FIGS. 72 and 73. However, the separator 5472 is at an angle to the longitudinal axis 102 as shown in FIGS. 74 and 75. Specifically, the separator 5472 has an axis 5473 which is at an angle of approximately 10–15 degrees from the longitudinal X axis 102. In addition, the legs 5540, 5542, 5560, 5562 are at an angle to the longitudinal axis 102. Specifically, the legs and shoulders 5540, 5542 have an axis 5543 which is at an angle of approximately 10–15 degrees from the longitudinal X axis 102. In addition, the legs and shoulders 5560, 5562 have an axis 5563 which is at an angle of approximately 10–15 degrees from the longitudinal X axis 102. The angles of the separator and the legs facilitate the movement of the slider 5432 along the fastening strips. As shown in FIG. 73, the fastening strips 130, 131 make a gradual bend 5573 as opposed to the bend shown in FIG. 72. Thus, the slider 5432 may move with less resistance.

Figure 79:
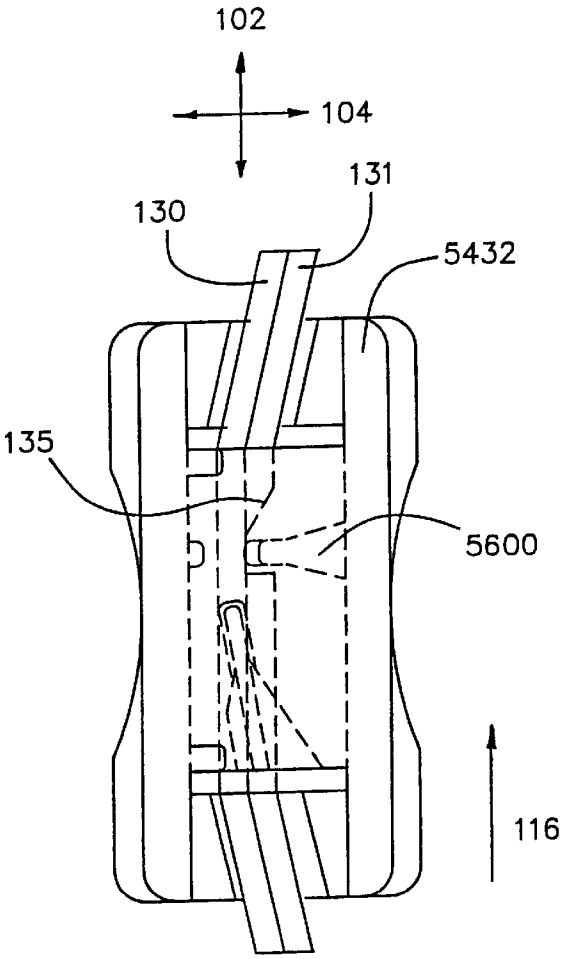
FIG. 79 is a top view of the slider and fastening strips in FIG. 78 with the slider engaging a detent in the fastening strips.
Figure 78:
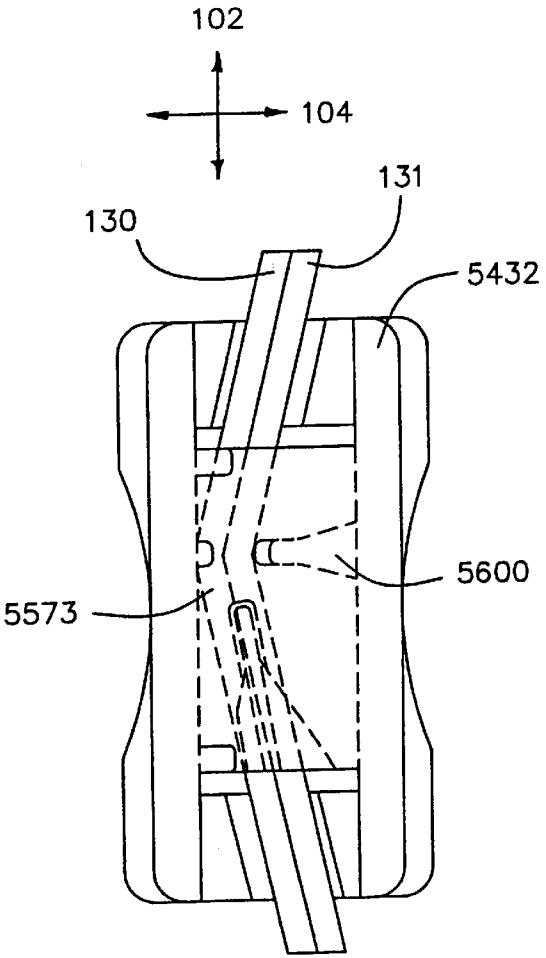
FIG. 78 is a top view of the slider in FIG. 74 and a partial view of the fastening strips.

Referring to FIGS. 78 and 79, the peg 5600 is provided for engaging the detents 135, 137 of the second fastening strip 131. Once the slider 5432 is moved a sufficient distance along the fastening strips 130, 131 in the horizontal X axis 102, the peg 5600 engages either detent 135, 137. For example, if the slider 5432 is continually moved in the deocclusion direction 116, the peg 5600 will eventually engage the detent 137 as illustrated in FIG. 79. The peg 5600 will resist further movement of the slider 5432 in the horizontal X axis 102 in the deocclusion direction 116. As a result, the slider 5432 may only be removed from the fastening strips 130, 131 in the horizontal X axis 102 by either tearing through the fastening strips 130, 131 or by breaking and/or deforming the peg 5600 of the slider 5432. It will be appreciated that the detents 135, 137 of the second fastening strip 131 may be provided on either the first or second fastening strip 130, 131 and should be on the fastening strip which contacts the peg 5600. In this connection, the slider 5432 may provide the peg 5600 on either side of the slider 5432 so as to correspond to the detents 135, 137 of the fastening strips 130, 131.

The slider of the present invention may incorporate several configurations. However, the slider should facilitate attachment of the slider onto the fastening strips in the vertical Z axis and prevent the removal of the slider from the fastening strips in the vertical Z axis and the horizontal X axis. Furthermore, the slider facilitates proper orientation of the fastening strips within the slider during operation. Proper orientation of the fastening strips within the slider is usually accomplished by providing legs which support the respective fastening strips. The design of the slider is further dictated by the configuration of fastening strips utilized.

Figure 80:
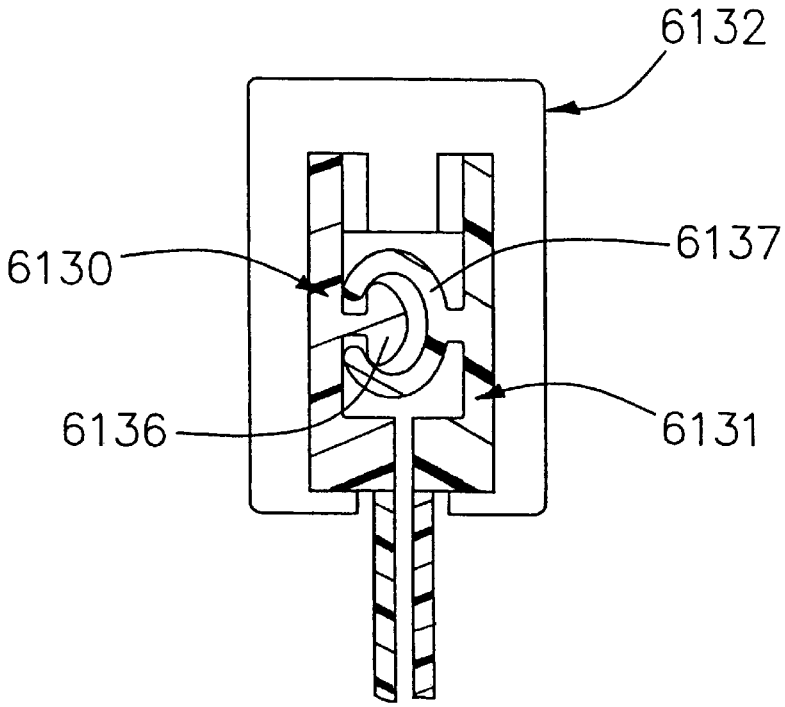
FIG. 80 is a rear view of another embodiment of the slider and a cross-sectional view of another embodiment of the fastening strips.
Figure 81:
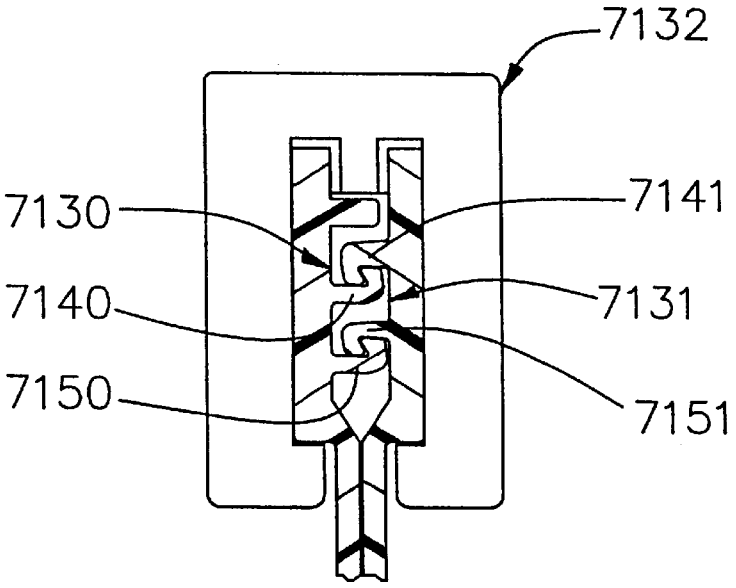
FIG. 81 is a rear view of another embodiment of the slider and a cross-sectional view of another embodiment of the fastening strips.
Figure 82:
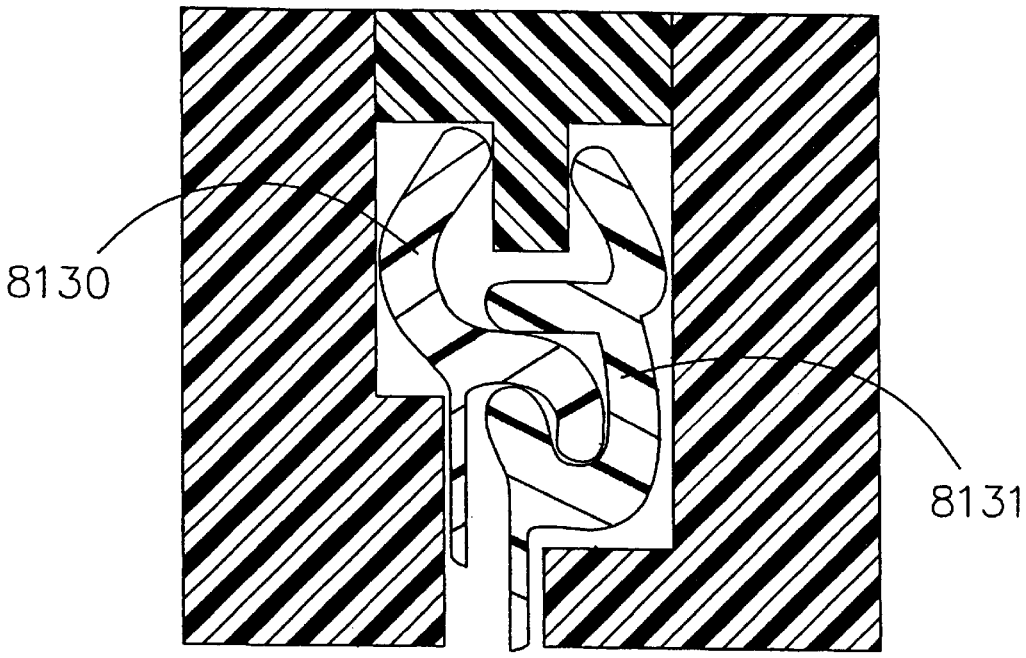
FIG. 82 is a rear view of another embodiment of the slider and a cross-sectional view of another embodiment of the fastening strips.

FIGS. 80–82 illustrate interlocking fastening strips of different configurations and the corresponding slider design. As shown in FIG. 80, the interlocking fastening strips may alternatively comprise "arrowhead-type" closure strips. As described more fully in U.S. Pat. Nos. 5,007,142 and 5,020,194, "arrowhead-type" closure strips typically include a first fastening strip 6130 with an engagement portion 6136, and an associated second fastening strip 6131 with an engagement portion 6137. In use, the first fastening strip 6130 and the second fastening strip 6131 are selectively occluded and deoccluded by moving the slider 6132 in the appropriate direction.

Additionally, the interlocking fastening strips may comprise "profile" closure strips, as shown in FIG. 81. As described more fully in U.S. Pat. No. 5,664,299, "profile" closure strips typically include a first fastening strip 7130 and a second fastening strip 7131 The first and second fastening strips 7130 and 7131 are selectively coupled and decoupled by moving the slider member 7132 in the appropriate direction.

Also, the interlocking fastening strips may be "rolling action" fastening strips 8130, 8131 as shown in FIG. 82 and described in U.S. Pat. No. 5,007,143.

The invention may also be used with a slider and fastening strips wherein the separator finger extends into the closure elements without extending completely through the closure elements. More specifically, the first closure element includes a first closure portion and a second closure portion and the second closure element includes a third closure portion and a fourth closure portion. The first closure portion engages the third closure portion and the second closure portion engages the fourth closure portion. The separator finger extends between the first and third closure portions but not between the second and fourth closure portions. One example is U.S. Pat. No. 5,664,299 which is incorporated herein by reference.

Although several interlocking fastening strip embodiments have been specifically described and illustrated herein, it will be readily appreciated by those skilled in the art that other kinds, types, or forms of fastening strips may alternatively be used without departing from the scope or spirit of the present invention.

The interlocking fastening strips of the present invention may be manufactured by extrusion through a die. In addition, the fastening strips may be manufactured to have approximately uniform cross-sections. This not only simplifies the manufacturing of a closure device, but also contributes to the physical flexibility of the closure device.

Generally, the interlocking fastening strips of the present invention may be formed from any suitable thermoplastic material including, for example, polyethylene, polypropylene, nylon, or the like, or from a combination thereof. Thus, resins or mixtures of resins such as high density polyethylene, medium density polyethylene, and low density polyethylene may be employed to prepare the interlocking fastening strips of the present invention. In most instances, the fastening strips are made from low density polyethylene. The selection of the appropriate thermoplastic material, however, is related to the particular design of the fastening strips, the Young's Modulus of the thermoplastic material, and the desired elasticity and flexibility of the strips.

When the fastening strips of the present invention are used in a sealable bag, the fastening strips and the films that form the body of the bag may be conveniently manufactured from heat sealable material. In this way, the bag may be economically formed by using an aforementioned thermoplastic material and by heat sealing the fastening strips to the bag. In most instances, the bag is made from a mixture of high pressure, low density polyethylene and linear, low density polyethylene.

The fastening strips of the present invention may be manufactured by extrusion or other known methods. For example, the closure device may be manufactured as individual fastening strips for later attachment to the bag or may be manufactured integrally with the bag. In addition, the fastening strips may be manufactured with or without flange portions on one or both of the fastening strips depending upon the intended use of the closure device or expected additional manufacturing operations.

Generally, the closure device of the present invention can be manufactured in a variety of forms to suit the intended use. In practicing the present invention, the closure device may be integrally formed on the opposing side walls of the container or bag, or connected to the container by the use of any of many known methods. For example, a thermoelectric device may be applied to a film in contact with the flange portion of the fastening strips or the thermoelectric device may be applied to a film in contact with the base portion of fastening strips having no flange portion, to cause a transfer of heat through the film to produce melting at the interface of the film and a flange portion or base portion of the fastening strips. Suitable thermoelectric devices include heated rotary discs, traveling heater bands, resistance-heated slide wires, and the like. The connection between the film and the fastening strips may also be established by the use of hot melt adhesives, hot jets of air to the interface, ultrasonic heating, or other known methods. The bonding of the fastening strips to the film stock may be carried out either before or after the film is U-folded to form the bag. In any event, such bonding is done prior to side sealing the bag at the edges by conventional thermal cutting. In addition, the first and second fastening strips may be positioned on opposite sides of the film. Such an embodiment would be suited for wrapping an object or a collection of objects such as wires. The first and second fastening strips should usually be positioned on the film in a generally parallel relationship with respect to each other, although this will depend on the intended use.

The slider may be multiple parts and snapped together. In addition, the slider may be made from multiple parts and fused or welded together. The slider may also be a one piece construction. The slider can be colored, opaque, translucent or transparent. The slider may be injection molded or made by any other method. The slider may be molded from any suitable plastic material, such as, nylon, polypropylene, polystyrene, acetal, toughened acetal, polyketone, polybutylene terrephthalate, high density polyethylene, polycarbonate or ABS (acrylonitrile-butadiene-styrene). The selection of the material may be determined by the characteristics to be achieved by the slider.

In summary, the present invention affords a closure device with interlocking fastening strips, a slider which facilitates the occlusion and deocclusion of the fastening strips, and a flexibly resistant attaching means which facilitates attachment of the slider onto the fastening strips in the vertical Z axis and prevents the removal of the slider from the fastening strips in the vertical Z axis thereafter. A flexible occlusion member prevents removal of the slider in the horizontal X axis.

From the foregoing it will be understood that modifications and variations may be effectuated to the disclosed structures—particularly in light of the foregoing teachings—without departing from the scope or spirit of the present invention. As such, no limitation with respect to the specific embodiments described and illustrated herein is intended or should be inferred. Indeed, the following claims are intended to cover all modifications and variations that fall within the scope and spirit of the present invention. In addition, all references and copending applications cited herein are hereby incorporated by reference in their entireties.

What is claimed is:

1. A closure device comprising:

a first fastening strip;

a second fastening strip wherein a length of said first fastening strip is occluded to a corresponding length of said second fastening strip to provide an occluded length, a slider slidably disposed on said fastening strips and facilitating the occlusion of said fastening strips when moved towards a first end thereof and facilitating the deocclusion of said fastening strips when moved towards a second end thereof, said fastening strips and said slider having a longitudinal X axis and a transverse Y axis, said transverse Y axis being perpendicular to said longitudinal X axis, said fastening strips and said slider having a vertical Z axis, said vertical Z axis being perpendicular to said longitudinal X axis, said vertical Z axis being perpendicular to said transverse Y axis, said slider comprising a housing having a separator facilitating the deocclusion of said fastening strips, said separator penetrating said occluded length of said fastening strips during attachment of said slider onto said fastening strips in said vertical Z axis.

2. The invention as in claim 1 wherein said occluded length is a portion of said fastening strips.

3. The invention as in claim 1 wherein said occluded length is the entire length of said fastening strips.

4. The invention as in claim 1, wherein said fastening strips comprise U-channel type fastening strips.

5. The invention as in claim 1, wherein said fastening strips comprise arrowhead type fastening strips.

6. The invention as in claim 1, wherein said fastening strips comprise profile type fastening strips.

7. The invention as in claim 1, wherein said separator has a first end and a second end, a portion of said separator angles downwardly relative to the longitudinal X axis from said first end to said second end.

8. The invention as in claim 7 wherein a portion of said separator angles inwardly relative to the longitudinal X axis from said first end to said second end.

9. The invention as in claim 7 wherein said separator has a bottom surface and said bottom surface angles downwardly relative to the longitudinal X axis from said first end to said second end.

10. The invention as in claim 9 wherein said bottom surface angles inwardly relative to the longitudinal X axis from said first end to said second end.

11. The invention as in claim 7 wherein said separator has a bottom surface and said bottom surface angles inwardly relative to the longitudinal X axis from said first end to said second end.

12. The invention as in claim 7 wherein said separator has a first side wall and a second side wall, a bottom portion of said first side wall and a bottom portion of said second side wall angle downwardly relative to the longitudinal X axis from said first end to said second end.

13. The invention as in claim 12 wherein said bottom portions of said side walls angle inwardly relative to the longitudinal X axis.

14. The invention as in claim 1 wherein said separator has a first end and a second end, a portion of said separator angles inwardly relative to the longitudinal X axis from said first end to said second end.

15. The invention as in claim 14 wherein said separator has a first side wall, said first side wall angles inwardly relative to the longitudinal X axis.

16. The invention as in claim 14 wherein said separator has a first side wall and a second side wall, said first side wall and said second side wall angle inwardly relative to the longitudinal X axis from said first end to said second end.

17. The invention as in claim 1 wherein said separator has a first end, a second end, a first sidewall, a second sidewall and a bottom surface, said bottom surface angles downwardly relative to the longitudinal X axis from said first end to said second end, said first sidewall angles inwardly relative to the longitudinal X axis.

18. The invention as in claim 7 wherein said separator has a bottom surface and a portion of said bottom surface is parallel to said longitudinal X axis.

19. The invention as in claim 18 wherein said bottom surface includes a ridge.

20. The invention as in claim 18 wherein said bottom surface has a horizontal surface, a first side surface and a second side surface.

21. The invention as in claim 18 wherein said separator has a first side wall, said first side wall having a first bottom portion, said first bottom portion angles upwardly relative to the longitudinal X axis from said first end to said second end.

22. The invention as in claim 21 wherein said first side wall angles inwardly relative to the longitudinal X axis from said first end to said second end.

23. The invention as in claim 21 wherein said separator has a second side wall, said second side wall has a second bottom portion, said second bottom portion angles upwardly relative to the longitudinal X axis from said first end of said second end.

24. The invention as in claim 23 wherein said second side wall angles inwardly relative to the longitudinal X axis from said first end to said second end.

25. The invention as in claim 24 wherein said first side wall angles inwardly relative to the longitudinal X axis from said first end to said second end.

26. The invention as in claim 18 wherein said bottom surface includes a first angled surface, said first angled surface has a first outside edge, said first angled surface angles downwardly relative to the vertical Z axis from said outside edge.

27. The invention as in claim 26 wherein said bottom surface includes a second angled surface, said second angled surface has a second outside edge, said second angled surface angles downwardly relative to the vertical Z axis from said outside edge.

28. The invention as in claim 27 wherein said bottom surface includes a ridge.

29. The invention as in claim 27 wherein said bottom surface includes a horizontal surface, a first side surface and a second side surface.

30. The invention as in claim 27 wherein said separator has a first side wall, said first side wall having a first bottom portion, said first bottom portion angles downwardly relative to the longitudinal X axis from said first end to said second end.

31. The invention as in claim 27 wherein said first side wall angles inwardly relative to the longitudinal X axis from said first end to said second end.

32. The invention as in claim 30 wherein said separator has a second side wall, said second side wall has a second bottom portion, said second bottom portion angles downwardly relative to the longitudinal X axis from said first end of said second end.

33. The invention as in claim 32 wherein said second side wall angles inwardly relative to the longitudinal X axis from said first end to said second end.

34. The invention as in claim 33 wherein said first side wall angles inwardly relative to the longitudinal X axis from said first end to said second end.

35. The invention as in claim 1, wherein said slider further comprises a flexible attachment means for facilitating the attachment of said slider onto said fastening strips in said vertical Z axis and preventing removal of said slider from said fastening strips in the vertical Z axis thereafter.

36. The invention as in claim 35, wherein said flexible attachment means deflects during attachment of said slider onto said fastening strips to permit passage of said fastening strips into said housing and retracts back to its original position once said fastening strips have passed into said housing.

37. The invention as in claim 36, wherein said flexible attachment means comprises a portion of said housing of said slider.

38. The invention as in claim 36, wherein said flexible attachment means comprises a pair of flexible legs operably attached to said housing of said slider.

39. A slider for slidable disposition on first and second fastening strips wherein a length of said first fastening strip is occluded to a corresponding length of said second fastening strip, said slider facilitating the occlusion of said fastening strips when moved towards a first end thereof and facilitating the deocclusion of said fastening strips when moved towards a second end thereof, said slider comprising:

a longitudinal X axis and a transverse Y axis, said transverse Y axis being perpendicular to said longitudinal X axis, said fastening strips and said slider having a vertical Z axis, said vertical Z axis being perpendicular to said longitudinal X axis, said vertical Z axis being perpendicular to said transverse Y axis, said slider comprising a housing having a separator facilitating the deocclusion of said fastening strips, said separator penetrating said occluded length of said fastening strips during attachment of said slider onto said fastening strips in said vertical Z axis.

40. The invention as in claim 39 wherein said occluded length is a portion of said fastening strips.

41. The invention as in claim 39 wherein said occluded length is the entire length of said fastening strips.

42. The invention as in claim 39, wherein said separator has a first end and a second end, a portion of said separator angles downwardly relative to the longitudinal X axis from said first end to said second end.

43. The invention as in claim 42, wherein a portion of said separator angles inwardly relative to the longitudinal X axis from said first end to said second end.

44. The invention as in claim 39 wherein said separator has a first end and a second end, a portion of said separator angles inwardly relative to the longitudinal X axis from said first end to said second end.

45. A container comprising:

first and second side walls, said first and second side walls including mating first and second fastening strips respectively, said first and second fastening strips comprising a closure device wherein a length of said first fastening strip is occluded to a corresponding length of said second fastening strip, a slider slidably disposed on said fastening strips and facilitating the occlusion of said fastening strips when moved towards a first end thereof and facilitating the deocclusion of said fastening strips when moved towards a second end thereof, said fastening strips and said slider having a longitudinal X axis and a transverse Y axis, said transverse Y axis being perpendicular to said longitudinal X axis, said fastening strips and said slider having a vertical Z axis, said vertical Z axis being perpendicular to said longitudinal X axis, said vertical Z axis being perpendicular to said transverse Y axis, said slider comprising a housing having a separator facilitating the deocclusion of said fastening strips, said separator penetrating said occluded length of said fastening strips during attachment of said slider onto said fastening strips in said vertical Z axis.

46. The invention as in claim 45 wherein said occluded length is a portion of said fastening strips.

47. The invention as in claim 45 wherein said occluded length is the entire length of said fastening strips.

48. The invention as in claim 45, wherein said separator has a first end and a second end, a portion of said separator angles downwardly relative to the longitudinal X axis from said first end to said second end.

49. The invention as in claim 48, wherein a portion of said separator angles inwardly relative to the longitudinal X axis from said first end to said second end.

50. The invention as in claim 45 wherein said separator has a first end and a second end, a portion of said separator angles inwardly relative to the longitudinal X axis from said first end to said second end.

51. A method of assembling a slider onto a closure device comprising the steps of:

providing a first fastening strip, providing a second fastening strip wherein a length of said first fastening strip is occluded to a corresponding length of said second fastening strip to provide an occluded length, providing a slider for slidable disposition on said fastening strips and facilitating the occlusion of said fastening strips when moved towards a first end thereof and facilitating the deocclusion of said fastening strips when moved towards a second end thereof, said fastening strips and said slider having a longitudinal X axis and a transverse Y axis, said transverse Y axis being perpendicular to said longitudinal X axis, said fastening strips and said slider having a vertical Z axis, said vertical Z axis being perpendicular to said longitudinal X axis, said vertical Z axis being perpendicular to said transverse Y axis, said slider comprising a housing having a separator facilitating the deocclusion of said fastening strips, urging said slider onto said occluded length of said fastening strips in said vertical Z axis whereby said separator penetrates a portion of said occluded length of said fastening strips.

52. The invention as in claim 51 wherein said occluded length is a portion of said fastening strips.

53. The invention as in claim 51 wherein said occluded length is the entire length of said fastening strips.

54. The invention as in claim 51, wherein said separator has a first end and a second end, a portion of said separator angles downwardly relative to the longitudinal X axis from said first end to said second end.

55. The invention as in claim 54, wherein a portion of said separator angles inwardly relative to the longitudinal X axis from said first end to said second end.

56. The invention as in claim 51 wherein said separator has a first end and a second end, a portion of said separator angles inwardly relative to the longitudinal X axis from said first end to said second end.

57. A closure device comprising first and second interlocking fastening strips arranged to be interlocked over a predetermined length, said fastening strips have a longitudinal X axis, said fastening strips have a transverse Y axis, said transverse Y axis is perpendicular to said longitudinal X axis said fastening strips have a vertical Z axis said vertical Z axis, is perpendicular to said longitudinal X axis, said vertical Z axis is perpendicular to said transverse Y axis, a slider which slidably engages said first and second fastening strips, said slider facilitates the occlusion of said fastening strips when moved towards a first end of said fastening strips and deocclusion of said fastening strips when moved toward a second end of said fastening strips, said fastening strips are deoccluded by moving said first fastening strip relative to said second fastening strip in the transverse Y axis and in the vertical Z axis;

said first fastening strip comprises a first web, said first web extending from said first fastening strip, said first web terminating in a first closure portion, said second fastening strip comprises a second web, said second web extending from said second fastening strip, said second web terminating in a second closure portion which engages said first closure portion when said fastening strips are occluded;

the first web and the first closure portion deflect during deocclusion of said fastening strips;

said first fastening strip includes a third web, said third web spaced from said first web, said third web includes a third closure portion, said second fastening strip includes a fourth web, said fourth web spaced from said second web, and said fourth web includes a fourth closure portion which engages the third closure portion, said third closure portion and said fourth closure portion shear and deflect during deocclusion of said fastening strips; and wherein said first closure portion is a first hook, said third closure portion is a third hook facing toward said first hook, said second closure portion is a second hook, and said fourth closure portion is a fourth hook facing away from said second hook.

58. The invention as in claim 57 wherein said first and third hooks include guide surfaces to guide said first and third hooks with said second and fourth hooks.

59. The invention as in claim 57 wherein said second and fourth hooks include guide surfaces to guide said second and fourth hooks with said first and third hooks.

60. The invention as in claim 57 wherein during deocclusion of the fastening strips, said first closure portion and said second closure portion deflect to deocclude, then said third closure portion and said fourth closure portion shear and deflect to deocclude.

61. The invention as in claim 57 wherein said slider has a first shoulder to engage the first fastening strip.

62. The invention as in claim 61 wherein said shoulder facilitates moving the first fastening strip in the vertical Z axis.

63. The invention as in claim 57 wherein said slider has a second shear wing to engage the second fastening strip.

64. The invention as in claim 63 wherein said second shear wing facilitates moving the first fastening strip relative to the second fastening strip in the vertical Z axis.

65. The invention as in claim 64 wherein said shoulder facilitates moving the first fastening strip relative to the second fastening strip in the vertical Z axis.

66. A closure device comprising first and second interlocking fastening strips arranged to be interlocked over a predetermined length, said fastening strips have a longitudinal X axis, said fastening strips have a transverse Y axis, said transverse Y axis is perpendicular to said longitudinal X axis, said fastening strips have a vertical Z axis, said vertical Z axis is perpendicular to said longitudinal X axis, said vertical Z axis is perpendicular to said transverse Y axis, a slider which slidably engages said first and second fastening strips, said slider facilitates the occlusion of said fastening strips when moved towards a first end of said fastening strips and deocclusion of said fastening strips when moved toward a second end of said fastening strips, said fastening strips are deoccluded by moving said first fastening strip relative to said second fastening strip in the transverse Y axis and in the vertical Z axis; said slider has a second shear wing to engage the second fastening strip; and wherein said second fastening strip has a first protrusion and said second shear wing engages said first protrusion.

67. The invention as in claim 63 wherein said slider has a first end and a second end, said slider has a separator, said separator is located between said first end and said second end, said second shear wing is located between said separator and said second end.

68. The invention as in claim 67 wherein said second shear wing is located between said shoulder and said separator.

69. The invention as in claim 63 wherein said slider has a second shoulder to engage the second fastening strip and a first shear wing to engage the first fastening strip.

70. The invention as in claim 63 wherein said slider has a second side wall, said shear wing extends from said second side wall.

71. The invention as in claim 61 wherein said slider has a housing, said first shoulder is flexibly connected to said housing.

72. A slider for slidable disposition on first and second fastening strips, said fastening strips arranged to be interlocked over a predetermined length, said fastening strips having a longitudinal X axis, said fastening strips having a transverse Y axis, said transverse Y axis is perpendicular to said longitudinal X axis, said fastening strips having a vertical Z axis, said vertical Z axis is perpendicular to said longitudinal X axis, said vertical Z axis is perpendicular to said transverse Y axis, said slider comprising:

a housing which slidably engages said first and second fastening strips, said slider facilitates the occlusion of said fastening strips when moved towards a first end of said fastening strips and deocclusion of said fastening strips when moved toward a second end of said fastening strips, said fastening strips are deoccluded by moving said first fastening strip relative to said second fastening strip in the transverse Y axis and in the vertical Z axis;

said first fastening strip comprises a first web, said first web extending from said first fastening strip, said first web terminating in a first closure portion, said second fastening strip comprises a second web, said second web extending from said second fastening strip, said second web terminating in a second closure portion which engages said first closure portion when said fastening strips are occluded;

the first web and the first closure portion deflect during deocclusion of said fastening strips;

said first fastening strip includes a third web, said third web spaced from said first web, said third web includes a third closure portion, said second fastening strip includes a fourth web, said fourth web spaced from said second web, and said fourth web includes a fourth closure portion which engages the third closure portion, said third closure portion and said fourth closure portion shear and deflect during deocclusion of said fastening strips; and wherein said first closure portion is a first hook, said third closure portion is a third hook facing toward said first hook, said second closure portion is a second hook, and said fourth closure portion is a fourth hook facing away from said second hook.

73. A container comprising:

first and second side walls including first and second fastening strips respectively, said fastening strips arranged to be interlocked over a predetermined length, said fastening strips have a longitudinal X axis, said fastening strips have a transverse Y axis, said transverse Y axis is perpendicular to said longitudinal X axis, said fastening strips have a vertical Z axis, said vertical Z axis is perpendicular to said longitudinal X axis, said vertical Z axis is perpendicular to said transverse Y axis, a slider which slidably engages said first and second fastening strips, said slider facilitates the occlusion of said fastening strips when moved towards a first end of said fastening strips and deocclusion of said fastening strips when moved toward a second end of said fastening strips, said fastening strips are deoccluded by moving said first fastening strip relative to said second fastening strip in the transverse Y axis and in the vertical Z axis;

said first fastening strip comprises a first web, said first web extending from said first fastening strip, said first web terminating in a first closure portion, said second fastening strip comprises a second web, said second web extending from said second fastening strip, said second with terminating in a second closure portion which engages said first closure portion when said fastening strips are occluded;

the first web and the first closure portion deflect during deocclusion of said fastening strips;

said first fastening strip includes a third web, said third web spaced from said first web, said third web includes a third closure portion, said second fastening strip includes a fourth web, said fourth web spaced from said second web, and said fourth web includes a fourth closure portion which engage the third closure portion, said third closure portion and said fourth closure portion shear and deflect during deocclusion of said fastening strips;

wherein said first closure portion is a first hook, said third closure portion is a third hook facing toward said first hook, said second closure portion is a second hook, and said fourth closure portion is a fourth hook facing away from said second hook.

74. A method of using a closure device comprising the steps of:

providing first and second fastening strips arranged to be interlocked over a predetermined length said fastening strips have a longitudinal X axis, said fastening strips have a transverse Y axis, said transverse Y axis is perpendicular to said longitudinal X axis, said fastening strips have a vertical Z axis, said vertical Z axis is perpendicular to said longitudinal X axis, said vertical Z axis is perpendicular to said transverse Y axis, providing a slider which slidably engages said first and second fastening strips, said slider facilitates the occlusion of said fastening strips when moved towards a first end of said fastening strips and deocclusion of said fastening strips when moved toward a second end of said fastening strips, said fastening strips are deocluded by moving said first fastening strip relative to said second fastening strip in the transverse Y axis and in the vertical Z axis, moving said slider along said fastening strips toward a second end of said fastening strips;

said first fastening strip comprises a first web, said first web extending from said first fastening strip, said first web terminating in a first closure portion, said second fastening strip comprises a second web, said second web extending from said second fastening strip, said second web terminating in a second closure portion which engages said first closure portion when said fastening strips are occluded;

the first web and the first closure portion deflect during deocclusion of said fastening strips;

said first fastening strip includes a third web, said third web spaced from said first web, said third web includes a third closure portion, said second fastening strip includes a fourth web, said fourth web spaced from said second web, and said fourth web includes a fourth closure portion which engages the third closure portion, said third closure portion and said fourth closure portion shear and deflect during deocclusion of said fastening strips; and wherein said first closure portion is a first hook, said third closure portion is a third hook facing toward said first hook, said second closure portion is a second hook, and said fourth closure portion is a fourth hook facing away from said second hook.

* * * * *